US006470870B1

(12) United States Patent
Schaar

(10) Patent No.: US 6,470,870 B1
(45) Date of Patent: Oct. 29, 2002

(54) SYNCHRONOUS COMPOUND BOW WITH NON-COPLANAR ACTUATORS AND INTERCHANGEABLE LEVERAGING COMPONENTS

(76) Inventor: John G. Schaar, 1048 W. Greenway Dr., Tempe, AZ (US) 85282

( * ) Notice: Subject to any disclaimer, the term of this patent is extended or adjusted under 35 U.S.C. 154(b) by 0 days.

(21) Appl. No.: 09/718,157

(22) Filed: Nov. 22, 2000

(51) Int. Cl.[7] ..... F41B 5/10
(52) U.S. Cl. ..... 124/25.6
(58) Field of Search ..... 124/23.1, 25.6, 124/86, 88, 900

(56) References Cited

U.S. PATENT DOCUMENTS

| | | | | | |
|---|---|---|---|---|---|
| 4,287,867 | A | * | 9/1981 | Islas | |
| 4,649,890 | A | * | 3/1987 | Powers | |
| 4,858,588 | A | * | 8/1989 | Bozek | |
| 5,024,206 | A | * | 6/1991 | Lester | 124/23.1 |
| 5,388,564 | A | * | 2/1995 | Islas | 124/25.6 |
| 5,979,425 | A | * | 11/1999 | Loomis | 124/25.6 |
| 6,029,644 | A | * | 2/2000 | Bronnert | 124/25.6 |
| 6,055,974 | A | * | 5/2000 | Dieziger | 124/23.1 |
| 6,067,974 | A | * | 5/2000 | Islas | 124/25.6 |

* cited by examiner

*Primary Examiner*—John A. Ricci

(57) ABSTRACT

An archers bow comprising a center riser section, two primary resilient limbs, a pair of twin grooved, dual-planar compound pulleys, with the compound pulleys being employed in a multiple of possible ways with non-coplanar actuator elements for purposes of inducing mechanical advantage, with the mechanical advantage induced by the pulleys being used by the archer to aid in bending the limbs on the bow in a manner which eliminates pulley/actuator induced torsion from the system. The invention defines an actuator configuration for the pulleys consisting of one or more sections, including tensioning actuator sections and one actuator section that is suitable for use as a bowstring, and includes a method for connecting the tensioning actuators to the pulleys, and to terminating locations on a pair of resilient Pulley Return Energy Storage e.g. PRES components provided separately for that purpose, which, in an overall bow configuration, provides that aside from the bowstring section used by the archer to actuate the pulleys, no part of the actuator or actuators connected to the pulleys is ever positioned in a manner whereby the actuator or actuators would intersect the horizontal plane bisecting the riser assembly of the bow at any time. The invention further seeks to define, and provide methods for solving, a plurality of known, as well as some perhaps previously unknown, problems affecting compound bows which have not been successfully addressed previously. The inventive bow defines and incorporates combinations of interchangeable components which can be configured to produce a variety of energy storing patterns for archers of all draw lengths, while allowing use of decreased fistmele distances, which serves to lengthen acceleration stroke distances.

21 Claims, 14 Drawing Sheets

Sight window down and profile pattern yields right hand riser body

Sight window up and profile pattern yields left hand riser body

Step 1

Using Lathe Relieve area that will provide a pivot surface and part off at a proper overall width.

Step 2

Using a mill Relieve a flat surface for the limb to rest on.

Step 3

Using a mill/Drill Relieve Material (shallow holes) to seat damper pads when bow is assembled.

Step 4

(optional) Mill away excess material to lighten the part.

| | Eccentric/Eccentric | Concentric/Eccentric | Concentric/Concentric |
|---|---|---|---|
| 1st Quarter (at rest) | P1=.30" S1=.70" Ratio P1 : S1 = 1 : 2.3 | P1=1.30" S1=.50" Ratio P1 : S1 = 2.6 : 1 | P1=1.30" S1=.60" Ratio P1 : S1 = 2.1 : 1 |
| 2nd Quarter | P2=1.40" S2=.90" Ratio P2 : S2 = 1.5 : 1 | P2=1.30" S2=.90" Ratio P2 : S2 = 1.4 : 1 | P2=1.30" S2=.60" Ratio P2 : S2 = 2.1 : 1 |
| 3rd Quarter | P3=2.25" S3=.80" Ratio P3 : S3 = 2.8 : 1 | P3=1.30" S3=.90" Ratio P3 : S3 = 1.4 : 1 | P3=1.30" S3=.60" Ratio P3 : S3 = 2.1 : 1 |
| 4th Quarter | S4=.25" P4=1.90" Ratio P4 : S4 = 7.6 : 1 | P4=1.30" S4=.25" Ratio P4 : S4 = 5.2 : 1 | P4=1.30" S4=.60" Ratio P4 : S4 = 2.1 : 1 |

FIG. 7D

SYNCHRONOUS COMPOUND BOW WITH NON-COPLANAR ACTUATORS AND INTERCHANGEABLE LEVERAGING COMPONENTS

PRIOR ART REFERENCES

| | | |
|---|---|---|
| 12/1969 | Allen | 3,486,495 |
| 7/1973 | Nishioka | 3,744,473 |
| 10/1974 | Ikeya | 3,844,268 |
| 11/1974 | Eicholtz | 3,850,156 |
| 2/1975 | Helmick | 3,865,095 |
| 10/1976 | Islas | 3,981,290 |
| 2/1976 | Nishioka | 3,989,026 |
| 11/1976 | Groves | 3,993,039 |
| 2/1977 | Jennings | 4,005,696 |
| 12/1975 | Trotter | 3,923,035 |
| 8/1978 | Shepley | 4,103,667 |
| 1/1980 | Caldwell | 4,188,345 |
| 10/1980 | Jones | 4,227,509 |
| 9/1981 | Islas | 4,287,867 |
| 7/1982 | Darlington | 4,338,910 |
| 12/1982 | Nishioka | 4,365,611 |
| 1/1983 | Simonds | 4,368,718 |
| 8/1983 | Simonds | 4,401,097 |
| 3/1984 | Ricord | 4,457,288 |
| 4/1984 | Simonds | 4,461,267 |
| 8/1984 | Nishioka | 4,465,054 |
| 7/1985 | Simo | 4,530,342 |
| 3/1987 | Powers | 4,649,890 |
| 5/1987 | Humphrey | 4,667,649 |
| 6/1987 | Schaar | 4,669,445 |
| 8/1987 | Larson | 4,686,955 |
| 3/1989 | Felice et.al | 4,819,608 |
| 10/1990 | Pickering et.al. | 4,957,094 |
| 2/1998 | Allshouse et al | 5,718,212 |
| 7/1999 | Allshouse et al | 5,921,227 |

BACKGROUND OF THE INVENTION—INTRODUCTION

In 1969 Holless W. Allen received a patent (U.S. Pat. No. 3,486,495) on the first successfully marketed version of an archers bow using mechanical advantage gained by affixing a pulley system to the ends of the bows limbs. Prior to Allen's bow, other mechanically advantaged bow inventions had centered more on employing springs or other mechanical means to accelerate the two bow limbs, with each limb being mounted over a pivot which incorporated a rotating axle, similar to simple catapults. Allen's invention accomplished the desired adaptation of mechanical advantage in a manner that both:

1. allowed the archer to flex (bend) limbs that were stiffer than he or she could have bent without the aid of the pulley system, and
2. provided that the amount of drawing force required to hold the bow in a fully drawn position was less than the amount of drawing force needed to reach peak energy storage in the "system" during the process of drawing the bow back to full draw from an "at rest" position. This was accomplished by placing the pulleys axle hole in an eccentric position.

The stated objective of the Allen Patent application providing that the invention would also allow the use of less stiff (and therefore smaller diameter and lighter for a given length and type of material) arrows, thereby further dramatically increasing arrow velocity, did not initially materialize effectively in practice due to other elements of the invention that were later found to offset this hoped for effect, and due to reduced target penetration that was found to occur when using the lightest arrows possible from the new style bow. Modest (10–20 feet per second) increases over the older recurve bow styles of the same draw length and draw weight occurred, due to the difference in the manner whereby compound bows released their stored energy into accelerating the arrow out of the bow (higher amount of energy transmitted for a somewhat longer period of time overall).

Allen's "compound" bow, as all such mechanically advantaged bows thereafter came to be known, employed a compound style pulley system wherein one end of a cable was pre-wrapped around one groove of a twin grooved, eccentrically mounted pulley suspended from an axle assembly that was, in turn, mounted near the outmost end of one of the bows two flexible cantilever type limbs. Sufficient length of cable, in addition to that needed to surround the pulley groove on this side of the pulley (primary pulley side), was provided for later attaching a bowstring to this end of the cable during the assembly of the bow.

The opposite end of the same cable passed diagonally through the pulley emerging from the opposite side (secondary side) of the pulley and traveled, without first being wrapped around the second groove cut in the secondary side of the pulley, from the point of emergence from it's groove to a point where it was fixedly attached directly to the limb on the other end of the bow (in the first "two-pulley" models introduced in the market, however, circa 1974, the tieoff point for the tensioning actuators was moved to a point on the axle that was supporting the eccentric compound pulley mounted on the other end of the bow).

As the archer drew the bow back to full draw, the cable that was pre-wrapped around the groove comprising the outside circumference of the primary side of the compound pulley was unrolled in a manner that effectively caused the bows draw length to lengthen and concurrently applied leverage to the opposite (secondary) side of the pulley which simultaneously wrapped up cable into the groove comprising the circumference of that pulley side, exerting pressure on the point where the end of the cable exiting the secondary side of the pulley was tied off on (fixedly connected to) the limb on the other end of the bow, thus causing the limb mounted at the opposite end of the bows riser section to be pulled in the direction of the pulley that was exerting the pulling force.

When the bowstring was released, after the bow had been drawn back to a fully drawn state ("full draw"), the limbs returned to their original position, causing the cables now wrapped around the groove surrounding the circumference of the secondary side of each pulley to now unroll from the groove that they had been wrapped around, and the (then unwrapped) cable in the pulley groove surrounding the circumference of the primary side of each pulley to then simultaneously once again become wrapped around it's groove as was the case prior to beginning the drawing of the bow. Thus, the pulley on the top limb of the bow was rotated back to it's original, pre-drawn position by pressure exerted from the energy stored in the limb on the bottom of the bow, and the pulley on the bottom limb of the bow was rotated back to it's original pre-drawn position by pressure exerted from the energy stored in the limb mounted on the top end of the bow.

Allen's invention called for each bow limb to incorporate such a "compound" pulley system with each such pulley providing mechanical leverage in a manner that actually bent or flexed the limb on the opposite end of the bow during the drawing of the bow, and for the energy then stored in each limb on the bow to then provide the force necessary to rotate the opposite pulley back to it's original position when the bowstring was released, after drawing the bow back to full draw, all in a necessarily very closely "bisynchronized" manner so as to provide for also accelerating the arrow in a manner that did not cause it to vary from the direction of aim as it was propelled forward from the bow.

The "bisynchronous" nature of the limb/pulley arrangement employed in Allen's invention required that the actuators (cables) that operated the pulleys mounted on each bow limb intersect one another or "cross over" at some point intermediate to the bowstring and the frontmost point on the bow.

Two cables, normally constructed of steel aircraft cable (usually coated with nylon, one for each pulley) intersecting each other at a point between the bowstring and the handle or grip section of the bow, were most commonly employed as pulley actuators to roll and unroll the pulleys themselves, with a separate "bowstring section" made of lighter in weight (normally dacron) material being used to connect the free ends of the cable end that started out pre-wrapped around each pulley.

Since 1969, many different variations of the wire rope/bowstring "stringing" approaches, designed to provide a system of "working" actuators for the bisynchronous limb/pulley arrangement specified in Allen's invention, have found their way into the marketplace, including combinations using all wire rope in a "continuous loop" and similar arrangements made out of newer materials such as aramid and polyolefin fibers, and versions that provided for the cables to "cross over" in recessed grooves reserved for that purpose in the handle "riser" section of the bow.

Allen's invention was a commercial success because it more effectively addressed several important needs of the majority of archers than had prior art versions of archers bows. The market for archers bows consists, in the very great majority (over 95% of archers, worldwide), of hunting enthusiasts for whom arrow velocity, flat trajectory (an element directly tied to velocity), penetration at the target, and accuracy, have always in the past, and continue to be, considered to be of great importance.

Allen's invention contributed some measure of improvement to each of these areas. The capability, using pulley system induced mechanical advantage, to bend much stiffer limbs, allowed archers to release additional stored energy into accelerating the arrow, and somewhat higher arrow velocities resulted, as did somewhat flatter arrow flight trajectories. Much less dramatic, but still measurable, increases in target penetration (given target arrows and points) resulted from the higher velocities. While the bow itself was not as inherently accurate as many prior art bows, due to torsion related problems, archers were nevertheless often able to achieve somewhat higher levels of net accuracy as well, (also primarily with target points), resulting primarily from the newfound ability to hold and aim longer and more effectively, due to the reduced draw force needed to hold the bow in a fully drawn state. "Net" Accuracy and penetration improvements were highly questionable when hunting points were substituted for non-bladed target points.

A number of other areas of importance to hunting archers were not addressed at all in the Allen Patent. These related to:

1) the difficulty associated with obtaining consistently good shooting accuracy, especially when using arrows having bladed points,
2) the need for light overall bow carrying weights for shooter comfort,
3) difficulties encountered by users when attempting themselves to assemble and/or takedown the bow for routine maintenance,
4) a need for frequent periodic maintenance and repairs being made, 5) difficulty associated with in-the-field (emergency) repairs,
5) lack of component and/or subassembly durability,
6) excessive noise of operation, and
7) impaired penetration resulting from arrows, having broadhead points mounted at their front ends, flying in an unstable manner when propelled from "compound" bows of the period.

These other areas of consideration did, however, come into play after the introduction of Allen's invention, and did become the object of a good deal of inventive effort in their own right, since each was later shown to be difficult to achieve in bows incorporating Allen's method of introducing mechanical advantage into the system.

Between the time of the introduction of Allen's invention and the present time, there has been an ongoing development process mostly related to perfecting the original design patented by Allen, or at least minimizing problems inherent in it.

The continuing development effort has spawned hundreds of (mostly small) new companies catering to those wishing to improve upon the overall performance of "compound" bow products supplied by major archery product manufacturing concerns. Most of the major bow producers have, for several years, employed degreed engineers on their staff's to aid them in staying in the forefront of new development efforts centered around improving "compound" bows.

Difficulties Encountered with the Allen Compound Bow Design

The current and ongoing development effort in terms of improving on Allen's invention stemmed originally from the fact that Allen's invention also had, at the time it was introduced, (and continues to have) some significant negative points. These negative points contributed to a number of areas of performance related dissatisfaction by archers using bows incorporating the teachings in the Allen Patent:

Every attempt made to date to resolve one area of difficulty in compound bow performance has uniformly resulted in either making matters worse in another related performance area, or has resulted in further compromising other elements of the end product design, usually making the end product more complex to manufacture, repair, and maintain, more costly to produce (and purchase), and much more difficult for the end user to understand in the process.

There have been two broadly different general paths taken by inventors working to perfect compound bow designs since the publication of the first commercially viable compound bow patent awarded to Holless Allen. One development group, having a large number of inventors in it, centered their efforts on working with bisynchronous designs functioning in a manner similar to that introduced by the Allen invention. A second, much smaller, group of inventors took a path wherein the primary energy storing and releasing components of the bow worked in an asynchronous manner. The following pages of this section review the the most significant development efforts, successes, and failures by inventors working with both types (bisynchronous and asynchronous) energy compounding systems for compound bows.

BACKGROUND OF THE INVENTION—CONTINUED—BISYNCHRONOUS COMPOUND BOW DEVELOPMENT

The compound bows being made today look very different from the original models introduced in 1969.

The Earliest Models Marketed

The Earliest compound bows (circa 1969) did not have such things as cable guards, crotch bolts, hanging yolk assemblies, or continuous loop string/cable arrangements, which are commonly found on current period compound bows. The first mass produced compound bows also used additional "idler pulleys" attached to the center section of the limb to provide a means of moving the working cables over far enough to clear the arrow fletching. The working cables passed over the "idler" pulleys and were then "tied off" on rigid, but adjustable as to pitch, "pylons" attached to each end of the bow's riser section.

These early compounds employed a "crotch" cutout in the end of the limb to house the pulley, similar to many bows made today, with the axle itself housed in holes drilled in "tip blocks" provided for that purpose. Most riser sections were constructed of hard woods which had been impregnated, under pressure, with a plastic compound similar to Formica, in an attempt to provide the necessary increase in strength required for compound bow construction.

These bows were heavy, averaging about 6 pounds (without a quiver, arrows, or a stabilizer). They were also very difficult to keep properly adjusted ("in tune"), due to the nature of their complex (many component) bolted-on sub-assemblies. Torsional forces imparted by the pulleys also caused lengthwise cracking of the limbs near the base of the crotch area, the bottom portion of which was normally additionally reinforced with a thin plastic overlay.

In the period between the 1975 and 1980, most manufacturers began replacing these "four wheelers", as they were called, with bows having only two eccentrically mounted pulleys, one mounted at each end of a bow limb, and each "working cable" was tied off at a point (usually on the axle) of the opposite bow limb. During this time a few very complex multi-pulley compound bows were introduced, but each lasted only a short time. The "two wheeler" design remains to this day.

This arrangement also employed a relatively wide (normally about 0.750" wide) pulley, with the pulley's two grooves thereby being far enough apart to provide for the arrow's fletching to clear the cables as the arrow passed by when being propelled from the bow. The axle itself passed through holes provided for that purpose that were part of a separate metal "hanger" component that was bolted on to the endmost section of the limb. By eliminating the "crotch" manufacturers hoped to also eliminate crotch related limb breakage. At this time, too, the "tie-off" point for the cable ends coming off the secondary side of each eccentric pulley was moved to a position on the axle, next to the secondary side of the pulley(s). Also, at about this point in time, most manufacturers began to substitute risers made of aluminum castings for the old plastic injected hardwood styles, in an attempt to reduce overall bow weights acceptably.

The "two wheeler" design was not really a follow-on innovation coming after the originally patented (Allen) design that was first published in December of 1969. Rather, it resurrected elements of the original Allen patent itself, which had all along called for use of only two eccentrically mounted pulleys, one at either limb end.

Manufacturers had originally deployed the "idler" pulleys in the first mass produced models made circa 1969, in an attempt to reduce splitting in the crotch area of the limbs due to torsional forces transmitted to the limbs from the pulleys, due to the pulleys mechanical advantage, and, at the same time, provide some means of moving the actuators (cables) out of the way of the arrow fletching as the arrow was propelled from the bow, near the center of the bow, where the cables "crossed over" each other as they stretched between the two limb ends.

The typical 1975–1980 period "two wheeler" compound bow was somewhat lighter in overall weight, primarily due to its fewer total number of components and the use of cast aluminum in constructing the riser section. Due to the elimination of the many movable components in the pylons (since pylons themselves were eliminated), these types of bows also stayed "in tune" much better than the prior "four wheelers" had.

Problems Encountered with the First "Two Wheelers" Marketed

The "new two wheel" design, however, contributed some serious new problems in place of the ones it solved. One such problem was the addition of a great deal of additional mass (weight) attached to the ends of the bow limbs that slowed limb-tip acceleration upon release, and caused the bow to exhibit an uncomfortable amount of "jar" to the shooters hand as the bow was shot. The 1975–1980 period "two wheeler" bows also applied additional stress to the actuators (cables) and bowstrings, causing the bows to be noisier shooting due to the increased vibration of limbs, strings and cables when all the slack ran out and the increased weights at the ends of the bows limbs stopped suddenly as the limbs reached the end of their forward travel.

The cables rubbing against each other where they "crossed over" each other during rotation of the pulleys, caused them to wear through often in the crossover area from the friction thus created. In this configuration, the bow cables also emitted an additional undesirable "rattle" type noise where they touched each other, due to harmonic vibrations induced in the cables at the time all the slack ran out, when the limbs suddenly reached the end of their forward travel, when the bow string was released.

Also related to the heavier limb tip weights of the 1975–1980 period two wheeler style bows was the increase in failures of cables, especially at the point where the various types of "teardrop" string attachment fixtures were "molded" or swaged onto the cable ends.

The greatest problem associated with the 1975–1980 period two wheel bow designs was the reintroduction of even greater lengthwise torsional twist imparted to the limb from the very wide pulleys (and the "tie-off" point now also mounted on the axle in a non-centered manner) as they applied their mechanical advantage to the system while the bow was being drawn and released.

The additional pulley/limb torsion contributed to shorter limb life (delamination and reduced durability) near the center of the limb, and also contributed to reduced shooting accuracy, since torsional forces reversing themselves upon release caused the limb to impart an undesirable left/right oscillating motion to the rear end of the arrow as it left the bow. This left/right oscillation was especially damaging to arrow flight when the archer was using broadheads.

Challenges for the manufacturers

After 1975, manufacturers continued to experiment with ways of eliminating the increased vibration ("jar"), increased noise, reduced arrow velocity, reduced accuracy, and reduced durability caused by going from four pulleys back to two.

One method used by many manufacturers to reduce limb tip weight in "two wheelers" was to employ very narrow pulleys, again in crotches, with the basic two wheel design. The narrow pulley approach eliminated weight associated with the metal "hangers", and also reduced the weight of the pulleys themselves. The reduced weights resulted in faster limb tip acceleration, less unpleasant "jar", longer cable (fitting) life, and reduced limb failures due to delamination in the center areas of the limbs. In the narrow pulley, "two wheeler" configuration, as with the original Allen design, neither the arrow shaft or the fletching of the arrows could clear the cables without undue friction. The friction caused cables to wear out at both the cable crossover and fletching passby points, rather than at the ends, and the wear on the arrows fletching was also greatly increased. Accuracy also suffered even more, due to the disturbance related to the arrow/fletching striking the cables very hard (bouncing off of them) as the arrow left the bow. Arrow accuracy was deplorable indeed when broadheads were used in place of field points. Reintroduction of "crotches" to house pulleys also reintroduced a higher incidence of limb cracking in the bottom of the crotch areas, for two reasons:

Causes of Lengthwise Limb Splitting

1. The first reason for the lengthwise splitting in the crotch area of the limbs had to do with the uneven pressures exerted on the arms housing the pulleys in the crotch area of each bow limb. As the pulleys exerted mechanical advantage on the system the system, the side of the pulley bearing the greater load exerted that pressure on the end of the crotch arm housing it's side of the axle, in a manner that caused that crotch arm to bend down farther than the crotch arm housing the side of the axle bearing the lesser load coming from the other side of the pulley.

The shifting side to side loading and unloading of pressure transmitted to the limbs from the pulley system caused a lengthwise torsional bending moment to be applied to the limbs overall, with the greatest amount registering at the ends of the crotch arms.

The torsional forces stored in the bow's limbs as the bow was drawn back to a "full draw" position reversed themselves very quickly upon release as the archer shot the bow, imparting a sudden sideways directional acceleration to the bowstring to which the nock of the arrow was loosely attached during the arrows acceleration from the bow. The sideways "whip" affected the rear end flight stability of the arrow as it left the bow, reducing accuracy and penetration at the target.

At the same time, the torsional forces working lengthwise in the bows limbs greatly shortened the life of the unidirectional fibers (held together only by various adhesives) in the bottom of the crotch area of the limbs.

2. The second reason for the lengthwise splitting in the crotch area of the bows limbs had to do with the nature of physical force alignment that occurred (even absent torsion) in a system wherein the pulley was mounted in a crotch cutout of the end of the bending member itself.

As the axle exerted downward force on the ends of the crotch arms, the limb was effectively divided into three separate (lengthwise) force resisting sections. The two outside lengthwise sections, of which the crotch arms were parts, attempted to bend directly in proportion to the amount of force exerted on them by the axle. The center portion of the limb, however, did not directly receive any force exerted on it by the axle (because the axle never touched it directly), and the center section of the bending member was therefore free to move in the other direction from that traveled by the outside sections.

The only thing opposing the opposite directional movement of these three sections, was the adhesive in the fiberglass and/or wood sections of the laminated limb in the area surrounding the bottom of the crotch area. The laminations, constructed of unidirectional, pultruded, fibers designed to provide maximum strength in the warp direction (for cast), generally proved no match for the combination of torsionally uneven forces, and the effect of the "three-unbalanced lengthwise section" effect caused by mounting the pulley in a "crotch".

Thus, while the 1975–1980 period "two wheelers" did bring improvements in terms of lightening the limb tip masses to be accelerated forward, reduced cable failures at the fitting locations, and reduced limb failures due to delamination related to torsional stress, they also created some other problems which were just as serious.

The problems created in place of the ones "solved" were increased wear in the cable "cross over" area, increased cable wear in the arrow rest area due to arrow fletching contact, reduced durability in the crotch area of the limbs, reduced accuracy due to arrow fletching disturbance, increased shooting noise from cable "rattle" as cables vibrated against one another at the "crossover" point, more noise being made when fletching struck the cables as the arrow left the bow, and reduced penetration at the target due to the arrows torsion-imparted, side-to-side tail end oscillation during down range flight causing the total kinetic energy stored in the arrow to be distributed inefficiently at the point of impact.

Cable Guards

Early in the third quarter of the 1970's, the first cable "guards" found their way into the market. The cable "guard" consisted of a round metal bar (normally 5/16" diameter), having an offset in it of about 1". The bar was mounted in a hole drilled in the risers back surface at a point either immediately below the grip section or at a point about half way up the length of the sight window. It's function was to move the tensioning cables (actuators) over to one side sufficiently to allow arrow fletching to pass by without making cable contact. The "guard" did a good job of moving the cables out of the way of arrows as they left the bow. Cable guards also tended to quiet cable vibration-related noise a bit upon release, since each cable was effectively "damped" by the considerable pressure caused by the "guard" at the point where it pushed the cables over to one side of the bow, out of the way of the arrow and it's fletching.

Cable "guards" also created some significant problems of their own when mounted on the bow. First was the reintroduction of even more greatly increased torsional forces back into the limbs of the bow, with torsion getting greater the further back the bow was drawn, and reaching a maximum at the point of full draw. In a bisynchronous limb/pulley system as defined by the Allen patent, the thrust forces stored in the limbs aligned themselves lengthwise in the bows limbs approximately in the vertical plane where the working cables "cross over".

In bisynchronous limb/pulley systems which were further "enhanced". by the addition of a cable guard, the cable "crossover" point was effectively moved (by the cable guard) well off to one side of the bow, (the side away from the sight window cutout), and the majority of the total energy stored in the limb also was stored on the same ONE side of the bow's limbs.

In the late 1970's, due primarily to the wide pattern of adapting cable guards to compound bows, limb breakage in the crotch area of compound bows reached epidemic proportions. Sometimes the torsional forces traveling through the limbs to the riser at the point where these two components were connected via "limb bolts", was severe enough to cause the cast aluminum bow risers to break from the added torsion that the entire system was being subjected to.

Another Source of Friction

In addition to magnifying unwanted torsion, cable guards were found to introduce an additional amount of friction into the system, which, unless applied absolutely evenly to each cable at every point in time, was very disruptive of arrow flight since one pulley might be allowed to return at a faster rate than the other pulley, if one of the cables nylon coatings should "bind" a bit while passing over the "cable-guard" post upon release.

In essence, cable "guards" replaced a single point of very light friction in the area where the cables "crossed over" one another (in bows without cable guards), with two points of much greater friction either slightly above or below the point where the cables "crossed over", in those bows having cable guards on them. The end result was that cable related friction in bows equipped with cable guards ended up being more than two times as great as cable related friction in bows without cable guards.

The increased friction levels created by cable guards also detracted further from the amount of total stored energy in the system that was transferred to arrow acceleration, and inhibited the rate of response of elements of the system that were directly affected by the cables (which included all moving parts of the bow itself).

To combat the unwanted friction resulting from the cables touching the "guard" itself, some manufacturers introduced cable "guard" models using a separate additional subassembly, constructed of a friction resistant material such as Teflon, designed to slide along the guard itself, with the cables passing over "rollers", also made of friction resistant materials, which were themselves attached to the "slide" subassembly with axles constructed of a more rigid and durable material such as stainless steel.

These "roller" equipped cable guard models did reduce guard-related friction, but only very slightly. The thing they did best was preserve the black nylon coating on the outside of the cables. Cable movement is virtually instantaneous upon release, and the simple rollers, mounted over un-coated steel axles, that were used on these types of cable guards were not built to move that easily or quickly. The rollers did roll upon release, but only started to do so well after the cables had already begun to slip over their surface. Like other added on components, they also constituted yet another additional weight that had to be moved forward upon release, and, as a whole did nothing to increase either arrow acceleration or accuracy.

The elimination of fletching disturbance in the cable area, did not have the expected (hoped for) net positive effect on arrow flight accuracy in cable guard equipped bows, since the pulleys themselves now tipped right and left more radically (due to the application of uneven and unbalanced downward pressure to the crotch arms caused by increases in torsional severity due to:

1) the cable guard moving the cable force vector even farther off to the same side of the bow's limbs that was already experiencing the greatest load coming from the pulleys, and
2), the non-centered cable "tie-off" position of the tensioning actuators on each axle, exerting uneven downward pressure on opposite sides of the limb, as the bow was drawn and released.

The rapid reversal of the unevenly bent crotch arms imparted an undesirable amount of sideways "whip" to the rear end of the arrow as it was propelled from the bow, and the resulting arrow flight instability reduced both accuracy and penetration at the target somewhat when target points were used on the arrows, and accuracy and penetration were both reduced even more when bladed hunting points were used.

Thus it can be seen in the case of cable "guards" as in previous areas of discussion, that the introduction of these attachments introduced as many serious problems as it "solved". And once again, with the introduction of cable "guards", the complexity of the overall system was increased.

Bows equipped with cable "guards" initially suffered a very high rate of return to the factory for maintenance and repair of the damaged components, primarily lengthwise cracks in the crotch areas of the limbs, with failure generally occurring well within even the shortest of product warranty periods.

Approaches Aimed at Reducing Lengthwise Splitting in Bow Limbs

Several approaches have since found their way into the marketplace aimed at reducing the severity of "crotch splitting" problems. Almost universally, manufacturers have, since the early 1980's, employed some method of increasing the level of structural reinforcement near the bottom of the crotch area of the bow limb.

The most popular approach as been combining wider limbs, overan, (to suppress torsional lengthwise twisting and provide wider and stiffer crotch arms) with the use of steel washers attached to both sides of the bow limb by steel bolts and locking nuts, near the bottom of the crotch. These bolt/washer arrangements effectively cover up any cracks that do get started in this area, and in some instances apply enough additional mechanical pressure to stop the cracking altogether.

The steel washer/bolt/nut assemblies, together with the increased limb widths, however, served to reintroduce additional weight (weighing almost as much as the (plastic or aluminum) pulley assemblies themselves), and "jar" and string noise were again increased. Of course arrow speed went down somewhat on bows thus equipped, since the increased weight at the ends of the limbs absorbed more of the energy originally intended for forward arrow acceleration.

Other attempts at reducing splitting in the crotch areas of compound bows have centered around using thickened "wedges" at the ends of the limbs through which the axle holes are drilled, and still other manufacturers have resorted to cementing on "overlays" made of very dense and shear resistant materials such as Formica to the top and/or bottom of the limb over the entire crotch area.

Durability was also increased using either of these (non-metal types of) reinforcement alternatives, but, as in the case with the steel washer arrangement, tip weight was also increased (about the same amount in each case since more fiber material was required in order to achieve a comparable level of reinforcement when inexpensive glass fiber material types were employed for such reinforcements), and jar and noise went up as well, and limb tip acceleration was reduced in rate.

Any of these crotch reinforcement approaches result in reducing arrow velocities by from 2–4 feet per second, or about 1–2% reduction in arrow velocity with a given arrow weight. This constitutes a significant reduction, when one considers that the compound bows principal claim to fame had been that it increased arrow velocity about 10% over the old style simple recurve bows of the same draw weight.

In effect, the crotch reinforcement methods employed to date have had the effect, by themselves, of reducing acceleration potential in bows so equipped, by from 10–20% when compared with expectations if comparing arrow velocities of given draw weight compound bows to the arrow velocities achieved by comparable draw weight simple recurve type bows.

One invention (Eicholtz, U.S. Pat. No. 3,850,156), did attempt to integrate strengthening and torque resisting fiber orientations in the limbs of recurve bows, by way of using woven fabric laminations with the fabrics reinforcing fibers oriented at plus and minus 45 degrees to the longitudinal, and 90 degrees, to the longitudinal centerline of the bow limbs. The fabric laminations were interspersed with the typical unidirectional fiberglass laminations of the limb typically used during the period of recurve bow usage and development. Later, in 1998, Allshouse (U.S. Pat. No. 5,718,212) expanded on this approach.

Several years after the Eicholtz invention, a number of compound bow makers hit on this method to stop lengthwise splitting, and increase torsion resistance in compound bow limbs, with marginal success. The multi directional fibers did inhibit cracking at the bottom of the crotch cutouts in compound bow limbs, but, because their reinforcing fibers stopped at the edges of the limbs, did much less in terms of combating torsion in the limb members themselves.

Since the multi-directional fibers were essentially added to other unidirectional layers of fiberglass already in place, their added weight added to the mass that had to be accelerated forward, and the added weight along the entire limb length in order to effectively inhibit cracks only in the bottom of the inch or so of limb where the bottom of the crotch was, was deemed by most manufacturers not a good tradeoff, and this approach was not widely followed for an extended period of time.

Most recently bow designers have returned to using an approach where the limbs are effectively split lengthwise down their entire length at the factory (Caldwell, U.S. Pat. No. 4,188,345). This approach works well from a marketing standpoint, since limbs so designed cannot "split" accidentally in the field after purchase, because they have already been "split" on purpose at the factory. Limbs so designed do allow torsion to effectively run uninhibited down the entire length of each "side" of the puspously split limb members, and so don't provide much of a net gain in overall performance. Manufacturers choosing this alternative have without exception then resorted to using "hanging yolks", cable guards, and in most instances also added crotch bolts after the fact about three-fourths of the way up the limb from the base, to limit the unbalanced torsional load to the croch arms, instead of allowing the torque to run all the way down to the base of each "split" segment of each limb so constructed.

Reducing Torsion—the Most Elusive Goal

Reducing the negative effects of pulley torsion in the shooting system has proven to be the most elusive goal of the various compound bow manufacturers, right up to the present point in time. As with the other "solutions" discussed here, each attempt to reduce the negative effects of torsion has come with a price tag in the form of introducing one or more new problems for each one being "solved".

In this problem area too, in every instance, part of the price of attempting to offset the negative effects of limb/pulley torsion on the shooting system, has been added complexity in the design of the bow, and an increased need for the archer to employ (at additional expense) other specialists, having special tools and fixtures to keep the bow performing up to snuff.

"Load-Balancing Yolks"

One popular approach at moderating the negative effects of limb/pulley torsion, in bisynchronous compound bows, has been use of a "hanging cable yolk" assembly suspended from the axle housing the pulleys. Yolks are a modified approach to torsional load distributing, similar to the "idler" pulleys used in the first (4-wheeler) compound bow models. The primary difference being that the "yolk" assemblies are mounted on the axles, instead of being mounted near the center of each limb, as was the case with the first "idler pulleys". The axle is thus made to serve two purposes:

1) it supports the pulley, and
2) it takes the place of the "pylons" used in bows manufactured circa 1970.

"Load-balancing Yolks", absent a cable guard, would cause the cables to cross over at precisely the vertical center line of the bow (in line with the vertical centerline of the bows limbs. Use of "yolk" assemblies therefore mandated the use of a cable "guard" in order to provide sufficient clearance for the arrow fletching to clear the working cables near the center of the bow area.

"Yolks" do lessen the negative torsional effects that are visible to the archer, but do not actually reduce the pulley-actuator torque in the system per se'. The total amount of pulley-actuator torsion imbedded in the system remains unchanged when "yolks" are employed.

Rather, the "yolks" serve primarily to relocate the torsional forces in a manner that minimizes the uneven deflection at the tips of the limbs (not apparent to the archer), but instead causes the entire end of the limb to be pulled over to one side, toward the point where the tensioning actuators pass over the cable guard. This effectively causes the entire limb, and the riser to which it is attached, to be pulled (pivot) in a clockwise or counter clockwise direction, which type of torsional force has to then be resisted by the archer's bow hand (hand torque). In essence, load-balancing yolks are effective only at translating pulley-induced limb torque into limb-related hand-torque.

Yolk subassemblies are constructed of the same kind of aircraft cables and swaged on fittings used in the "principal" or "working" cables themselves, and are therefore subject at each point of "joining" to the same kinds of cable/fitting failures discussed earlier.

The incorporation of a "yolk" assembly on the axle also requires wider crotch openings, and thinner, and more easily affected by torque, crotch arms, thereby leaving the remaining torsion in the system free to bend the arms more unevenly than would be the case with wider (and stiffer) crotch arms, (unless the limbs are, at the same time, also further widened, and made heavier, in order to accommodate the "yolk" hangers), Like cable guards, yolk assemblies resulted in increasing the level of friction present in the bow during operation. Yolk assemblies required two points of friction to be present along the surface of each axle, where before there had been a single point of friction relating to the cable tieoff point which was normally on the axle, immediately adjacent to the secondary side of the pulley.

The yolk assembly trades some improvement in visible limb tip tippage, for an increased level of limb-related hand-torque, additional weight that has to be accelerated upon release (reduced velocity and increased noise and "jar"), an increased number of swaged on cable fittings which are subject to failure, less torsion resistant crotch arms per se', increased friction levels related to operation of the pulley system, and increased overall complexity in the bow itself Different Pulley System Types Designed to Reduce Torsion Other approaches to reducing the negative effects of pulley torsion have centered on design of the pulleys themselves.

Single-Plane Pulleys

One approach pulley designers presented as a means of reducing pulley induced torsion in the system called for both pulley grooves to be positioned in the same vertical plane of operation as the bowstring while rotating through their working arc.

Single-plane pulleys took many different shapes varying from round, to egg-shaped, or, in one instance, shaped somewhat like a kidney bean. In essence, approximately one half of the pulley's outside circumference was dedicated to operating in the same fashion as the primary side of a "normal" bisynchronous compound pulley, while the other half of the pulley's circumference was dedicated to performing the "take-up" function normally attributed to the secondary side of a "normal" bisynchronous compound pulley. In operation, whatever amount of bowstring-attached actuator was unwrapped from the pulley during drawing of the bow, would concurrently have an equal amount of tensioning actuator cable wrapped in the vacated groove. These operations would then be reversed when the bow was released after having been drawn.

Were it not for the fact that, in order to be useful as a bisynchronous bow pulley component, an arrow had to be used with these single-plane pulley configurations, they might have been said to have accomplished their intended purpose of virtually eliminating pulley induced torsion from the system altogether.

However, in actual use, single-plane pulley types, of necessity, had to be used in conjunction with a cable "guard" component, in order to move the actuators sufficiently off to one side of the bow to allow arrows to:

1) initially be mounted on the string, ready to shoot, and
2), allow the arrows to be propelled forward out of the bow without the arrow's fletching making contact with the actuators while doing so.

The requirement to utilize a cable guard on bows equipped with "single plane" pulleys, effectively initially negated 100% of the hoped for benefits expected from their use. Manufacturers who adopted these types of pulleys in some of their bow models ultimately also had to resort to using "yolk" assemblies in conjunction with the mandated cable guards, in order to be able to claim any level of torque reduction whatsoever in the bows with "single-plane" pulleys.

Of course the addition of cable guards and yolk assemblies also brought with them greatly increased friction levels in the bow, overall, making bows equipped with single-plane pulleys, and cable guards, and load-balancing yolks, among the slower shooting models in the marketplace.

Pulleys with Diagonally Transversing Cable Grooves

One popular pulley style invented specifically to moderate torsion, overall, utilized a wide design with the working cable being transported diagonally back and forth as the bow was drawn and released. "Net" torsion was reduced minimally, if at all, with this design, and the wider crotch and thinner crotch arms again led to increased breakage of limbs in the crotch area.

The pulley with helically transversing cable grooves was itself so wide that the bottom radius of the crotch cutout in bows using these pulleys was too wide to be effectively covered by a crotch "bolt" assembly, and the very narrow limb crotch arms were also unsuitable for use with "overlays", and "wedges". The added pulley width resulted in also adding weight to the ends of the bows limbs which, in turn, resulted in slowing limb acceleration upon release.

The inventor of this pulley design ultimately resorted to splitting (sawing) the limb lengthwise down it's centerline during the manufacturing process, to a point below the movable pivot it was bent over, in an attempt to reduce the number of crotch splitting problems experienced by purchasers of the product. Limbs couldn't split accidentally in the field, since they had already been purposely "split" at the factory during the manufacturing process.

Greatly lengthening the lengthwise division of the limb into two longer working "crotch arm sections" reduced the number of in the field failures experienced by users of this particular bow, but as in other instances, other problem areas were magnified.

The requirement in bows with helically-grooved "take-up" pulley grooves, for the pulley to relocate the cables from side to side during operation of the pulley system, resulted in friction related to the operation of the pulleys being further increased, since additional energy was required to move the cables sideways, by using sideways pressure being exerted against the cable by the pulley groove, at the same time the pulleys were being rotated through their arc of operation.

The longer working "crotch arms" also allowed the remaining torsion in the system to work completely unchecked along each side of the bows limbs, magnifying the uneven tippage due to remaining torsion in the system. This limb/pulley system also had the drawback of increasing torsion in the system most, right at the time the arrow was about to leave the bow, rather than, as in most other systems, at the inception of the bows cast. Thus, accuracy and torsionally undisturbed arrow flight were more difficult to achieve with bows employing such diagonally traversed pulley grooves and/or lengthwise slit limbs.

Pulleys Mounted on the Bow Riser

Several different inventive approaches designed to remove the pulley torsion normally transmitted to the limbs, attempted to achieve this goal by mounting the pulley system on the riser, (or on "pylons" attached to the riser), instead of mounting the pulleys on the limbs themselves. These designs eliminate much of the tip mass normally associated with compound bows in general, freeing the limb tips to accelerate more quickly, at least in theory.

The most successfully marketed "hybrid" version of a pylon mounted pulley compound (Islas, U.S. Pat. No. 4,287,867) employed a complicated limb arrangement comprised of a cantilever limb affixed to each end of the riser, to which a separate axle mounted pivot subassembly was attached near the end of the cantilever section. A second rigid catapult section was then attached to the pivot assembly mounted on top of the cantilever section, and the entire conglomerate was then attached by a complex cable rigging to a compliment of three pulleys, axially mounted on the pylon itself, which served to actuate the cantilever section located at the OTHER end of the riser, via crossover cables passing lengthwise through the riser in recessed "channels" provided for that purpose. Pulley torsion was supposedly reduced slightly in this arrangement, but the added weights of the cable fittings, the increased "dead" weight representing the rigid catapult members which had to also be accelerated both forward and upward upon release, and the added friction occurring between the many additional moving parts making up the overall pylon subassembly negated most of the sought after benefits claimed by the inventor. The many additional moving components in the system also increased the difficulty in keeping the bow "in tune" when shock was present in the system, and additional unwanted shooting noise occurred from shooting vibration as well.

Attempts to solve torque related problems by moving the pulleys to the riser (or one or more "pylons" attached to the riser) have so far uniformly resulted in some very complicated engineering. To date, every attempt to use this approach has resulted in an incredibly complex bow design, (example Trotter, U.S. Pat. No. 3,923,035) having many more components incorporated in it's makeup, and requiring even more specialized knowledge to service or tune the bow. These types of bows are really only marginally suitable as weapons for the bowhunter, since in the field care by the owner is frequently necessary, but virtually impossible to accomplish with these designs.

Other negative considerations related to riser mounted pulley designs, center around the generally poorer balance in the hand ("system torque") exhibited by bows having their pulleys mounted somewhere other than at the ends of the limbs, and the much greater frictional forces that have to be overcome in the complex riser mounted (or pylon mounted) pulley sub-assemblies. The more moving parts there are in the pulley assemblies, the more friction that naturally has to be overcome in operating the bow.

Most significantly, riser mounted (or pylon mounted) pulley systems introduced to date have done very little to ultimately reduce torsion in the system. These types of bows simply transfer the primary torsional force directly to the riser of the bow instead of causing the torsion to initially register at the ends of the bows limbs. While the riser is generally constructed of stronger materials than the limbs are, and therefore can withstand the torsional loadings better without actually breaking in two, the torsional forces are still just as disruptive in terms of adversely affecting arrow accuracy, since the torsion is transmitted to the shooters hand (torquing the riser) even more quickly than is the case with bows having the pulleys mounted on the ends of the bow's limbs.

Some bisynchronous compounds having pulleys mounted on their risers (or pylons attached to their risers) evolved that also included in their design a requirement for cable guards in order to provide adequate arrow fletching clearance. These models did not have cables that crossed over in channels recessed in the riser, but instead had cables that crossed over somewhere in the space between the bows riser, and the bowstring (similar to the original "Allen" style compounds). The effect of putting a cable guard on these types of bows was to negate the effect of mounting the pulleys on the riser in the first place, since the "guard" ended up transferring the torsion resident in the riser section back out to the limbs during operation of the bow. Bows using riser mounted pulley systems, and which also employed cable guards, resulted in producing a "net negative" type of advance in the state of the art, since several performance related factors (accuracy, arrow velocity, penetration, and shooting noise) were made worse, while at the same time the bows were made much more complex in terms of providing the necessary periodic and in-the-field maintenance.

In summary, riser (or pylon) mounted pulley designs failed to achieve their theoretical potential in terms of being able to either 1) greatly increase the rate of arrow acceleration, or 2), significantly reduce torque levels, in large part, due to their various additional (complex) subassemblies of moving parts. While limb tip mass was reduced, increased friction between their many more moving parts served to greatly erode any significant gains that might have otherwise been forthcoming from the tip weight reductions, shooting noise was found to be greater due to the movement of the many added components when exposed to shock and vibration during shooting of the bow, field maintenance proved to be much more difficult as well, and torsion was only marginally (in most instances not at all) reduced in terms of it's detrimental effects on shooting accuracy and penetration.

Attempts to Increase Velocity

Beginning in the early 1980's, bow manufacturers began concentrating almost entirely on ways to increase arrow speed.

During the 1975–1980 time period, while manufacturers continued to add more and more component subassemblies designed to increase durability, improve accuracy, and reduce torque, the bows coming out of the manufacturing plants again got heavier, more ungainly looking, and often slower shooting (in terms of shooting velocities attained with a given mass weight arrow) than some of the very first models had been at the time of the compound bow's original introduction in the marketplace.

Between 1975 and 1980, most "improvements" in compound bows had done little, if anything to improve the amount of accelerative energy that got transferred into the arrow from the bow upon release.

Different Basic Pulley Shapes for Bisynchronous Compound Bows

The fastest shooting compound bows originally produced, (circa 1970) normally had both (round) shaped pulley grooves on the same pulley having the same diameter. This increased limb deflection, and caused more energy to be stored and released into the arrow upon release.

Some manufacturers used pulleys with the groove on the secondary or "return" side of the eccentrically mounted pulley being some percentage smaller in diameter ( called "step-wheel eccentrics"). The objective of using step-wheel eccentrically mounted pulleys was to reduce the overall amount of limb deflection to a level that would, in turn, reduce limb breakage to more acceptable levels. The step-wheel pulley design resulted in slower shooting bows, due to:

1) less limb deflection occurring, overall,
2) having therefore to use thicker limbs (and therefore heavier limbs) to get adequate cast, since each limb was not bent as far as the bow was drawn back to full draw, and
3) the need to use disproportionally larger pulleys in terms of the pulley's primary side circumference (in order to get sufficient draw length), which, in turn, added still more weight to the ends of the limbs which had to be accelerated upon release.

By the early 1980's, manufacturers were satisfied that limb breakage was pretty well under control, and many of them introduced models which made use of eccentrically mounted, cam-shaped pulleys, in an attempt to store and release more energy into the arrow, and thereby increase arrow speeds.

"Cam" bows represented yet another modification of a known bow design. The original Allen compound bow patent referred to cam-shaped pulleys as a "preferred embodiment" suggested by the inventor, who also noted that round pulleys could also be used with good effect.

The earliest (circa 1970) attempts to use eccentrically mounted cam-shaped pulleys however, resulted in greatly increasing the limb breakage rates, which were already too high, thus manufacturers initially elected to use the standard round eccentric-mounted, "parallel groove" pulleys in a variety of forms in the first mass produced compound bows.

Once again, in the early 1980's, limb breakage increased on bows equipped with cam-shaped pulleys, when cams were reintroduced. Further reinforcements were again added to the limb to reduce breakage, resulting in increased limb tip "swing" weights. "Jar" increased, noise increased, arrow velocities were reduced below the levels attained without additional limb crotch reinforcements having been added, and cable teardrops again began snapping off frequently, resulting in time consuming and expensive trips to a service center, for archers using "cam" equipped bows.

Unnoticed by Bow Manufacturers—Changes in Pulley Designs Mandate Modifications in the Riser Component Bows equipped with "cams" also proved more difficult to shoot accurately, especially in the hands of novice archers. Uniform hand position on the bow became extremely important, and push vs. pull points on the bow had to be moved more straight across from one another than had been necessary with round "eccentric" pulleys.

The reason for increased importance of bow hand position ("push" pressure) location had to do with the many and varied contours presented to the working cables by the "cam".

With round eccentrically mounted pulley bows, aluminum castings, having relatively thick cross sections, could suffice for riser and grip construction since push/pull points could be "adjusted for tiller" adequately if the push and pull points were as much as 3–4" apart (vertically).

The "tiller adjustment" called for "slipping" (pre-positioning the pre-wrapped portion), of the cables in a manner that pre-wrapped less cable around the pulley side that would initially receive it's draw force from the bowstring as the bow was drawn.

In the typical compound bow riser configuration, the archer effectively "pulled" harder on the cable attached to the top pulley on the bow, (since the majority of the archers bow hand was situated above the true vertical center of the bow), and the push/pull vector angled slightly downward from the fingers pulling on the bowstring to the main pressure point of the bow hand pushing the bow away from the archer).

This meant that the top pulley would require more cable to be pre-wrapped around it than would be required by the bottom pulley, in order for both pulleys to reach the same relative rotational position at the point of "full draw", and be still be fairly closely synchronized at other points of their individual rotation as the bow was drawn and released. Since the round eccentrics presented a constant 360 degree surface to cables being wrapped and unwrapped around them, this type of "adjustment" method could be employed (by a skilled bow "tuner") in a manner that allowed the bow to propel the arrow forward without disrupting arrow flight too much.

Conversely, "cams" embodied many different shapes of curved surface for the cables to contend with, and any slight variation in rotational synchronization when using "cams" could seriously disrupt the arrows flight, causing the nocking point to bob up and down violently as the rear end of the arrow was leaving the bow.

For this reason, "cam" bows, of necessity, in order to perform well, required equal (or very nearly equal) amounts of cable to be pre-wrapped around each pulley's primary side groove during assembly, and this approach didn't work well with risers having the main pressure point of the grip section positioned 3–4" below the point where the projectile guide (arrow rest) was attached to the riser.

The 3–4" distance below the arrow rest area chosen for the bow's grip location generally constituted the actual vertical center of the bow (overall, limb tip to limb tip), since the risers continued to be designed with about 3"–4" in added length below the arrow "shelf". This particular riser design characteristic had been carried over from the days when such a design consideration had been necessary due to use of wood risers, and when general bow designs had called for the archer to use the top of his/her bow hands index finger knuckle as the resting point for the arrow shaft as the bow was being drawn.

It appears that manufacturers simply failed to note the different effect that placing both the main "push" pressure point on the riser, and the main "pull" pressure point on the bowstring above the true overall center of the bow could have on arrow flight stability, and adjusting for same, when recurve and/or longbow limbs were being replaced with limbs having pulleys mounted at their ends.

Reconfiguring the riser design to properly accommodate the use of either eccentric round pulleys or eccentric "cams" required both moving the arrow (rest area) down, and also moving the main hand pressure point area of the grip up, while relocating the true center of the bow's riser section to be positioned about halfway between these two points. The reduced material cross-sections that would result from such a reconfiguration mandated stronger materials in order to maintain adequate strength requirements in the riser section to eliminate the possibility of breakage. The most likely material choices proved to be pre-forged, or extruded and redrawn aluminum billets.

A single company used a pre-forged riser component in 1980, but that riser failed to balance the push and pull points in an optimum manner. In 1982, another company introduced a bow having a riser section configured with push and pull points on the opposite side of the vertical center of the bow, and that riser was machined from solid barstock. By 1993, most bow manufacturers were offering machined riser bows, but many still did not locate the push and pull points on the opposite sides of the horizontal centerline of the riser.

Machining a riser (right hand and left hand models) from solid barstock resulted in excessive material waste and high material costs, and required separate Computer (machine) programs to construct right and left hand risers. Using completely pre-forged to shape risers required duplicate sets of forging tooling and very high startup tooling costs.

Use of stronger materials should have allowed use of less material (overall) as well, and served to reduce the overall weight of the bow, on machined riser bows, or bows with pre-forged risers, as well as providing for an ability to (safely) incorporate additional features into the riser component such as integral sight pin slots, and more solid mounting alternatives for a number of added-on "accessory" components such as overdraws, bow quivers, and so forth.

However, no noticible reductions in overall bow weights occurred from the substitution of machined and/or forged risers for cast risers. In 1994, the typical compound bow having a machined riser weighed 4.5 pounds, and was about ¼# heavier than the average cast riser bow. Bow risers made by machining or forging processes thus most often failed to take advantage of the redesign possibilities that could result in lighter overall weight bows, or redesign possibilities that could be incorporated in the risers to facilitate more accurate performance in bows having cam shaped pulleys.

There is no evidence available to suggest that manufacturers in general either did or did not understand the advantages in terms of of using stronger materials for the riser section of the bow in order to reduce the overall weight of the bow, and to improve accuracy in cam equipped models.

In 1994, aluminum castings remained the dominant manufacturers choice for bow risers, and many bow grips continued to be located at, or somewhat above, the vertical center of compound bows, and many risers continued to be configured with from 3–4" more length below the arrow shelf, than above it, as had been the case with the original versions of longbows and recurves. By 1999 many manufacturers had adopted stronger materials, including preforged and machine finished aluminum of various alloys, but riser design, including positioning of the grip with respect to the horizontal center of the bow remained substantially unchanged.

Bows outfitted with cam-shaped pulleys thus have remained generally somewhat faster shooting, but also somewhat less accurate and in bows with cast risers, have generally exhibited less durability in several key component areas than have bows outfitted with round, eccentrically mounted pulleys.

Modern Archery Ballistics—Published in 1986

In 1986, the publication "Modern Archery Ballistics" (Schaar, 1986) first drew wide attention to the public, and consumers at large, to several relationships that existed between different components of the overall archery shooting system when all were called upon to work together. Among the things first brought to the buying public's attention through the "Modern Archery Ballistics" publication were:

1) the root causes of limb breakage in compound bows,
2) the effects of hand induced, pulley induced, and "system" induced torsional forces on shooting accuracy, penetration, and component durability,
3) the relationship between the weights of bow components that required acceleration, and resulting arrow speeds coming from the bow, with a given mass weight arrow,
4) the relationship of arrow mass-weight to arrow velocity when being propelled from a bow of a given type, given peak draw weight, and given "true" draw length,
5) the relationship between hand position on the bow grip and the lengths of cable pre-wrapped around the primary side of each pulley,
6) the relationship between pulley mechanical advantage levels ("letoff" ) and the weight and stiffness of arrows needed to provide optimum performance in the case of a given bow, and
7) the effect of using overdraw attachments on arrow requirements (stiffness, weight, resultant arrow velocities, and shooting accuracy).

The extent to which these relationships may have already been known to manufacturers of conventional compound bows at the time is uncertain. However, it may be surmised that much of what was first revealed in the book Modern Archery Ballistics may have constituted new knowledge to the existing compound bow manufacturers as well as the general public, since most manufacturers began making use of it's teachings soon after it's publication, making a number of changes in their existing products shortly thereafter which made use of the teachings in the book, which had uniformly been absent in their product lines prior to publishing of the book.

Techniques Widely Employed After 1986 Suggested by the Book "Modern Archery Ballistics"

The most recent (1986 to present) set of compound bow-related "innovations" have been:

1. the use of lighter weight materials for actuators
2. development of shorter limbs for compound bows
3. use of pulleys designed to have "high letoff" (attain a very low "holding" weight)
4. risers reconfigured to accept mounting of overdraw accessories.
5. reduced fistmele distances—lengthened power stroke distances.

Lighter Weight Materials for Tensioning Actuators

Manufacturers have begun offering bows utilizing tensioning actuators made of lighter weight materials in place of earlier actuators which were generally constructed of nylon coated stainless steel wire ropes.

By itself, the replacement of steel wire ropes for tensioning actuators, with tensioning actuator segments made from lighter, aramid or polyolefin fiber strands, can contribute to increasing arrow speed from 3–5 feet per second, since two steel cables weigh relatively more than two aramid cables, and the additional weight of the cables also has to be accelerated forward as the arrow is being propelled from the bow.

The primary drawbacks of the aramid/polyolefin actuators are, that, since they can have no protective coating over them, they are subject to becoming easily frayed by contact with brush, sharp rocks, cactus, etc., and, being of fixed-length, two-piece construction, they can not be used in the usual manner to make small adjustments in bow draw length (i.e. "slipping" the cables to make adjustments in the amount of pre-wrapped cable around each pulley).

Additionally, aramid and polyolefin materials resist sticking permanently to most common adhesives and ordinary coatings, (which is why they can't be coated with a nylon or other more durable material as is done with steel wire ropes) and it is very difficult to make the necessary string servings (wrapped around them) stay in place. In addition, their smaller circumference prohibits snap-fit nocks staying in place during drawing of the bow. Finally these materials stretch more than steel, and sometimes the tensioning actuator at one end of the bow stretches more than the tensioning actuiator at the other end of the bow, and this can cause the pulleys to operate in an out-of-synch manner during operation of the system.

Shortened Limb Lengths

To reduce limb tip weights, most manufacturers have resorted to reducing limb lengths in their fastest shooting bows, making them shorter and thinner, but of the same general width, and being otherwise similarly constructed of traditional wood and/or unidirectional pultruded fiberglass.

A few manufacturers have also more recently introduced compound bows having limbs constructed with lighter weight pultruded, unidirectional graphite fibers in place of, or in addition to the more common fiberglass materials.

The reduced overall limb weights achieved by shortening and thinning (but not narrowing) the limbs, again translates into somewhat faster limb acceleration upon release, but at a cost in terms of shortening the overall length of the bow so much as to significantly increase finger pinch to the archer, making the bows much more difficult to shoot accurately in general, and much more susceptible to hand torque on the part of the archer.

Hand torque results from uneven top to bottom, or side to side hand pressure on the bow grip being exerted by the archer when the bow is being shot. Shorter bows are known to be more critical to shoot in terms of being more sensitive to the negative effects of hand torque.

In the past, patents have been issued to inventors of special, highly complex, universal joint (hinged) kinds of bow grips designed to moderate the undesirable effects upon shooting accuracy caused by hand induced torsion. During the period of recurve bow shooting, tournament archers used to use bows an extra 12–18" longer than would have been practical for use in the hunting fields, just to reduce the effects of hand torsion sensitivity inherent in shorter bows.

Hand induced torsion, when introduced into the system in short limbed compound bows, ultimately transfers all the way out to the ends of the bow's limbs, and, when present, results in undesirable up/down or right/left (or both) "whipping" motion being imparted to the rear end of the arrow upon release. Hand torque also reintroduces an additional amount of torsional stress back into the limbs of compound bows that must then be somehow mechanically countered in order to thereafter retain accuracy and durability in the system.

"High Letoff" Pulleys

"High letoff" pulley systems work by using more of the pulleys potential draw length (cable pre-wrapped around the pulley at rest) to increase leverage near the end of the draw as the archer comes back to a fully drawn position. Adjusting "letoff" in eccentric pulleys is accomplished by positioning the axle hole closer or farther away from the geometric center of the pulley during the manufacturing process. The farther from the geometric center of the primary pulley side the axle hole is located, the greater will generally be the mechanical advantage (high letoff) applied near the end of the pulleys rotation when the bow is drawn back to full draw.

"High letoff" pulley systems allow the archer to select thinner walled, and/or smaller diameter arrows, of a given material, for use with any given draw length/draw weight bow. This, in turn, normally translates into lighter mass weight arrows which accelerate faster when propelled from a given bow. The end result of using very high letoff pulleys on compound bows, results in a tradeoff in terms of the immediate amount of accelerative force transmitted to the back of the arrow shaft upon release being reduced, in return for a reduction in the amount of "draw weight" the archer has to contend with holding when at full draw.

A compound bow having a "peak" draw weight of 60#, but employing a "high letoff" pulley arrangement providing for 75% "letoff" (high letoff), would allow the archer to hold the bow in a fully drawn position by exerting only 15# of muscle pressure.

While somewhat easier to "hold" at full draw, such bows are, at the same time, more difficult for most archers who use their fingers to release the bow string, to "release" cleanly due to the lack of pressure exerted on the finger tips. The low initial force imparted upon release allows archers to select less stiff arrows for their shooting, which, given any arrow material type, normally translates into somewhat lighter arrows, and thus usually somewhat faster flying arrows as well when propelled from a given bow.

For the great majority of archers (over 90%, worldwide), who use their equipment for hunting purposes, the use of very light arrows, (normally 100–150 grains lighter) and "high letoff" bows were found to work to their detriment. The increases in arrow velocities possible through such an arrangement are normally insufficient to make up for the loss of kinetic energy stored in the arrow at the point of contact with the target (penetration), when compared with bows of equal draw weight using "lower letoff" pulley arrangements, and somewhat heavier arrows, traveling at only slightly slower (10–20 feet per second slower) overall speeds to the target.

Overdraw and Sight Attachments

Overdraw attachments are another relatively (about fifty-year) old idea enjoying something of a rebirth. Originally intended as a form of relief for earlier-period archers with draw lengths over 32" (who could not get uniformly stiff and/or straight wooden dowel type arrows long enough to shoot), overdraws are now being touted as an alternative method of increasing arrow speed.

Overdraw attachments provide a means of allowing the archer to shoot shorter arrows than would be required if the arrow rest were to be positioned directly over the archers bow hand. The primary objective in using overdraw attachments has changed from being that of providing a means of serving long armed, and hard to fit archers. Rather, the current objective has become that of providing some means for archers of all draw lengths a means of shooting shorter, and therefore lighter, arrows out of bows of any given draw weight, and "true" draw length (the length of arrow that would be required to shoot out of a non-overdraw equipped bow), for a given archer.

Like "high letoff" pulley arrangements, overdraw attachments can be effective when it comes to creating bow/arrow combinations that result in faster flying arrows. And, as with high letoff pulley systems, the end result is often reduced penetration at the target, generally being the opposite of what is needed and desired by the majority of archers, who are bowhunters.

Another significant negative aspect of overdraw attachments is their tendency to greatly magnify shooting errors caused by hand induced, "system" induced, or pulley induced torsion. The overdraw "extension" serves as a pivot arm which causes any movement in the area where the archers bow hand makes contact with the bow grip, to be magnified in severity at any point relating to the bows riser that is behind the archers bow hand (which is where the arrow rest makes contact with the arrow, when an overdraw attachment is employed on the bow).

Achieving consistent shooting accuracy is made more difficult by the use of overdraws on any bow. Thus, while arrow speed is increased through the use of overdraw attachments, the increase in arrow speed is effectively offset by reduced shooting accuracy, and, quite often, somewhat reduced penetration at the target as well.

Still another drawback associated with the use of overdraw accessories is the increased shooting noise normally experienced with their use. The general bow limb designs are unchanged on bows with overdraw attachments. Instead, the riser of the bow is redesigned to accommodate the overdraw accessory being mounted upon it.

Bows having wide limbs with a variety of relatively heavy attachments affixed to them (overlays, crotch bolts, wedge reinforcements, cable yolk assemblies, etc.), and which are also equipped with overdraw attachments allowing the use of shorter and lighter arrows, ultimately result in a combination wherein a good deal of the energy normally absorbed by the arrow during acceleration, remains otherwise still unused at the end of the limbs forward travel upon release.

The leftover energy is translated into a combination of vibration ("jar"), and noise, as well as placing additional stress on the other working bow components in the process, shortening the life of the strings, cables, and limbs.

Prior to 1950 most archers used the "instinctive" shooting style where the archer shot without the aid of any sort of a sighting attachment on the bow. Over the past fifty years time sighting attachments have grown in popularity and now the very great majotity of archers use such an aid. Current approaches include some incredibly complex attachments to the bow, some of which weigh a considerable amount, and are complicated to adjust as well. Most archers however use (relatively) simpler models designed for hunting as opposed to tournament shooting.

Hunting bow sights generally attach to the back side of the bow's riser section, in the sight window area, and protrude either out in-front-of or back-behind the sight window itself. Such positioning has the same effect on sighting, that overdraw positioning (behind where the archers hand rests on the bow grip), and represents a compromise in terms of positioning.

Optimum positioning would be directly over the point where the archer's bow hand pushed against the bow's grip, this being the longitudinal "pivot" point of the shooting system. However in the days of wood and cast risers, relieving material in this area might render the sight window subject to breakage, unless considerable extra material were provided in the area at the same time, which would have also added unwanted additional weight to the bow.

More recently, use of risers made from forgings, and from machined high-strength materials, would allow such positioning, and at least one bow company (Grand Slam Archery 1982–1986) did employ through-the-sight-window slots in a bow line produced in the 1980's. That bow line used a four-component sight assembly consisting of a threaded sight pin, a slide assembly through which the pin was threaded, and two locking nuts, one to inhibit up-down pin movement, and another to "lock" the pin from turning in/out along it's threaded axis, and lengthwise openings in the sight window, over the push point on the bows grip, for mounting the four-component slide used for each sight pin.

The Grand Slam approach mirrored an invention by Ikeya, (U.S. Pat. No. 3,844,268) which was also included molded trapeziodal shaped recesses mounted in each side of the sight window to facilitate dual matching trapeziodal threaded "slide" elements, together with a "lock" nut that inhibited pin movement along the threaded axis. Still another much more complex invention (Helmich, U.S. Pat. No. 3,865,095) also utilized a through the sight window positioning approach, but had a multitude of moving parts, and was probably too complex to be considered as a sighting approach for hunting bows.

Current state of the art in hunting sights for compound bows continues to use bolt on attachments that protrude either in-front-of, or behind the sight window itself The use of stronger materials having eliminated the potential breakage factor, it is surmised that the principal reason for use of such positioning may just be market related, since the cost to produce the bolt-on sight modules is quite low, while such "add-ons" bring relatively high margins to resellers of these types of products.

For whatever the reason, the bolt-on approaches predominate, but at a cost to the end-user of sight-pin positioning distortion, and by way of having to then add additional counter balancing elements to the bow to prevent the type of torsion resulting from having the bow itself being out-of-balance side-to-side, or top-to-bottom, from adversely affecting arrow flight.

Lengthened Power Strokes

The length of the forward "power stroke" distance has a marked effect on arrow velocity from a given bow. The longer the period of time the string is working at transferring energy from the limbs to the string and arrow from a given bow, the greater is the ultimate velocity achieved.

Most manufacturers simply redesigned their risers to accommodate the need for a lengthened power stroke, but a relative few took the approach of designing yet another add-on component that could be attached to each end of an existing riser, which modified the initial pitch of the limbs when at-rest to accomplish the desired reduction in fistmele.

A second approach called for reconfiguring the riser in the grip area, moving the grip well back toward the archer while leaving the initial limb pitch alone. This had the effect of causing an archers arms to appear (to the bow) as if they were longer by the amount of deflex built into the grip area, and resulted in archers bending the limbs further than they would absent the deflexed grip. Of course, as might be expected, some manufacturers chose to do both of these things.

Changing the initial at-rest angle of the limbs when the bow was at rest served, in many instances, to overstress the limbs, since larger pulleys then had to be used to get a full draw length for a given archer. The larger pulleys increased swing weight, and added shock to the system.

Moving the grip back to a point behind the fulcrum point of the limbs made the bow inherently less stable and more difficult to shoot accurately.

Thus, it can be seen, that while these changes were effective in terms of increasing arrow velocities to some degree, such changes brought with them a number of problems in other areas.

Allen's Concept of Inducing Mechanical Advantage Via a Bisynchronous Limb-pulley System is a Fundamentally (and Fatally) Flawed Concept In simple terms, Holless Allen's patented compound bow design called for the limb and pulley arrangements located at each end of the bow to provide for accomplishing four things in a very closely (bi)synchronized manner. These four things were (and are):

1. Provide a location on each of two flexible bow limbs suitable for mounting a mechanical means of inducing leverage in a manner that would assist the archer in bending stiffer limbs than he or she could have bent absent the leverage inducing mechanism.
2. Employ, as the leverage inducing element, at each end of the bow, an eccentrically mounted "compound" type pulley, with one "side" of each pulley (the primary side) applying leverage to the opposite (secondary) side of the pulley, and, at the same time, unrolling a length of cable which had been pre-wrapped around the primary side of the pulley during assembly of the bow, thereby adding draw length to the system.
3. Transfer the leverage thus induced by the pulleys (via cables or "actuators") to the point where the free end of the cable coming off of the secondary side of each eccentrically-mounted pulley was anchored (tied off) solidly on the OPPOSITE limb. This arrangement caused the limb on the OPPOSITE end of the bow to be bent and store energy that could later be used for accelerating the arrow out of the bow.
4. Provide for each opposing limb, upon release, to both: 1) provide the arrow acceleration force coming from one end of the bow, and 2) provide the energy needed to rotate the pulley mounted at the opposite end of the bow, back to it's original "at rest" position, making the system ready to be operated again.

The fatal flaw in the Allen compound bow design was item number four. By requiring each limb (mounted on opposite ends of the bow) to accomplish TWO functions, one at each (different) end of the bow, i.e.

1. provide arrow acceleration energy at one end of the bow.
2. provide "return rotation" energy for the pulley located at the other end of the bow.

Allen's bisynchronous concept for a leverage inducing mechanism for archers bows introduced a number of conflicting and diametrically opposed design considerations that have been the curse of the compound bow designer's existence ever since.

The "bisynchronous" nature of the Allen design required that the lever actuators (cables) cross over (intersect) one another at some point between the bowstring and the frontmost part of the bow, in a manner which further dictated that the energy storing members work in conjunction with each other at all points in time. This requirement, in turn, caused all of the other problems that compound bow makers have been working so diligently to overcome ever since.

In theory, Allen's design may have sought to simplify things by requiring each energy storing limb member to accomplish more than one necessary function (arrow propulsion, and return energy for the levers), thus requiring fewer overall component parts to get the whole job done.

However, as described in the foregoing text, in practice, the exact opposite is what occurred, and in a big way.

The Current State of the Art in Bisynchronous Compound Bows

It is a fact that (fancier finishes and advertising hype aside) the conventional compound bows being offered today reflect only a very small advance in the "state of the art" when compared to the models first introduced commercially in 1969.

It is also a fact that some 90% (plus) of the increases in arrow velocity being touted today over the velocity levels attained by the original compound bows made in 1969, must be honestly attributed to improvements in arrow and point components, and the current popular tendency toward using overdraw attachments and shorter, and/or lighter-weight arrows, rather than being attributable to basic improvements in the compound bow itself.

The eight engineering problem areas and eight related performance areas discussed previously herein, aren't (and can't be) isolated from one another or treated separately when seeking solutions. They are forever linked together in a manner that makes EACH engineering problem, in reality, EIGHT performance related problems that have to be solved concurrently, in a manner that does not, at the same time, compromise any other engineering area in the process.

The matrix-chart on the next page will serve to graphically illustrate the total combination of engineering problem areas challenging bisynchronous compound bow designers, and how each engineering area is related to each performance area considered important to archers.

It is believed that the performance-engineering matrix, shown on the following page, represents the first time an attempt has been made to document, in an inclusive manner, the totality of potential problem areas facing designers and inventors focusing their efforts on working with compound bows which are based upon a bisynchronous energy compounding system.

Making things more complex is the relationship that sometimes exists between various engineering considerations, taken by themselves. For example, providing greater strength in a component might affect the weights (mass) that had to be accelerated forward with the arrow, providing tradeoffs in these areas as well. Thus, the "bisynchronous" compound bow designer had not just eight, but perhaps as many as sixty-four interrelated problems which had to be solved, all at the same time, in order to really effect a complete solution to his or her problem(s). That was a lot of balls to have to juggle all at once!

No invention to date has sought to either identify all of the performance and engineering elements affecting bisynchronous compound bow performance, or to define the relationships between them as has been done in the performance-engineering matrix that is a part if this patent application, nor has any single invention in the compound bow field of art attempted to address all of the potential problem areas identified by the P/E matrix. The Performance-Engineering Matrix shows HOW each engineering consideration is related to each performance area considered important to archers.

In most cases, the relationship is an "inverse" one, meaning that as one goes UP, the other goes DOWN. For example, the relationship between pulley induced torsion and accuracy is an inverse one because as pulley induced torsion in the system goes up (increases), shooting accuracy goes down (gets worse).

In the case of material strengths, all of the relationships are "direct" ones. That is, as component material strength gets higher, it positively affects every performance area (assuming component weights remain equal). Conversely, if material strengths are reduced, performance suffers in every performance area.

In a few instances, when viewing the Performance-Engineering Matrix, it can be seen that a change either way

THE PERFORMANCE - ENGINEERING MATRIX

The Figure below is a reproduction of what I have termed the "Performance - Engineering Matrix". The column headings relate to the engineering problem areas, while the row headings relate to the affected performance areas.

| | Pulley Induced Torsion | Hand Induced Torsion | System Induced Torsion | Registration of Lengthwise Shear Force | Accelerated Wts. of Bow Components | Friction Between Moving Bow Parts | Design Complexity | Material Strengths |
|---|---|---|---|---|---|---|---|---|
| Accuracy | Inverse | Inverse | Inverse | Inverse | Null | Null to Inverse | Null to Inverse | Direct |
| Velocity | Inverse | Inverse | Inverse | Inverse | Inverse | Inverse | Null to Inverse | Direct |
| Penetration | Inverse | Inverse | Inverse | Inverse | Inverse | Inverse | Null to Inverse | Direct |
| Durability | Inverse | Inverse | Inverse | Inverse | Inverse | Inverse | Inverse | Direct |
| Reliability/ Consistancy | Inverse | Inverse | Inverse | Inverse | Inverse | Inverse | Inverse | Direct |
| Quiet Shooting | Inverse | Inverse | Inverse | Inverse | Inverse | Null to Inverse | Inverse | Direct |
| Ease of Maintenance | Inverse | Inverse | Inverse | Inverse | Inverse | Inverse | Inverse | Direct |
| Shooter Comfort | Inverse | Inverse | Inverse | Inverse | Inverse | Null | Null | Direct |

The Performance-Engineering matrix shows, at a glance, how the "bisynchronous" compound bow designers problems were, themselves, compounded. As can be seen by looking at the Performance-Engineering Matrix, Each engineering/design consideration affects not just one performance area, but instead affects all EIGHT performance related areas (simultaneously).

in a given engineering/design area won't have any affect one way or the other on one of the performance areas. These are termed "null" relationships.

In a few other instances, the relationship can vary between "null" and "inverse" depending upon circumstances. For example, the relationship between accuracy and friction may be "null" if the friction present in the bow is relatively equal, at both ends of the bow, from shot to shot. In this instance, accuracy isn't affected one way or the other. (Of course the remaining performance factors may still be very much affected in an inverse manner). If, however, friction at one end of the bow between moving components is much more than friction between similar moving components at the other end of the bow, then the pulleys (and limbs) will return at different rates, and accuracy will suffer, making the relationship an "inverse" one.

The Elusive "Net Gain" Solution(s)

Hindsight being what it is, it is perhaps understandable that in an effort to find a quick fix in one critical problem area that might be adversely affecting sales at the time (say limb breakage, for example), the bow-design engineer might not be all that concerned about the immediate effects of increasing the mass weight of the limb in a manner that reduced arrow velocity by some margin. Similar logic, applied over and over to each of the problem areas shown, in a very fast moving and competitive market has inevitably led us to the present point in time, where many bisynchronous compound bows resemble the proverbial "horse designed by a committee", being one which more resembles a camel (and perhaps also runs more like one).

The marketplace has been the great (and costly from the buyers standpoint) testing ground for the many and varied attempts manufacturers have made to improve on the basic bisynchronous compound bow design first introduced in 1969. The marketplace litmus test for compound bows can be summed up as a search for the "Elusive Net Gain Solution".

Those bow design improvements that the buying public determined had more positive factors than negative factors, (i.e. offered something of a "net gain" over prior models) tended to be more widely received, and had longer lifespans in the marketplace. Those designs which the buying public determined either offered no REAL improvement over prior models, or worse, introduced more problems than they "solved", were both much less well received, and endured for much shorter periods of time.

Complete solutions to problems inherent in compound bows of the conventional type (bisynchronous operation), have proven extremely hard to come by. In fact, to date, no manufacturer has been successful in solving even ONE of them in a manner which did not, at the same time, end up making things worse in at least one (usually several) of the other performance or engineering areas.

Once the fatal flaw in the "bisynchronous" concept is revealed, it is thereafter clear why no complete solutions to the problems associated with bisynchronous compound bows over the past thirty (plus) years have been forthcoming, despite the best efforts of hundreds of engineers and inventors working in the field. It also becomes equally clear why no complete solutions relating to such problems can ever be expected to appear at a future point in time, assuming the invention takes a basically bisynchronous form.

BACKGROUND OF THE INVENTION—CONTINUED—ASYNCHRONOUS COMPOUND BOW DEVELOPMENT

Not all invention regarding compound bows centered on improving Allen's basic bisynchronous design. A relative few inventors took a completely different approach aimed at circumventing the conflicting design considerations posed by having a limb/pulley/actuator configuration that required the actuators to cross over somewhere between the bowstring and the frontmost part of the bow. Because so few inventors took this approach, it is possible to look at their efforts individually.

Groves, et al, (U.S. Pat. No. 3,993,039)

Within a year of the publishing of Allen's patent, the first patent application was filed (Groves, et al) relating to a compound bow design that did not employ actuators that crossed over intermediate the bowstring and front of the bow. The Groves invention required mounting of the eccentric cams on axles positioned off to the sides of the bow limbs, near the point where the base of the limb was joined to the riser. This design employed a simple pulley mounted in a crotch at the limb ends for the actuator leading to the bowstring to be guided by. One end of the actuators passed from the riser mounted cam, in a transverse fashion along the outside of the limb facing the target, over the simple pulley at the end of the limb to a bowstring section. The other end of the actuator passed from the opposite "side" of the cam, in a transverse fashion, to a centrally located point near the bottom of the crotch of the limb, on the opposite side of the limb (back side), where it was fixedly attached.

In the Groves invention, pulling on the bowstring, which passed over the front side of the limb to the cam, caused the cam to apply pressure to the actuator section on the opposite (back) side of the limb, and the result was what was termed by the author a "buckling beam" effect, which allowed the limb tip to be bent down as in prior art bows, but not proportionally as far back toward the archer as had generally occurred with prior art bows, compressing tips of the limbs toward one another, and thereby storing energy that could be used for arrow acceleration when the bowstring was released.

In this configuration, the two pulleys and one limb at each end of the bow worked independently of the two pulleys and one limb at the other end of the bow. The Groves invention constituted the first "asynchronous" compound bow invention published after the Allen patent was issued.

Asynchronous bow configurations, per se', were nothing new to archery. Up to the point in time that the Allen invention was published, virtually all bows had been asynchronous in nature, with each limb operating independently of the other. Of necessity, for accuracy to ensue in such designs, the limbs mounted at opposite ends of the bow had to be very carefully matched in terms of their stiffness and flexure characteristics. This asynchronous characteristic applied to longbows, recurve bows, and crossbows.

One of the advantages claimed by designers and builders of compound bows that were bisynchronous in nature, was that the bisynchronous nature of the actuator operation would overcome variances in stiffness and flexure of limbs mounted at opposite ends of the bows riser. Thus, it was claimed, manufacturing tolerances for limbs could be loosened, when compared to the tolerances that had been required for prior art bow designs, because the bow's bisynchronous (pulley/actuator) operating configuration would force the unmatched limbs to work closely together.

This claim on the part of the bisynchronous compound bow designers and builders was greatly exaggerated. While, in fact, the bisynchronous nature of the pulley/actuator system did provide that the same amount of total energy might be stored in the system in bows having either equal or unequal limb stiffness and flexure characteristics in the limbs mounted at opposite ends of the bow, it did not automatically provide that limbs of unequal energy storing characteristics mounted on opposite ends of the bow would produce acceptable overall shooting characteristics in terms of shooting accuracy, arrow flight stability (needed for effective accuracy and penetration at the target) or shooter comfort (jar to the shooters bowhand). Bows having unequally flexing members also resulted in systems that were far harder to "tune", and which were far more prone to breakage, due to the unbalanced stored energy loads registering at opposite ends of the bow.

In fact, a whole series of inventions followed the introduction of bows based on Allen's bisynchronous designs into the market, by manufacturers who attempted to use unequally flexing limbs on their bows, erroneously assuming that the bisynchronous nature of the pulley system would offset any limb imbalance, in terms of limbs at opposite ends of the bow having differing stiffness and flexure characteristics.

These follow on inventions for bisynchronous bows were aimed primarily at doing such things as keeping the nocking point on the bowstring traveling in a straight line toward the target during the arrow acceleration period, in instances where the limb flexure imbalance resulted in limbs (and pulleys) returning at different rates (i.e. Nishioka, U.S. Pat. No. 4,365,611). Absent such follow-on inventions, bisynchronous compound bows having unbalanced limb configurations, would have provided (and did provide) even poorer overall results in the accuracy and penetration areas than had their prior art cousins (longbows and recurves) which had similar unequal limb stiffness and flexure characteristics. In this regard at least, bisynchronous compounds introduced nothing that was either new or improved to the bow builders.

Over time, it eventually became common knowledge to compound bow builders, that regardless of the bisynchronous nature of the pulley/actuator system being used, limbs at both ends of the bow had to be as carefully matched in terms of stiffness and flexure, as had been the case with prior art bows. However, by the time this was fully realized, sufficient follow-on inventions had been incorporated into the bisynchronous bow designs, that manufacturers tended to leave the unnecessary features (like a bisynchronous actuator rigging) in place, apparently, just in case. Doing this resulted in adding unnecessary complexity to the bow, without providing any additional benefits, whatsoever.

Bisynchronous compound bow designers apparently failed to discern the fact that, once limbs were carefully matched in terms of stiffness and flexure, the need for additional coordination of limb travel by way of crossover cables rigged in a bisynchronous fashion was obviated, and that, in fact, continuing to employ such means in the bows makeup provided a significant opportunity for making things worse, without providing any benefits.

Established notions prevailed and the very great majority of inventors (apparently all but five) continued to work on further improving the bisynchronous designs produced by the major manufacturers. Those efforts were described in detail in the previous section regarding the evolution of bisynchronous bows in general.

The initial asynchronous bow invention (Groves) also incorporated tradeoffs, in a number of performance-engineering areas, as did all bisynchronous attempts at improving compound bows. However, the performance-engineering tradeoffs found in the Groves invention included some "new" categories that didn't affect bisynchronous bow designers.

On the positive side, it allowed a variety of energy storing patterns, depending on the type of eccentric pulley(s) used, and eliminated crossover cables intermediate the string and front of the bow. Getting rid of crossover cables eliminated cable rattle from the cables contacting one another, and thereby eliminated cable wear from fletching contact. Eliminating fletching contact with the cables eliminated a reason for arrow flight instability.

However, there were also other problem areas introduced by this design that were just as serious as the problems being "solved", perhaps even more so, which kept this design from ever being marketed effectively. The first drawback to the initial asynchronous attempt was the fact that the moderate "buckling beam" motion of the limbs when stressed by the pulley/actuator system used, was less efficient than the motion employed in bisynchronous systems. Pulling on the actuators in this asynchronous design resulted in the limb tips traveling down, toward the vertical center of the bow, but a relatively shorter distance back, toward the archer. Reversal of these motions when the string was released, caused the limb tips to travel up but less far forward, as the slack ran out.

While this system did make somewhat more effective use of the compressive strength of the materials comprising the underside of the bow limbs; this fact was more than offset by the less efficient motion (limb tips moving less far forward) upon release, resulting in a system that had a reduced net amount of stored energy (and less useful limb motion) when compared to prior art bisynchronous systems where the limb tips traveled up and farther forward upon release. Because of this, arrow acceleration potential from a given draw length and draw weight bow was generally superior in prior art bisynchronous compound bows than with the Groves asynchronous model having a patent issued for it.

A second drawback of the Groves invention, was that it had inherently greater pulley/actuator induced limb-torsion in it. This resulted from having the actuators travel in a transverse fashion from a point completely outside the limb edge where the cams were attached to the bow, to the roller mounted at the center of the limb in a crotch, and to the cable tieoff (anchor) point centered near the end of the opposite side of the limb. Increased pulley related limb-torque resulted in adversely affecting all related performance areas (as shown by the P/E matrix earlier).

A third disadvantage of the Groves invention was that the actuator section passing in a transverse fashion along and across the front surface of each limb, passed so close to the surface of the limb that the normal amount of vibration that occurred when all the slack ran out at the end of the arrow acceleration period, caused the cables to make noise when they vibrated against the surface of the limb, instead of making noise contacting other cables at the cable crossover point, as had always happened in bisynchronous bows.

A fourth disadvantage of this approach related to the tradeoffs required when attempting to balance the need for draw length against a need for a desirable and workable energy storing pattern. Since the limb tips did not travel as far back toward the archer as the bow was drawn (as was the case with bisynchronous systems), the cams had to provide a relatively larger outside circumference from which actuator lengths could be unrolled during of the bow. The added circumference was needed to provide a longer section of actuator to unroll, and thereby add sufficient draw length to the system. This need conflicted directly with the need to provide an acceptable and efficient energy storing pattern during drawing of the bow.

Given the types of levers (cams/pulleys) identified for use in this (Groves) invention, if the outside circumference of the pulley groove holding cable to be unrolled during the draw was increased in size, and the side of the pulley exerting leverage on the bottom side of the limb remained constant, the leverage inducing pattern (how much energy was being exerted against the string for arrow acceleration at each point in the draw) became less efficient than other, existing and widely employed, energy storing patterns available to users of compound bows having bisynchronous operation.

Conversely, if the side of the pulley that unrolled cable during drawing of the bow was sufficiently reduced in size (when compared to the side exerting force on the bottom of the bow limb), in order to provide an efficient energy storing pattern, the alternatives, in terms of draw lengths that could be offered, precluded making bows in the most sought after draw lengths (i.e., the average draw lengths used by the majority of archers), unless the limbs were, at the same time, either:

1) made so pliable that they were rendered relatively ineffective in terms of storing energy for arrow acceleration, or
2) were mounted on the riser in such a way that the overall length of the forward power stroke was shortened in a manner that would result in even further reduced arrow velocities from a bow of a given draw length and draw weight.

It should be noted, that an alternate embodiment of the Groves invention used rigid limbs and mounted the eccentric pulleys at the ends of the non-flexing members. Draw length options in this embodiment would have presented even greater challenges in terms of coming up with a suitably effective energy storing pattern.

Though it had some decided preformance-engineering tradeoffs in it's makeup, the Groves invention did find it's way into the market for a brief period. It was never adopted by the majority of manufacturers, and is no longer being produced or marketed.

Three other asynchronous compound bow designs were patented between 1975 and 1987 which attempted to both resolve the conflicts caused by cables crossing over intermediate the string and frontmost part of the bow, and concurrently better address the pulley/actuator induced limb-torque that was part of all bisynchronous designs, and which had been a part of the initial (Groves) asynchronous design as well. Each of these inventions sought to utilize single-planar, leverage inducing components, all mounted so as to be aligned longitudinally with the bowstring. Having in common the use of single planar elements, the follow-on asynchronous bow designs patented since 1974, otherwise varied greatly in terms of their overall designs and functional characteristics.

Jones, (U.S. Pat. No. 4,227,509)

The Jones invention employed a severely arcuated limb design with the concave face of the limb facing the intended target area. Like the initial asynchronous compound bow (Groves) the overall limb motion during operation of the bow called for a more extreme "buckling beam" motion. However, this bow was configured to use levers mounted at the tip-ends of each limb, rather than near the base of the limbs on the riser component, as had been the case with the (Groves) invention.

The levers employed at each limb end were non-equilateral (right) triangular shaped elements with an axle hole proximate the right angle. In order to get sufficient draw length from this design, the triangular lever elements had to have the longest side adjacent the right angle be quite long (between 5" and 6" long for the average draw length archer). The bowstring was attached directly to the triangle at the tip of the most acute angle. A separate actuator section was affixed to the triangle at the tip of the less acute (non-right) angle, and proceeded from there directly to a point where it was secured in place on the front of the bow's riser element. The (non-bowstring) actuator segment was positioned between the side of the limb facing the target, and the target itself. The non-equilateral nature of the right triangular levers used, produced the effect that the farther back the bowstring was drawn, the less force was required by the archer to hold it in a drawn position. The inventor held the ever decreasing draw force characteristic to be an advantage of the invention.

All elements relating to operation of the Jones invention (string, levers, lever mounting brackets, front actuator segments, etc.) were aligned with the lengthwise centerline of the limbs, thereby accomplishing two soughtafter goals, namely, elimination of crossover cables intermediate the bowstring and front of the bow, and elimination of pulley/actuator induced limb-torsion with it's well known negative effects. These constituted the sole positive features of the invention.

However, the Jones version of asynchronous operation, also had performance-engineering compromises in it's makeup.

The more extreme "buckling beam" limb motion inherent in this (Jones) design had the same type of built in deficiencies, but to a greater degree, as had plagued the earlier (Groves) version. Additionally, the requirement to bolt on metal "hangars" to house the levers on the outside of, as opposed to in a crotch at the end of, each limb added significant swing weight to each limb, further compromising limb tip acceleration when the string was released, after the bow had been fully drawn back. Outside mounting hangers were required by the design in order to synchronize lever start and stop positions during operation of the bow, and use of "crotches" at the limb ends which might have removed enough material so as to at least partially offset the added weight of the hangers, was therefore not an option.

The levers in the Jones invention themselves were, of necessity, far larger and heavier, for a given draw length bow, than were required of pulleys or cams used to provide leverage in bisynchronous bows having similar draw lengths, and this further added to the already relatively heavy swing weights at the limb ends. Added swing weights adversely affect arrow acceleration and increase shock transmitted to the archers bowhand.

However, these drawbacks paled by comparison to the (Jones) invention's most glaring defect, that of having an even less efficient transmittal of energy stored in the limbs, out to the string and arrow upon release of the fully drawn bow, than had been the case with centuries old prior art longbow and recurve designs of equal "peak" pull weight. In effect the type of levers used in this configuration worked exactly opposite the way prior art simple bows worked in terms of causing the limbs on the bow to store and release energy into the arrow for acceleration purposes.

In prior art simple (non-compound) bows, the farther back the bow was drawn, the greater was the amount of energy stored in the limbs that could be used upon release for arrow acceleration. At the peak of the draw in prior art longbows and recurves, the greatest possible amount of energy was therefore available to use in overcoming the fixed inertia of the arrow when the string was released. In the (Jones) version of an asynchronous compound bow, the farther back the bow was drawn, the less the amount of energy became in terms of being transmitted to the arrow upon release. Upon release in this (Jones) design there was the least possible energy available to be transmitted to the string to be used in overcoming the fixed inertia of the arrow when the bowstring was released, after the bow had been fully drawn.

While the leverage working on the bowstring and arrow continued to increase as the string moved forward with the Jones invention, the increased leverage was also being applied as the total amount of energy stored in the limb was being rapidly and continually reduced (unloaded). The net result on energy transference from the limbs to the string and arrow with this design, was that more energy was lost to rapid limb relaxation as the limbs went from a full drawn position to a relaxed (at rest) position, than could be compensated for by increasing leverage near the end of the strings forward travel. This, coupled with the inherently less efficient "buckling beam" type of limb energy storing (acknowledged by the inventor) and limb tip motion upon release, together with the greatly increased swing weights at the ends of the bows limbs, rendered this design less efficient, from an overall performance standpoint, than the bisynchronous bows being produced at the time of its introduction.

Ricord (U.S. Pat. No. 4,457,288)

The third asynchronous compound bow invention (Ricord) also used an arcuated flexible member in it's makeup, but the arcuated member was not related to the bows limbs. The flexing member in this invention was a riser mounted resilient member to which the eccentric pulley was attached by way of an outside hangar bracket. Like the (Jones) invention, the cam employed in the (Ricord) invention required a built in "stop", which mandated a hanger assembly instead of a crotch in the bending member.

In the Ricord invention, the limbs were specified to be completely rigid beams mounted on the front of the riser component in cantilever fashion. The arcuated flexing members to which the pulley assemblies were attached were specified to be attached to the back of the riser component in what would normally be the sight window area of the riser, and the area immediately below where the grip would normally be positioned.

The flexing members to which the pulley assemblies were connected were designed to arc upward and away from the back side of the riser when the bow was in an assembled but at-rest condition. The pulley assembly, string, actuator section connecting the pulley to the bowstring, and the simple rollers mounted on hangers at the end of the rigid limb members were all aligned in a single plane, with said plane being offset to the outside of the bows vertical centerline sufficiently for arrow fletching to clear the sight window of the bow.

During operation of the bow, pulling on the bowstring caused the pulling force to be transmitted over the simple rollers mounted at the limb ends to the eccentric pulleys mounted on the flexing members attached to the back side of the riser. The eccentric pulleys rotated on their axles causing the flexing members attached to the bow to store energy in whatever energy storing pattern was programmed into the pulley type being used. As the energy load increased, the flexing member, to which the pulley assemblies were attached, would bend in a manner causing it's non riser-attached end to move toward the back side of the riser component as the actuator length pre-wrapped around the pulley at rest unrolled and added draw length to the system.

Upon release, these motions were reversed, and the flexing member moved in a direction back toward the archer as the bowstring returned to an at-rest position.

No information was given by the inventor (Ricord) about where the grip should be positioned in the invention in order to effect the soughtafter elimination of pulley/actuator induced limb-related torque, but it can be surmised that those practiced in the art would quickly have determined that the centerline of the grip would have had to be offset from the bows centerline sufficiently to line up with the pulley-string elements in order to accomplish such an outcome.

The Ricord invention, like other asynchronous inventions before it, contained performance-engineering tradeoffs. On the positive side were (again) the elimination of cables in the arrow passby area of the bow, and, assuming proper grip positioning and use of rigid limbs, a complete elimination of pulley induced torque in the system.

While no specific claims relating to energy storing patterns, letoff points and/or letoff percentages, and so on were made by the inventor, it may be presumed that this design might also have been produced, at least in short draw lengths, with a variety of energy storing patterns, including effective and desirable ones, depending upon the shape of pulleys selected for use.

Problems arose with the Ricord invention in a number of areas as well. Among the more obvious limitations of the Ricord invention was the requirement to mount all the co-planar elements off to one side of the vertical centerline of the bow. Such off center mountings would, unless somehow counterbalanced by adding additional weight to the back side of the bow (the side opposite where the pulley elements were offset) would result in an unacceptable amount of "system" torque being present in the bow due to the side-to-side imbalance resulting from the uneven weight displacement along the bow's centerline. Such side-to-side imbalance would seriously distract from shooting accuracy unless stabilizing counterbalances were strategically positioned along the bow riser to offset it.

The requirement of the Ricord design to offset the pulley-actuator elements all to one side of the bow's vertical centerline, precluded use of flexing limb members, since employment of flexing limb members having all stress applied to one side of each flexible limb, would have rendered the limbs subject to a horrendous amount of torque, and it probably would have made the bow impossible to either shoot accurately, or, in fact, even remain in an unbroken state for any length of time.

Lack of ability in the Ricord invention to utilize flexing limb members dictated that, as in the rigid-limb configuration embodiment of the original (Groves) invention, each pulley used had to be of sufficient circumference to provide all of the draw length needed for archers of all sizes. This rigid limb configuration, in turn, dictated that the pulleys used be significantly larger than the ones used in a typical prior art bisynchronous compound bow of equivalent draw length and fistmele. The requirement for unusually large pulleys, in turn, led to the same kind of draw length versus desirable energy storing pattern tradeoffs that had plagued all prior asynchronous compound bow inventions before it.

In the Ricord invention, the draw length limitations were possibly even more restricted that in the inventions that preceded it. This occurred because of the relatively short length of the flexing member mounted on the back sides of the riser, and the proximity of their tips, to which the pulley assemblies were attached, to the back of the riser when the bow was in an at-rest position. Relatively small pulleys (allowing relatively short amounts of cable to be unrolled from around them that could be used to effect draw length) would cause the flexing member to contact the back of the riser, thereby precluding further bending of the flexing member, or unrolling of enough actuator segment used to sufficiently increase draw length in the bow to accommodate the draw lengths of most archers.

In the event the flexing member were increased in length, and made more severely arcuated when at rest, to allow for greater flexure, and thereby accommodate the use of larger pulleys, capable of providing greater draw length to the system; the larger size of the pulleys would cause the flexing member to bend so far that, unless the materials it was constructed of were extremely pliable, the flexing members would be subject to breakage.

In the event the materials used for the flexing members were pliable enough to allow for sufficient movement to accommodate large pulleys and long draw lengths, the return energy stored in them would be relatively ineffective in terms of accelerating the arrow forward when compared to prior art bows. In the event longer, and more severely pre-arcuated flexing members were employed, and the materials they were constructed from were sufficiently stiff to provide arrow acceleration, the pulley sizes used to effect their deflection would necessarily be too small to result in unrolling enough actuator to provide a draw length sufficiently long to fit most archers, or breakage of the flexing member would ensue.

These conflicting performance-engineering considerations were of the worst kind, meaning that while diametrically opposed to each other in nature, all three such characteristics (i.e. normal draw lengths and efficient energy storing patterns and efficient energy storing members) had nonetheless to be present, in order for the bow to prove useful in the field. Such contradictions relating to the Ricord invention have to date apparently not been overcome by practitioners in the art.

Nishioka, (U.S. Pat. No. 4,465,054)

While not attempting to address the issues relating to pulley induced torque, resulting from use of mechanical advantaging devices relating to compound bows, one invention (Nishioka, U.S. Pat. No. 4,465,054) relating to a bow using simple (non-energy compounding) pulleys which operated essentially in an asynchronous manner was published a couple of years following the (Ricord) invention.

This bow operated by employing simple pulleys (rollers) centered in crotches located at each limb tip, over which the bowstring/actuator used by the archer to draw the bow, passed to a point where it was tied off on a pair of rigid pylons fixedly attached to the bows riser component, and extending backward from the bow riser at points above the sight window, and below the bows grip area.

A "second" flexible bowstring section was fixedly attached to the bows limbs at a point(s) immediately below the crotch at each limb end, and in the same plane as the bowstring/actuator section used to draw the bow. The bowsrting/actuator section used to draw the bow was thereafter attached by other flexing means to the "second" bowstring that was secured directly to the limbs.

In operating the Nishioka invention, the archer secured the arrow nock to the "second" bowstring, while thereafter applying draw force directly to the other bowstring/actuator segment which passed over the simple rollers to the point(s) where it was tied off on the rigid pylons attached to the back of the bow riser.

The "second" string was deployed in order to provide for mounting of the arrow on the "secondary" string segment, in front of the primary bowstring, thereby allowing use of shorter arrows, and ostensibly eliminating most of the finger induced torque to the arrow propelling string that might otherwise occur when the archer executed an imperfect release of the bowstring, in bows equipped in the normal (single bowstring) manner.

While no claims were made regarding it's possible use in a configuration in which the simple pulleys might have been replaced with eccentric cams, thereby allowing the bow to function as a compound bow, those practiced in the art might be expected to detect the possibilities of such a substitution. Approximately two years after publication of the Nishioka patent another inventor (Powers) received a patent for just such an improved "compound" design.

Powers, (U.S. Pat. No. 4,649,890)

The inventive bow described in the Powers patent (U.S. Pat. No. 4,649,890) like those described in all of the asynchronous patents except (Groves) which precluded it, used single planar elements in terms of those elements contributing to the energy storing and releasing system. That is, the centerline of the pulleys, actuators, pulley mounting assemblies, cantilever bars to which the actuators were tied off, and bowstring all lay in the same plane.

Unlike the (Ricord) invention, all these elements likewise laid in the same plane as the vertical centerline of the bows limbs and riser, with the centerline of the grip also laying in the same plane, and the limbs were designed to be flexing members. Unlike the (Jones) invention, the Powers invention used single planar pulleys (both actuator segments, the one being unrolled and the one being rolled up used the same groove, but at different times), and a separate cantilever bar, attached to the back side of the bows riser was used to position the tieoff (anchor) location for the cable (tensioning) actuators. Unlike the (Nishioka) invention, the Powers invention used a single bowstring, and substituted single-planar, overlapping track cams to effect a possible measure of mechanical advantage in the energy storage system.

The rigid cantilever mounted bars, extending well back toward the bowstring, which were used to position the actuator tieoffs, provided a somewhat less severe version of the "buckling beam" effect when the bow was drawn, as the means of storing the energy that would be used for arrow acceleration upon release of the fully drawn bow.

The Powers design was simple, even elegant, in terms of it's approach to eliminating pulley/actuator induced limb torque, and eliminating many of the problems long associated with compound bows having cables which crossed over intermediate the string and frontmost part of the bow.

The Powers invention had three significant performance-engineering compromises in it's makeup.

The first compromise had to do with limitations on energy storing patterns imposed by the pulleys used. By selecting a pulley type designed earlier for use in bisynchronous bows (Simonds, U.S. Pat. No. 4,401,097), for use in an asynchronous compound bow configuration, the inventor severely limited the types of energy storing patterns that could be employed by bow builders. In fact, the only energy storing pattern possible, given the overlapping track, single planar pulleys used, was one that had many undesirable aspects in it's makeup. Single-planar pulleys having overlapping tracks in the same plane have inherent in their makeup an operational requirement not suited to bows configured to operate in an asynchronous fashion.

Single-planar pulleys with overlapping tracks, which aim to produce continuous and effective energy transferrance to the arrow during the entire distance comprising the forward power stroke, require that for whatever length of (one end of) the actuator is unwrapped from the track during drawing of the bow, an equal length of actuator must be wrapped around the track with actuator material comprising the other end of the actuator system. This requirement works well in bisynchronous bows, since, in bisynchronous configurations, the "take-up" pulley track needs to roll up sufficient actuator length to accommodate the bending of both the limb it's pulley is directly attached to, and the slack resulting from the bending of the limb, of equal length, mounted at the opposite end of the bow, as the limb tips are being compressed toward one another.

The first limitation of the Powers invention relates to combining the working limb and pulley system elements in a way that produces an efficient and desirable energy storing pattern. Regardless of the overall size of overlapping-track cam (pulley) used, it is not possible, in an asynchronous configuration, to produce a draw force energy curve, using a single-planar, overlapping track pulley, which provides that, beyond the point where the minimum effective leverage point while unrolling actuator from the primary pulley groove is reached (about halfway back in drawing the bow, when the bowstring resistance to the archer is the greatest) that the system can be made to thereafter provide for continually reduced pressure on the bowstring for the remainder of the draw, as a benefit to the archer.

A continually reduced drawing/holding force during the final stages of the draw (only) has been established as both the most desirable from the standpoint of shooter comfort, from the standpoint of accurate aiming, and from the standpoint of allowing the optimum selection of arrow weights and stiffness suitable for use with a given compound bow.

The use of a single-planar, overlapping track cam as seen in the Powers invention results in a draw force energy curve wherein the archer initially finds the bow relatively harder and harder to draw over the first half of the draw which serves to store high amounts of energy in the system which can thereafter be used for arrow acceleration, and which condition is desirable. This happens because during the first half of the draw, the leverage in the pulley is working against the archer, even though the resistance from the limb member is less than it will be later on in the draw. However, during the second half of the draw, while the energy storing in the limb continues to grow at a very high rate, the pulleys used in the Powers invention provide insufficient additional leverage to the archer with which to effect a significant reduction in holding force related to the bowstring.

During the last quarter of the draw, when using the pulleys described in the Powers invention in an asynchronous configuration, the amount of force required by the archer to continue drawing the bow back increases in a linear fashion to the total energy being added to the system through limb deflection. The only energy storing pattern available to those employing the teachings of the Powers patent is one which is undesirable in nature, and inferior to other widely deployed energy storing patterns that can be produced in bisynchronous systems, using the same pulley type, and other types of pulleys.

The second area of compromise in the performance-engineering areas mandated by the Powers invention related to the need to balance pulley sizes, lengths of tensioning actuator takeup, and overall limb deflection against draw length requirements. Given the rigid cantilever rods used to position the actuator tieoffs, and the concurrent use of single-planar, overlapping track cams, deflection in the flexing limb members is restricted to bending more in a direction down, but not very far back toward the archer. As discussed earlier, with regard to the (Groves) invention, this motion is inherently somewhat less efficient than systems which allow the limb tips to travel further back, toward the archer, during drawing of the bow.

A third area of difficulty with the Powers invention, which is perhaps more important than the somewhat less efficient limb tip motion during operation of the bow, is the fact that pulley sizes (and therefore draw length options) are restricted by the combination of elements being used in the Powers invention, in the event the bow were to be configured to provide continuous energy transference to the arrow through the limb and pulley system during the acceleration period.

Continuous energy transference to the arrow during the entire distance of the forward power stroke is acknowledged to be a preferred condition of compound bow energy storing systems, as well as other bow types. The effective length of the forward power stroke greatly affects the overall ability of any bow (including compounds, recurves, and longbows) to provide peak acceleration performance at a given draw length and with a given mass (weight) arrow.

In the Powers invention, in the event standard single-plane pulleys are selected that would both allow continuous and efficient energy transference throughout the entire forward power stroke distance, and would further allow the usual 6–7" of actuator segment to be unrolled during the drawing of the bow, in order to effect an average draw length, while maintaining a normal fistmele, and providing an acceptably long and efficient power stroke distance for arrow acceleration, the opposite track in the pulley would be required to roll up a similar 6–7" of tensioning actuator material in the pulley groove that had it's actuator segment tied off on the cantilever bar.

If, in the Powers invention, again supposing the use of single-plane pulleys capable of providing continuous and effective energy transference throughout the entire power stroke distance, and assuming the point where the tensioning actuator tieoff point on the cantilever bar could be moved far enough away from the limb to allow that amount of cable to become engaged in the single-plane pulleys groove, the taking up of that amount of cable would cause such a great amount of deflection in the limbs, that, unless they were constructed of very pliable materials, they would almost certainly break in two. If constructed of pliable enough materials to avoid breakage, they would be relatively less effective at storing energy for arrow acceleration. In order to hold limb deflection to acceptable (non-breaking) levels, a standard single-plane pulley when used in the Powers invention would have to be relatively small, assuming the limbs were made of suitably stiff materials to provide effective energy storage from which arrow acceleration could be obtained. In the event the pulleys remained small enough in outside circumference to avoid limb breakage, the draw lengths attainable would be far too short to be useful for the majority of archers, assuming the bow was also configured to have a reasonably low brace height and desirably long power stroke.

In the Powers invention, if single-plane pulleys were employed of a type that would provide continuous and effective energy transference throughout the entire forward power stroke distance, and the bow builder elected to angle the limbs further back toward the archer when the bow was in an at-rest position, in order to be able to employ small enough pulleys so that the limbs would not break from over-deflection, and thereby enable use of limbs constructed of stiff enough materials to provide good energy storage characteristics, while still ending up with a suitable overall draw length for the majority of archers, the brace height (fistmele) would be increased unacceptably, and the power stroke distance would be shortened to a level that resulted in unacceptably compromising the rate of arrow acceleration from a given draw length and draw weight bow shooting a given weight arrow; such resultant arrow velocities being inferior to, and uncompetitive with, that found in most prior (and current) art bisynchronous compound bows being marketed.

It appears clear that the inventor (Powers) recognized the paradox that existed in his co-planar approach, in terms of having to concurrently provide sufficient draw-length in the bow (indicating large enough pulleys), but not, at the same time have the single-planar pulleys take up so much tensioning actuator length so as to overstress the bow's limbs, since the inventor attempted to address the problem by modifying the pulley in a manner that resulted in significantly less tensioning actuator length being rolled up in the pulley's grooves, during drawing of the bow, than would have been the case with a standard single-plane pulley configuration.

In the Powers invention, in order to accommodate the conflicting concurrent needs for acceptably long draw lengths, non-overstressed limb members, use of stiff and resilient limb materials, and suitably low brace heights (fistmele), the inventor provided in the single-plane pulleys of the invention, a swivel sub-assembly point where the tensioning actuators attached to the pulleys. The swivel-mounted tensioning actuators allowed the pulleys to be rotated between ¼ and ½ of a full revolution, prior to the tensioning actuator engaging the pulleys tracking groove in a manner that would begin to apply significant amounts of bending pressure to the limb member. When reversed, during the forward power stroke, the swivel mounting of the tensioning actuator likewise resulted in reduced (virtually no) energy transference to the arrow for approximately ¼ to ½ of the final distance the limbs traveled forward upon release. The swivel sub-assembly of the single-plane pulleys required by the Powers invention also added another point of friction between moving mechanical parts to the bow.

In the Powers invention, the approach to tying off the tensioning actuators on a swivel sub-assembly on the single-plane pulleys in the Powers invention, achieved the previously stated objectives of concurrently allowing adequate draw lengths, non-overstressed limb members, and use of stiff and resilient limb materials, but at a great sacrifice in terms of reducing the limbs and pulleys ability to transmit energy to the arrow over the entire distance of the forward acceleration (power) stroke distance.

The net-effect of the swivel mounting of the tensioning actuators on the pulleys in the Powers invention would be roughly the same as tilting the limbs farther back at rest, lengthening the fistmele, and shortening the length of the forward power stroke by these means. That approach has already been shown to result in non-competitive performance when compared to other existing bow designs, and is therefore felt not to constitute an improvement in the state of the art from a performance standpoint, in the compound bow field of art.

In effect, the approach taken in the Powers invention toward overcoming the paradox imposed between draw length and cable takeup requirements, said paradox existing because of the overriding requirement that all actuator sections had to be co-planar and coincident with a plane containing the vertical centerline of the bow's limbs, would seem to be a negative advance in the state of the art.

When the compromises relating to the shortening of the effective power stroke distance, are added to the lack of a desireable energy storage and transmittal to the arrow pattern for whatever reduced amount of the power stroke distance still remains during those times when the tensioning actuators become and remain engaged in the pulleys grooves during operation of the bow, the Powers invention yields significant perfromance-engineering tradeoffs. The tradeoffs include being harder to hold at full draw, reduced arrow speed, heightened trajectory, and reduced target penetration on the negative side, compared to non-torque affected arrow flight, with a potential for improved accuracy on the positive side.

This is especially the case when current state-of-the-art bisynchronous bows are available which essentially offer to reverse the ratio of negatives to positives, when considering these same performance factors. It is admittedly the case that either approach listed in this paragraph involves compromise. However, the typical bisynchronous compound bow (current state of the art) requires compromises in fewer performance areas than would the Powers invention.

BACKGROUND OF THE INVENTION—SUMMARY OF COMPARISONS BETWEEN ASYNCHRONOUS AND BISYNCHRONOUS SYSTEMS

As described before, the basic concept defined by the Allen patent in 1969, while sound as an energy compounding system per se', was nonetheless flawed when adapted for use in providing mechanical advantage for archers bows. The flaw in the Allen invention was the requirement for actuators to cross over at some point intermediate the bowstring and frontmost part of the bow.

When adopted for use as an energy compounding system for archers bows, the cable crossover mandated in the concept proposed by Allen required that a number of performance-engineering compromises be accepted by bow builders using the teachings of the Allen patent. Upon careful examination, as has been provided herein, it can be seen that the crossover cable requirement is, in fact, a fatal flaw, in that the crossover cable approach mandates various individual bow elements to always be deployed in a manner that involves at least some mutually contradictory results, in terms of achieving overall performance objectives. Thus, bow builders choosing to adopt the basic bisynchronous concept first identified in the Allen patent, must always be limited to building compound bows which involve in their makeup some compromises in either key engineering areas, key performance areas, or both.

However, it must be said that, on balance, the positive features enabled by the Allen invention, were sufficient to cause it to be widely adopted by manufacturers and archers, and favored by the great majority of archers over prior art longbows and recurves.

Further, over a period of the next thirty years time, nearly two hundred follow-on invention were spawned by the Allen invention, aimed at improving upon the original Allen Design. While many of these follow-on inventions were deemed by the end users in the field to not be highly significant, and many of these follow-on inventions did not achieve a lasting presence in the market, it can at least be said that a relatively high percentage of them initially appeared worthy enough in merit to have found their way into the market and common use by archers for some period of time.

Compound bow inventions centered around energy compounding systems designed to work in an asynchronous manner have not, to date, fared as well in the marketplace as have compound bow inventions centered around bisynchronous energy compounding systems. In fact, to date, no compound bow invention employing an asynchronous energy compounding system has found it's way into the marketplace for even a brief sustained period of time.

As shown previously herein, asynchronous compound bow inventions published to date have uniformly encountered performance engineering stumbling blocks of their own. With one exception, asynchronous compound bow inventions to date have, by employing co-planar elements in the pulley/actuator systems used, uniformly been able to avoid most of the specific types of performance-engineering compromises unique to bisynchronous compound bows, especially in the areas relating to eliminating the negative effects of pulley induced torsion on all performance areas important to archers, and in terms of avoiding cable interference with arrows leaving the bow.

However, the asynchronous inventions made to date have uniformly achieved the desired elimination of crossover cables intermediate the bowstring, and the elimination of pulley-induced, torsion-related, problems stemming from the use of crossover cables, at a cost of having to accept compromises in one or more of the following four engineering areas:

1) efficient limb motion limitations—i.e., adopt design factors that force limb tip motion to be less efficient than, and generally inferior to, that found in bisynchronous systems, resulting in bows whose ability to accelerate arrows of a given weight forward, is less than that found in compound bows based upon bisynchronous designs,
2) desireable energy storing pattern limitations—i.e., adopt energy storing patterns that are less efficient, less desirable from an overall performance (shooter comfort, arrow selection, arrow velocity, and arrow penetration) standpoint, and which are generally inferior to those energy storing patterns found in bisynchronous systems,
3) draw length limitations—i.e., accept limitations in terms of the draw lengths that could be offered to users, in the event the bow incorporated features which did not have compromises in one (or both) of the first two areas of limitation mentioned immediately above, and/or,
4) power stroke distance limitations—i.e., accept limitations in terms of the short lengths of power (acceleration) strokes that could be designed into such bows, said shorter power strokes working to reduce resultant arrow velocities from a given draw length and draw weight of bow when so configured.

These four performance-engineering constraints, are unique to asynchronous compound bows, and are in addition to the other performance-engineering considerations noted in the performance-engineering matrix for bisynchronous compound bows alluded to earlier. An augmented performance-engineering matrix could be compiled for asynchronous compound bow designs, by adding the above four additional engineering categories to the eight outlined earlier for bisynchronous compound bows, and linking each of the four new engineering categories to each of the same (eight) performance categories shown in the performance-engineering matrix relating to bisynchronous compound bows. The augmented performance-engineering matrix for asynchronous compound bows would then have a combined number of ninty-six possible problem areas in it, compared to the sixty-four elements in the performance-engineering matrix relating only to bisynchronous compound bows.

It is logical, given the fact that bow designers had only to confront the eight engineering obstacles outlined in the performance-engineering matrix relating to bisynchronous compound bows, but had to confront the twelve engineering obstacles comprising the performance-engineering matrix relating to asynchronous compound bows, that compound bow invention following the original commercial success of the compound bow defined by the Allen patent, would center on improving compound bows based upon the bisynchronous model originally laid down in the Allen patent.

The four types of performance-engineering tradeoffs unique to and associated with asynchronous compound bow inventions published to date have proven to be particularly intractable in nature, and are further complicated by virtue of the fact that they all must be overcome concurrently, if the resultant asynchronous compound bow is to be as useful, and perform as well in the key performance areas, as bows based upon the bisynchronous model. This has not proven an easy task, and inventions aimed at improving upon the shortcomings thus far identified in asynchronous compound bow inventions, have been very few in number.

Only one invention might so far qualify as a follow-on asynchronous invention. This figure must be compared directly with the almost two hundred follow-on inventions that ensued aimed at improving bisynchronous compound bows, after Allen introduced the original bisynchronous invention in this field of art.

The four additional engineering challenges that have plagued asynchronous compound bow inventions since 1969, comprise a somewhat more difficult set of challenges to meet and overcome than the individual engineering challenges related solely to bisynchronous compound bows, due to the fact all of the engineering challenges unique to asynchronous models must be addressed and solved concurrently, if the resultant asynchronous compound bow is to be as useful as state-of-the-art bows having bisynchronous pulley operation.

These are possibly the principal reasons why no compound bow, based upon an asynchronous model, has thus far reached a point of sustained commercial production and/or use by manufacturers and/or archers.

Unlike the four engineering challenge areas that are unique to asynchronous compound bows, which must all be addressed concurrently in order to effect a practical and useful product, the eight engineering challenges defined in the performance-engineering matrix, which are the only ones that must be faced by bisynchronous bow designers, can be attacked by inventors individually. This, in fact, has been the approach of most of the compound bow inventions patented since issuance of the Allen patent.

This is not to imply that attempting to single out a single engineering area to work on is, or should be, the correct or preferred approach. In fact, the attempt by bow designers to single out a particular engineering area to work on,.without understanding how that engineering area is affected by, and affects other engineering areas, or related key performance areas, simultaneously, is believed to be a principal reason that no bisynchronous invention to date has been completely successful in advancing the state of the art in even one engineering or performance area, without concurrently making things worse in another engineering or performance area.

The first step in solving any problem is to define the problem. The second step in solving any problem is to break the problem down into its most basic set of elements. How the problem is defined determines the type of solutions that will ensue. An improper or incomplete definition of the problem will result in an ineffective or incomplete solution. It has been the history of compound bow development that ineffective and incomplete solutions to the many problem areas which existed at the outset (and which continue to exist) have been the rule. The reason appears to be clear. The problem definition by prior inventors in this field of art has been flawed and/or incomplete.

In this context, the value of identifying the performance-engineering matrices applying to bisynchronous compound bows and asynchronous compound bows, and the related discussion in this patent application of their relevance, in terms of identifying all of the problems that have to be overcome concurrently, if the inventor or bow designer is attempting to provide a complete solution to the problems that have faced all compound bow designers and related inventions to date, constitutes a significant benefit afforded future inventors who will have benefit of the teachings of this invention.

On balance however, at this point in time, if usefulness is taken as the guideline of success, it must be said that those inventors who to date have centered their efforts around improving bisynchronous compound bows, have decidedly thus far produced the more useful inventions.

DESIRABLE COMPOUND BOW CHARACTERISTICS AND THE OBJECTIVES OF THIS INVENTION

Given the preceding detailed and complete description of prior art relating to compound bows, it is now possible to summarize the significant characteristics that would need to be incorporated into the "ideal" compound bow. It can be stated with certainty that, to date, no compound bow has been produced, whether widely used or not, based upon either bisynchronous or asynchronous operation, that embodies all of the characteristics and/or features which follow. Broadly speaking, the objective of this invention is to define an archers compound bow which successfully addresses all of the past engineering challenges that have faced prior inventors of both asynchronous and bisynchronous compound bows, in a manner that does not result in adverse affects manifesting themselves in any of the engineering or performance areas discussed previously.

Specifically, it will be the objective of this invention to define an improved compound bow which does embody all of the desireable features and charactistics which follow:

Characteristic Number 1: Complete Range of Energy Storing Patterns, Draw Lengths, and Power-stroke Lengths The ideal compound bow should provide enablement of a wide range of effective and desirable energy storing patterns for archers of all draw lengths. All types of archery shooting do not necessarily require the same type of energy storing pattern in order to be best suited for the type of shooting in question.

Tournament (target) shooting is best served by energy storing patterns which provide a great deal (usually 55–80%) of reduction in the amount of force required by the archer when at full draw, in order to facilitate long time periods for refining of aim, before releasing the arrow, usually with a mechanical release aid. Penetration, which is generally reduced (from a given draw weight bow) when high percentage letoff pulleys are used, is relatively unimportant in target shooting, while the ability to hold the bow in a fully drawn condition for relatively long periods of time, while refining aim, is very important.

Hunting requirements require rapid and complete arrow penetration from bow and arrow combinations used by hunting archers, and bows of a given peak draw weight having the highest percentage of letoff related to their energy storing systems do not work as well under hunting conditions. Hunting bows need to provide for a more moderate percentage (usually from 30–55%) of decrease in holding force, when compared to the maximum amount of draw force resistance (muscle effort) the archer had to expend in drawing the bow all the way back. This "medium" letoff "range" provides a significant enough amount of letoff to allow archers to shoot bows which are generally much greater in peak draw weight than they could handle given recurve or longbow energy storing patterns, and therefore produce significantly greater possibility of rapid and complete penetration of the sometimes very large animal type targets involved in this aspect of the sport. At the same time, letoff percentages in the 30–55% range are still significant enough to provide a substantial measure of improved (extended) aiming for archers using bows so designed.

Archers shooting at moving targets, such as swimming fish or flying birds, are generally best served by bows having no letoff whatsoever. "Snap" shooting requires that a rhythmic "feel" be developed wherein the archer draws the bow, smoothly moves the aim of the arrow to a point ahead of the intended target, and at that split second the sight "picture" appears correct, releases the string, all in one smooth controlled movement. Archers involved in this aspect of the sport are generally best served by older style recurve and longbows, which, are lighter in weight (bow mass) and easier to "swing" ahead of the target with, and which also provide an energy storing system with no letoff, and therefore no abrupt change in draw force on their fingers which might detract from their concentration on the overall movements and timing required for successful shot execution.

The ideal compound bow should be able to accommodate all such varying energy storing patterns using interchangeable components, and should further accommodate all such energy storing patterns for all draw lengths of archers while allowing the bow designer to incorporate low fistmeles (brace heights), thereby providing as long a power stroke distance as desired.

It is an objective of this invention to define a compound bow which does embody all of these characteristics.

Characteristic Number 2, Elimination of Pulley Induced Torque

The by now obvious advantages of eliminating limb torque resulting from pulley/actuator use are well known. While minimal amounts of pulley-induced torque can be compensated for to some degree by adding other components to the system such as load-balancing "yolks" suspended from the axles, and by thereafter adjusting the sights to cause the arrows to hit the center of the target, even moderate torque in the system is detrimental to every performance area, especially penetration, and even moderate torque makes it much more difficult to shoot hunting pointed arrows in a consistently accurate fashion. Dozens of inventions have sought to improve things in this area, and for good reason.

The optimum compound bow would not have pulley-induced torque present in it's energy compounding and storing system at any point in time.

It is an objective of this invention to define a compound bow that does not have pulley-induced torque present at any point in time.

Characteristic Number 3, Minimizing Hand-induced and "System" -Induced Torsion

All kinds of torque are disruptive in terms of overall archery shooting system performance, as could be seen in the previously described performance-engineering matrix. "System" torque is best minimized by assuring that as little material weight as possible is required for forming the bow's sight window, and that added-on accessories attached to the bows riser (arrow rests, cushion plungers, overdraw shelves, sight pin mountings, bow quiver mountings, stabilizer mountings, and so on) are incorporated in a manner that minimizes either side-to-side or top-to-bottom imbalance in the fully equipped bow.

Hand torque, resulting from a form-fault on the part of the archer, is best minimized by providing a narrower grip section in the "throat" area of the grip. The optimum compound bow would address both of these needs as well.

The ideal compound bow would also incorporate in it's makeup flexing (limb) members which themselves were capable of moderating the effects of any torsion that did inadvertently find it's way into the system, and which members were capable of counteracting or "damping" any torsion transmitted to them quickly.

It is an objective of this invention to define a compound bow which facilitates minimizing hand-induced, and system-induced torsion to the extent that either source of torsion cannot be completely eliminated. It is a further objective of this invention to define a means of embodying torsional stability in an integral manner, directly within the limb members themselves, in a manner that eliminates the need for other components to be added to the system to aid in accomplishing torque suppression when the limb members are subjected to lengthwise torsional forces from any source.

Characteristic Number 4, Elimination of Actuators in the Arrow Passby Area of the Bow The problems relating to actuators being present in the arrow passby area are well known. The ideal compound bow would not have tensioning actuators, except the bowstring, present in the arrow-passby area of the bow, whether displaced by a cable "guard" or not.

It is an objective of this invention to define a compound bow structure that has no tensioning actuator sections, except the bowstring, present in the arrow passby area of the bow, at any point in time.

Characteristic Number 5, Minimized Masses of Accelerated Bow Components

Weights of pulleys, axles, actuators, and limb tips all steal from the total amount of energy stored in the system that can be used for arrow acceleration. The ideal compound bow would employ the lightest possible combined weights in terms of movable bow components. Optimally, this would be accomplished in a manner that did not make the overall length of the bow so short as to be critical in terms of reacting violently to hand torque that might be present when the bow was shot.

It is an objective of this invention to define a combination of elements and means for operating them that result in significantly reducing the combined masses of bow-related elements that have to be moved forward in order to accelerate the arrow out of the bow, thereby providing a situation wherein a higher percentage of the total amount of energy stored in the limbs is available for transfer to the arrow upon release, and less of the energy stored in the bow's limbs is needed to accelerate bow parts. It is a further objective of this invention to define a means of accomplishing significant reductions in the weights of bow parts that are accelerated forward, while concurrently allowing the bow to be sufficiently long, overall, to minimize the adverse affects of hand-induced torsion on the system.

Characteristic Number 6, Eliminate the Possibility of Lengthwise Shearing in the Limbs Torque from any source (hand induced, pulley induced, or "system" induced) registering in the crotch area of compound bow limbs embodying crotches for housing pulleys, often results in lengthwise cracks emanating from the bottom of the crotch area. Regardless of torque in the system, the use of a crotch cutout to house the pulleys results in an uneven distribution of warp force registration along the length of the limb due to the fact that the axle doesn't pass through the limbs center (core) section. This fact further exacerbates the lengthwise splitting tendencies near the bottom of the crotch that ensue from torque induced by the operation of the pulleys being used.

These types of lengthwise cracks, when present, at a minimum result in noisier operation of the bow, and some degradation of accuracy, and at a maximum may result in complete limb breakage, and possible injury to the archer. The ideal compound bow, if embodying limbs with crotches, should be constructed in a way that precludes such cracks from occurring. The means used to eliminate lengthwise cracks in the limbs should itself be light in mass, so as to not unduly add to the swing weights at the ends of the limbs, or unduly reduce the amount of stored energy available for transmittal to the string and arrow upon release.

It is an objective of this invention to define a means of significantly increasing shear resistance, in an integral manner, in the limbs of the invention, to be employed in a manner that further eliminates the need for additional components such as "crotch bolts", wedges, and hanging load-balancing harnesses, to be employed as an aid in suppressing lengthwise cracks in the crotch area of the limbs.

Characteristic Number 7, Minimize Friction Between Moving Bow Components

Energy lost to friction between moving bow components, especially those relating to operation of the pulley-actuator system, detracts from the bows ability to maximize arrow acceleration. The ideal compound bow would have as few sources of friction as possible incorporated into it's makeup, and would further incorporate efficient means of minimizing friction in each area where friction between moving bow components could not be totally eliminated.

It is an objective of this invention to define a combination of elements and means for deploying them which results in significant reductions in the levels of friction present during operation of the bow.

Characteristic Number 8, Minimize Noise During Operation Resulting from Shock and Vibration Noise of operation, especially in compound bows designed for hunting, is undesirable in every instance. Noise may result from unused energy stored in the limbs being inefficiently transmitted to the arrow upon release, friction between moving elements of the energy compounding system employed, ineffective means of fixing in place a variety of add-on accessories attached to the bow's riser component, or some combination of these factors.

The ideal compound bow would incorporate features which served to eliminate as many such sources as possible of unwanted noise, and would further incorporate a variety of means of moderating or "damping" any such noise for which absolute elimination were not an option.

It is an objective of this invention to define a combination of features, elements, and means for deploying them that results in significantly reducing the level of noise associated with operation of prior-art compound bows in general, and compound bows having accessories mounted on them.

Characteristic Number 9, Minimize Overall Bow Weights (Masses)

Compound bows are, by their very nature of requiring the addition of an energy compounding mechanism in their makeup, subject to being somewhat heavier than their prior art recurve and longbow cousins. The heavier overall weights make them less comfortable to carry all day long in the field, and less agile when it comes to enabling movement in the hunting archers hand when shooting at moving targets.

The ideal compound bow would itself therefore be as light in weight as possible, while providing a means of adding weight, in a "system-balanced" manner, for those instances, such as competitive (stationary) target shooting, where additional mass in the archers hand might be deemed desirable.

It is an objective of this invention to define a combination of elements, and means for deploying them that may be employed in a manner that serves to significantly reduce the overall weight of a complete compound bow. It is a further objective of this invention to define a means for increasing overall bow weight, in a modular fashion, in a manner that preserves top-to-bottom and side-to-side balance in the bow.

Characteristic Number 10, High Strength and Durability Provided in Each Component Area While being of light overall weight, the ideal compound bow should not achieve the desired lightness in overall weight at the expense of component durability. Each component in a compound bow is subject to greater shock than is the case in prior art longbow and recurve bows. The increased shock mandates greater overall strength be built into compound bow components.

Typically the requirement for greater strength has manifested itself in components that are also heavier than comparable components found in prior art longbows and recurve bows. The added weight is often therefore counterproductive to both the overall efficiency of the bow, itself, and contributes to increased overall bow mass which detracts from shooter comfort in terms of producing heavier carrying weights. Both the component designs employed, and the materials employed in compound bows should result in a durable overall product which requires low maintenance on the part of the owner.

It will be an objective of this invention to define a combination of component parts and means of producing them which results in significantly increasing the strength of the affected components, while concurrently allowing them to be made lighter in weight.

Characteristic Number 11, Simplicity of Design Leading to Ease of Operation, Maintenance and Repair Compound bows have evolved into relatively complex instruments. Many are too complex in nature for the average archer to understand the operation of, and are now too complex for the owner to perform routine maintenance on and/or repair him or her self in the event a component should require replacement.

The complex designs associated with most compound bows have themselves, in many instances, contributed directly to the frequent need for maintenance and/or repairs, which had then to be accomplished by expert shop repair staff, at added cost to the bow's owner.

The ideal compound bow would be simple enough in design so that the owner could both easily understand it's makeup and operation, and be able him or herself, to accomplish any needed periodic maintenance or repairs, simply, even in the field, without complex specialized tools being required.

It is an objective of this invention to define a compound bow which is simple to understand the operation of, and which is simple enough to maintian that the archer can typically assume responsibility for his or her own maintenance work, without the need to employ paid specialists to do such maintenance work.

Characteristic Number 12, Well Defined and Cost Effective Production Alternatives A common fault of many designs in all fields of art is that they have no well defined means of being produced in a cost effective manner. In many instances, it is determined that tooling up to make a particular invention, would be so difficult and expensive, that the level of improvement that the new invention brings, would not demand a sufficient premium in the marketplace to offset the additional expense incurred in introducing it.

No invention can be termed truly useful for which no means exists for producing it in a cost effective way. The ideal compound bow therefore should be one whose component forming and assembly requirements, both result in an end bow product which not only exhibits the ideal characteristics in terms of providing no tradeoffs in any key performance-engineering areas as outlined immediately above in this section, but which also has well defined means of producing each key component, as well as the overall bow, in a simple and cost effective manner.

It will be an objective of this invention to define a suitable means of producing each key component of the bow in a simple and cost-effective manner, while meeting it's functional requirements in an optimum fashion.

DESCRIPTION OF THE PREFERRED EMBODIMENT

The following section describes the preferred embodiment of the invention and one or more alternate embodiments, each of which represents substantial improvements over the prior art. The description of the preferred and other embodiments shown are in accordance with the drawings as referenced in the text. Other embodiments will undoubtedly be suggested to those practiced in the art upon viewing the preferred embodiments. To the extent that such other alternate embodiments are suggested by the description of the preferred embodiments), they are intended to fall within the scope and spirit of, and be covered by, this invention.

Figure 1:
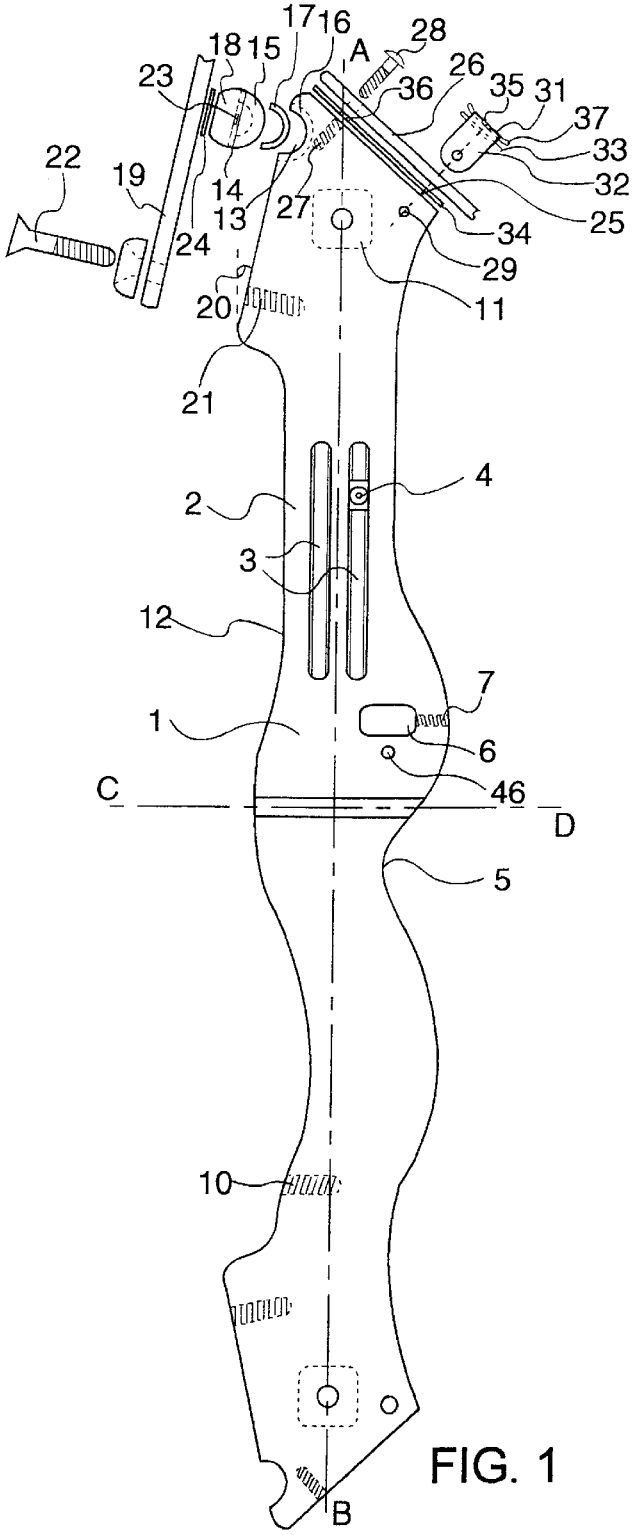
FIG. 1. FIG. #1 provides an exploded view of the bow's riser component, viewed from the side, and shows the manner in which the various elements that coact with the riser are configured in the preferred embodiment.

FIG. 1 illustrates an exploded side elevation of the main body of the riser component of the invention (1), designed for right handed-shooters. The riser of the bow provides the framework for securing in place on it a number of attachments and FIG. 1, illustrates how these attachments are secured in place in an optimum fashion in the inventive compound bow. Risers for left-handed archers would be a mirror image of the riser depicted for right-handed archers. The riser incorporates one or more vertical slots (3) in the sight window section (2), designed to house industry standard hunting sight pins (4), a grip area (5), an accessory mounting slot (6) for mounting of a variety of arrow rests and/or cushion plungers, a set screw (7) for securing in place a male attachment post section (9, FIG. 2) of a component designed to mount projectile guides or arrow rests on the bow, and which can also be used to secure in place an overdraw attachment having a similar male post insert feature incorporated in it, and a tapped hole (10) below the grip area on the front surface of the riser for mounting of a stabilizer rod. Recessed areas (11) are present near each end of the riser, along it's back (side away from the sight-window opening) side, designed to house two-piece (point shroud and arrow shaft holder) bow quiver components in an integral fashion, using large bolts which can be tightly fastened down. The sight pin slots and recessed areas provided for mounting of a bow quiver are located symmetrically along the vertical centerline (AB) of the main body of the riser component.

Since the top and bottom ends of the riser are symmetrically configured, the remaining discussion of the riser will refer only to components affixed to the upper end of the riser, in order to simplify the discussion. The bottom end of the riser is understood to embody similar component configurations to those embodied at the upper end of the risers main body.

The front edge profile of the riser (12) near each end of the riser is angled back (20) a sufficient amount to provide for mounting the limbs at the desired pitch when the bow is assembled. Proximate the end of the angled-back portions along the face of the risers main body are semi-circular relieved areas (13) designed to accept half-round male sections of semi-circular limb alignment components (14) having downward projecting flanges (15) which engage the sides of the riser (16) in a manner that disallows clockwise or counter-clockwise turning of the limb alignment component. The optimal configuration would employ a semi-circular, non-metallic bushing (17) between the male and female surfaces to increase smoothness in adjusting the bow, and to provide a noise-dampening effect when vibration is present, thus contributing to quieter operation of the bow. Each removable limb alignment component provides between its upward projecting flanges (18) sufficient width to provide for accepting the base end section of a flexing limb member (19). The opposite end of the angled section designed to provide initial pitch for the mounting of limbs (20) embodies a drilled and tapped hole (21) for purposes of adjustably securing the base of the limb to the riser component, using industry standard limb adjustment bolts (22). The bolt (22) coacts with the limb-allignment component to triangulate and keep in a constant position, the base section of the limb, and thereby provides non-shifting vertical, horizontal, clockwise, and counter-clockwise positioning of the limbs with respect to the vertical centerline of the bow.

Each limb alignment component incorporates a series of milled or drilled recesses (23) along it's base portion designed to hold in place, when the bow is in an assembled state, a pad of damper material (24) constructed of pliable materials such as felt or rubber, which serves to make the bow shoot more quietly. The recesses formed in the base of each limb alignment component secure the damper material in place when the bow is assembled, using only the pre-loaded pressure from the limbs, pressing against the limb alignment component's base, when the bow is assembled under pressure, making other means for securing it in place unnecessary.

The back side edge-profile of the riser, near each end of the main body of the riser component is again angled back (25) toward the archer sufficiently to provide for mounting the base end of a separate resilient Pulley Return Energy Source (hereinafter referred to as a PRES) component (26) at a prescribed angle with respect to the base of the limb mounted at the same end of the bows riser. Each angled section designed to house the PRES components includes a drilled and tapped hole (27) for purposes of securing the base end of a PRES component with a bolt (28) or locating pin, in a manner that precludes it's moving either back and forth, or side-to-side. At the opposite end of the angled section designed to house the PRES components, a lateral hole (29) is provided for accepting a pin (30, FIG. 2) which works in concert with a PRES holdown component (31), to further secure in place the base section of the PRES component in a manner that allows some pivotal movement of the PRES holddown component around the axis of the securing pin, while the flanges (32) of the PRES holddown components work, in concert with the bolt at the opposite end of the same angled section of the riser, to preclude clockwise or counterclockwise motion of the PRES's once mounted on the main body of the riser component. Axial rotation around the axis of the PRES holddown component is not believed to be essential, but allowing some pivotal movement in this area will reduce the tendency of shear forces to build to high levels along the fulcrums edge.

The PRES components are sandwiched in between thin upper (33) and lower (34) damper pads of a pliable material, such as rubber or felt, located as shown. Each PRES holddown component has a small hole (35) in its top-most area designed to cause the damper material to become lodged in it when the PRES component is under pressure, and the bow is in an assembled state. The damper material therefore stays in place without having to otherwise secure it. The underneath PRES damper pad (34) has a hole (36) in it to accept the securing bolt/pin passing through the PRES to prevent clockwise rotation, and is likewise held in place by pressure when the bow is in an assembled state. The fulcrum-edges of the PRES holddown components (37) would ideally present a convex surface to the limb/damper pads to further reduce the tendency for shearing forces to build up along the edge areas of the PRES holddown components when the system is under stress.

Figure 3:
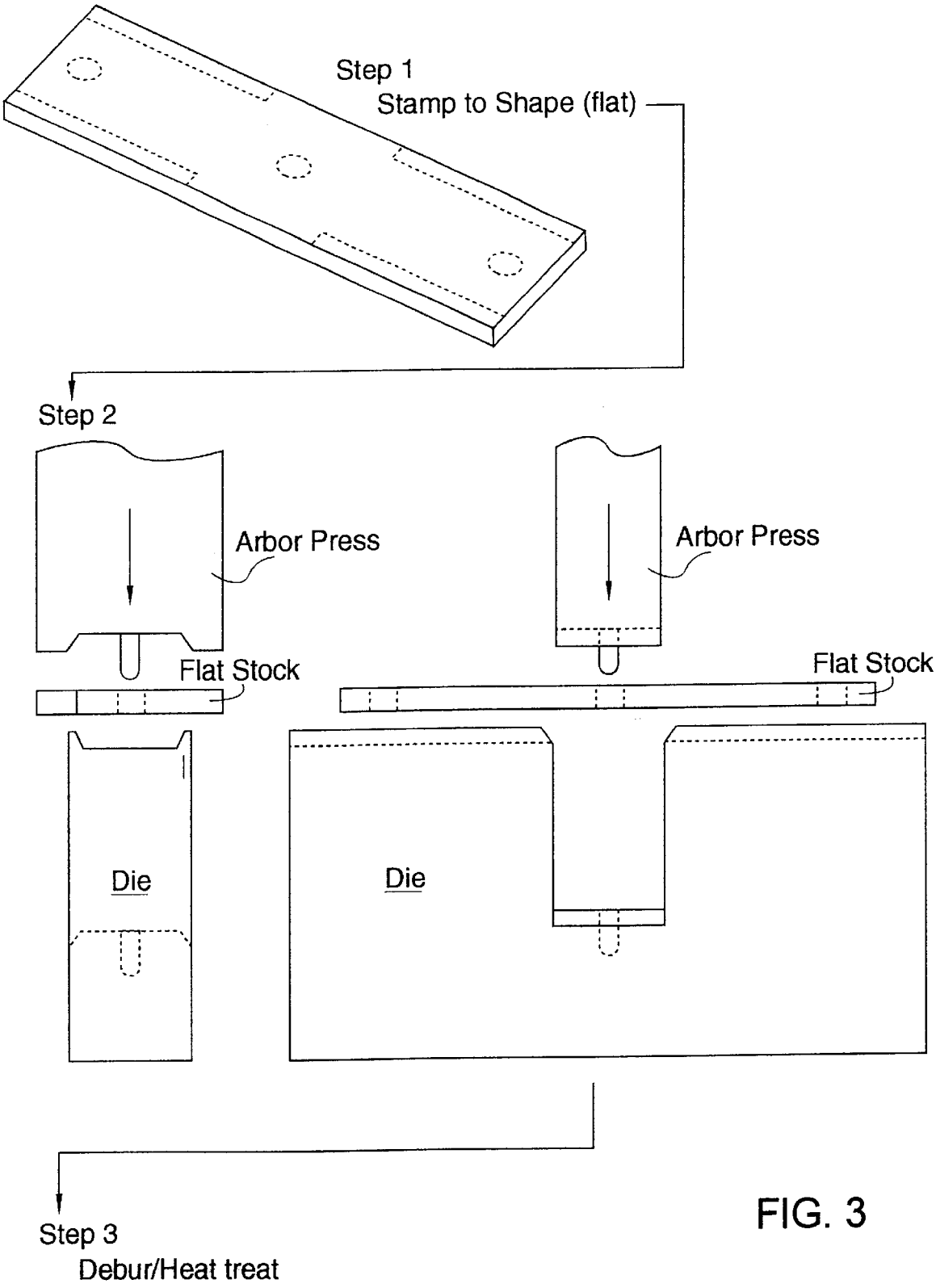
FIG. 3. FIG. #3 shows a simple means of producing the PRES holddown components described in the preferred embodiment.

FIG. 3. illustrates a simple forming process for producing PRES holddown components in accordance with the preferred embodiment. The drawings are self-explanitory.

Figure 2:
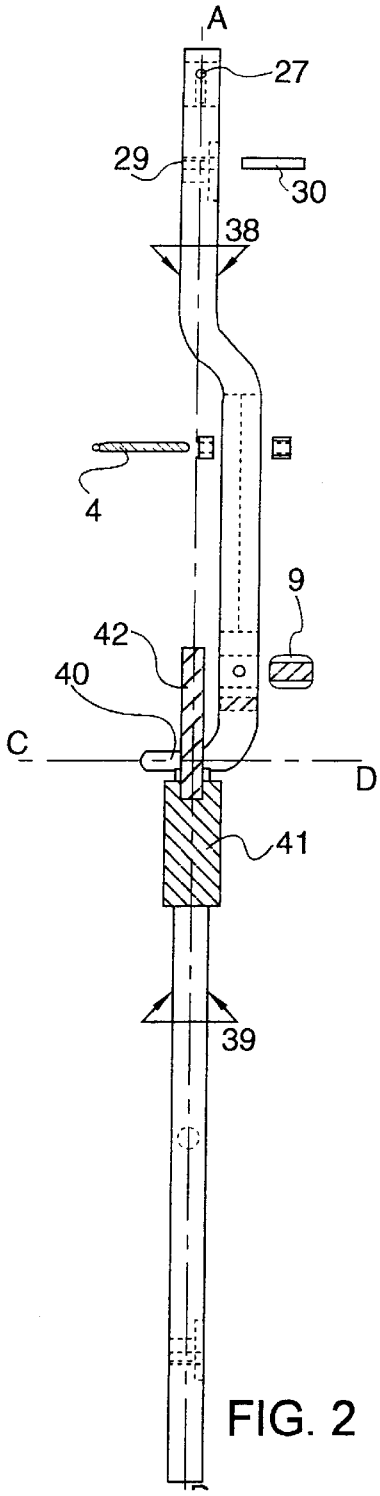
FIG. 2. FIG. #2 shows an elevation from the rear of the main body of the riser component shown in FIG. #1.

FIG. 2 is a rear elevation of the main body of the riser component shown in FIG. 1. This elevation illustrates how the side to side cross sections (38, 39) of the main body of the riser is substantially the same thickness in all areas both above end below the arrow shelf section (40) of the riser. The arrow shelf section (40) of the main body of the riser represents the vertical center of the riser, and the overall bow. This configuration provides equal distances above and below the bows vertical center for the push point on the bow's grip (41), and the pull point on the bow's bowstring (42), with said push and pull pressure areas overlapping somewhat near the exact center of the bow's riser. Placing the push (41) and pull (42) points on the bow on equal distances from, but on opposite sides of, the bows vertical centerline provides equal amounts of pressure on upper and lower bowstring segments, and provides for equal amounts of actuator to be pre-wrapped around each pulley at rest. This feature makes the bow more forgiving of variance in up/down hand pressure by the archer, and much easier to "tiller" or tune as well.

Aligning the aforementioned features thus, along the risers horizontal and vertical centerlines produces superior performance characteristics in the finished bow, and this feature also makes it possible to produce the material blanks for main body sections of the riser component for both right handed and left handed archers from a single forging die and billet. Producing the risers main body section from pre-forged aluminum or magnesium billets allows bow builders to employ materials which are effectively two to three times as strong, per equivalent volume of material, as cast materials of the same genre', and therefore to employ risers which use far less material in their construction, and which are therefore significantly lighter in weight than prior art cast risers.

Figure 4A:
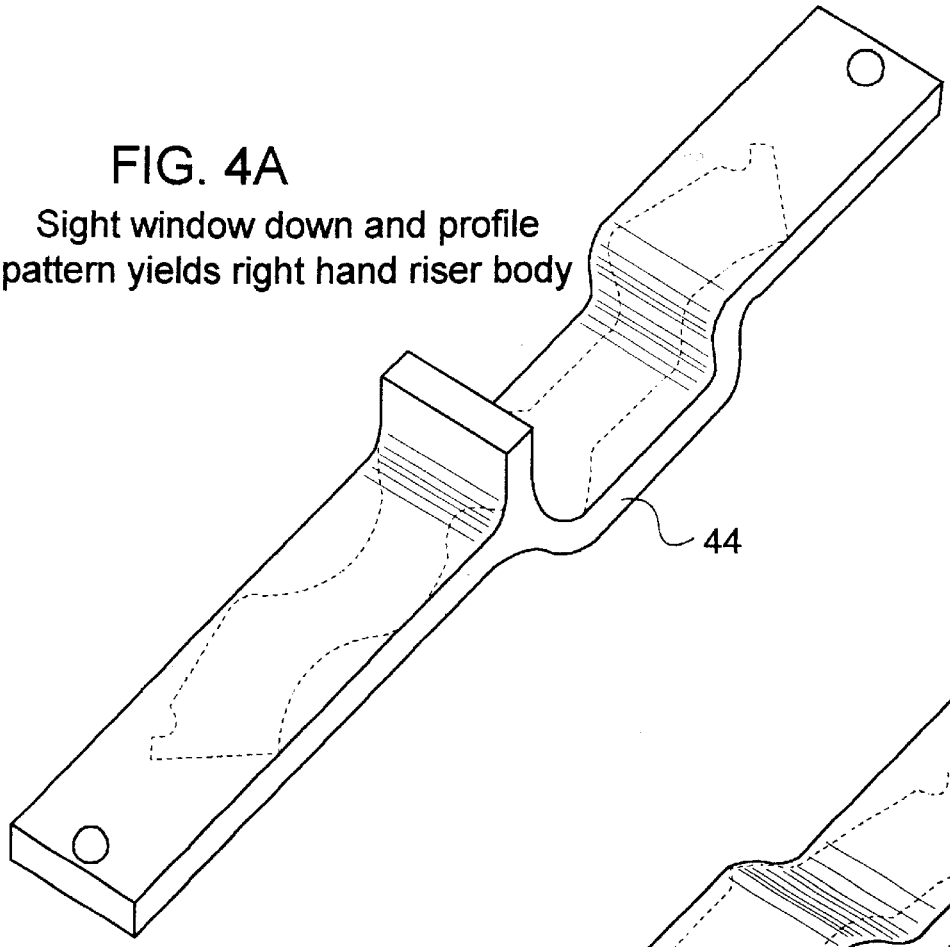
FIGS. 4A–4C illustrate a simple means of profiling the main body section of either right-hand or left-hand risers, from the same pre-forged material billet, as described in the preferred embodiment of the invention.
Figure 4B:
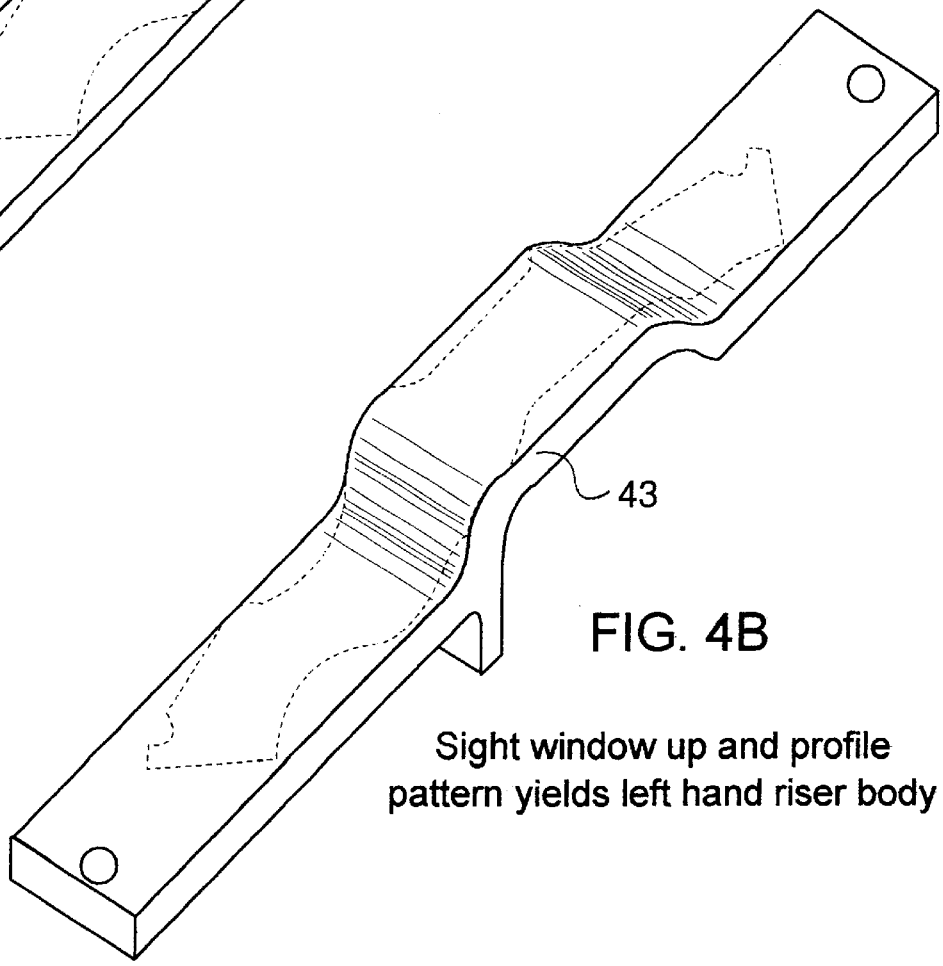
Figure 4C:
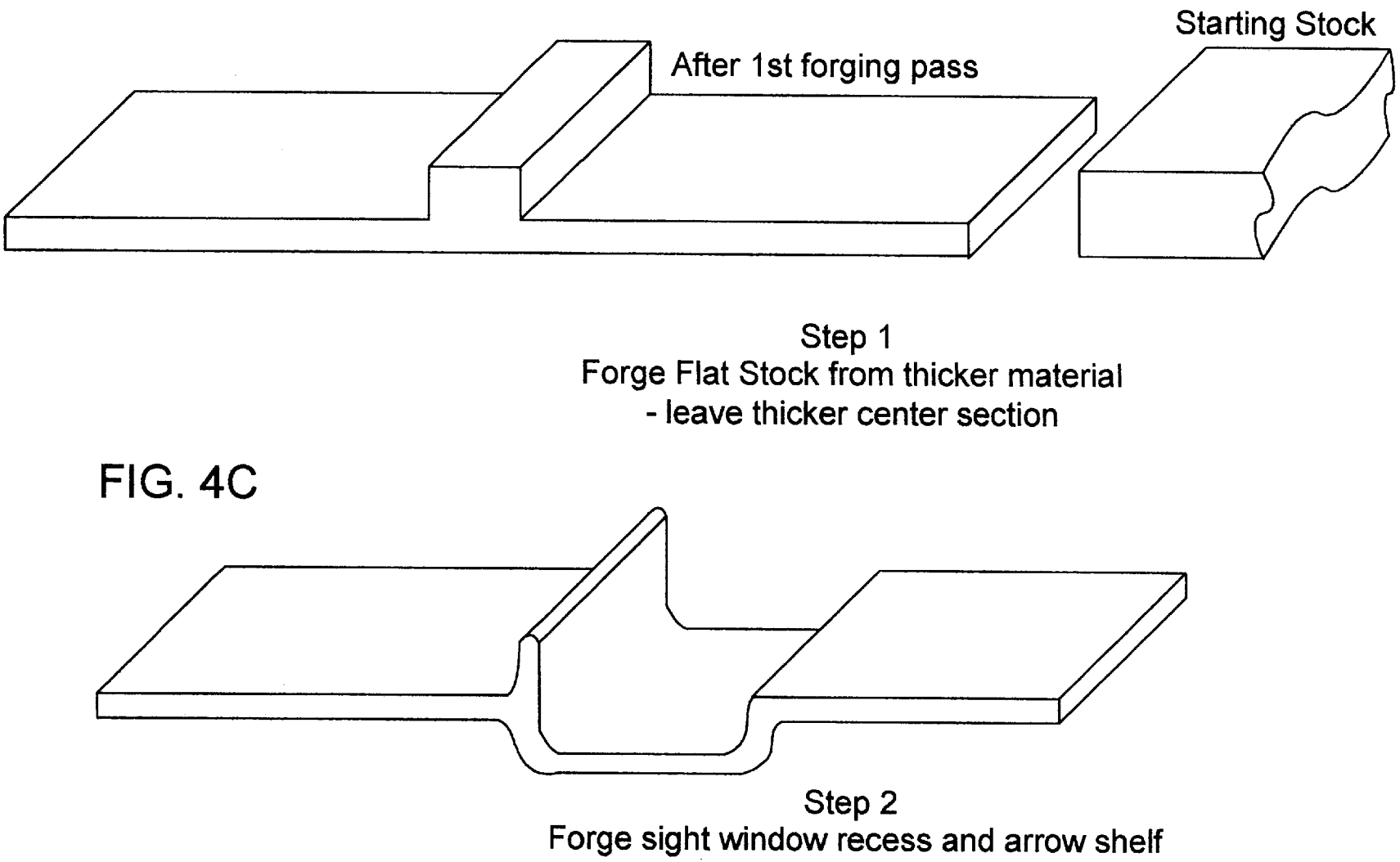

FIG. 4 illustrates how a single profiling tool setup can be used to produce the main riser body of either right handed or left handed risers, by simply flipping the pre-forged billet over [sight window up. (43) or sight window down (44)] to produce the different kind of riser desired. The drawings are otherwise self-explanitory.

Prior art bows have employed forged material risers and risers machined from high strength extruded and redrawn barstock. However, the designs of prior art risers precluded use of a single pre-forged material blank suitable for producing either right or left handed risers. In part, this was due to the fact that all prior art forged and/or machined risers incorporated in their makeup integral limb alignment channels and or other features non-symetrically located with respect to the risers vertical centerline, which precluded the same material blank from being able to produce either a right handed or left handed riser component.

The inventive bow employs as a riser component a three piece configuration that provides the basis for producing right-handed and left-handed risers from two principal component parts; (one) main body section (1, FIG. 1), and (two) identical limb alignment components (14, FIG. 1) which coact in a free-floating manner, being neither fixedly attached to either the primary limb components, or to the main body section of the riser component, without requiring separate axles or any other additional related components and/or means for securing them in position near the ends of the riser component.

The manufacturing process employed for forming of the main body section of the riser allows a single set of forging dies, and a single forging cleanup (profiling) machine tool program to be employed for forming the main body of the riser. The pre-forging of riser main body billets produces much stronger riser components while also allowing components of adequate strength to be produced which are reduced significantly in weight.

The use of a single set of forming tools and cleanup programs reduces toolup costs by half over prior methods of forming riser components. The use of pre-forged billets as starting stock reduces the material required for producing a non-cast riser component by way of machining processes by approximately 75%, thereby significantly reducing both the time and the cost to produce a riser component having superior strength and lightweight characteristics.

The use of the simple separate coacting limb alignment components, which are easily formed using common lathe and milling machine processes and a single tooling setup, coacting with the limb adjustment bolt to triangulate the limb alignment, eliminates the need for full length limb "channels" as part of the riser, and further lightens the overall weight of the bow.

Figure 5:
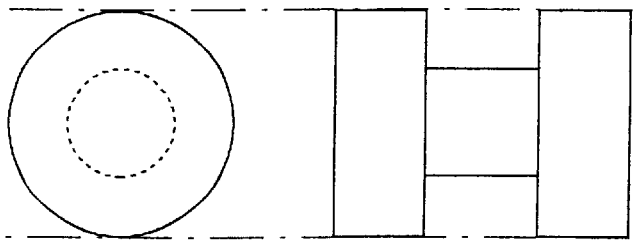
FIG. 5. FIG. #5 illustrates a simple three step method of forming the free-floating limb allignment components described in the preferred embodiment of the invention.
Figure 5:
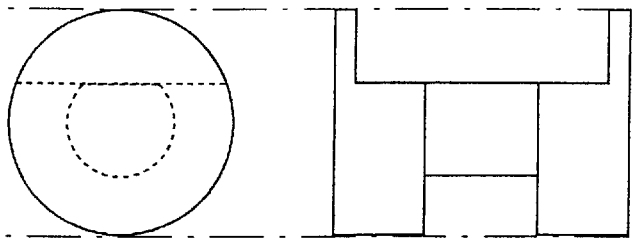
Figure 5:
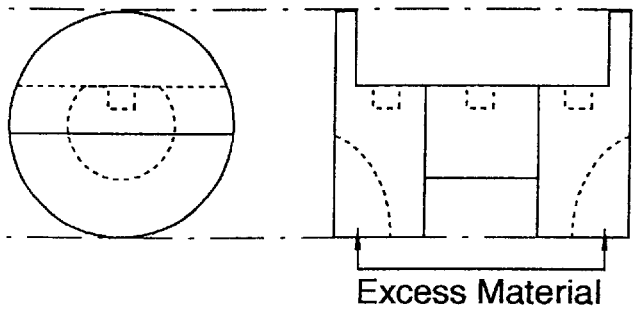

FIG. 5, illustrates a simple three step method for forming limb alignment components from round metal barstock. The integration of sight pin slots, channeled to accept non-round industry standard sight locking nuts, eliminates the need for separate bolted-on sight brackets on the bow riser, eliminates the need for a separate (second) locking nut for use with the sight pins, causes sight pins to be mounted over the archers bow hand, minimizing adverse effects of hand torque on aiming, and reduces side-to-side system torque in the assembled bow.

The use of pre-forged barstock for the main body of the riser allows grips to be made narrower, thereby moderating the effects of any shooter induced tendency to torque the grip area during shooting, since less material is needed to effect sufficient strength in the grip area due to the increased strength of the materials being used. The use of high strength pre-forged materials for the main body of the riser allows all accessory mounting recesses, drilled and tapped holes, and limb bolt holes to be incorporated directly in the main body of the riser, without having to employ other separate component bushings secured in place by adhesives, and thereby enhances durability while reducing labor related costs normally incurred in secondary operations when preparing cast risers to accommodate such functions. The use of a separate accessory slot (6, FIG. 1) in the arrow rest area allows mounting of any and all kinds of arrow rests as well as providing a means of easily adapting an overdraw accessory for use on the riser for those archers choosing to shoot shorter arrows from their bow.

An additional feature provides that the use of a secondary screw hole (46, FIG. 1) may be used to provide a mounting place for an arrow rest guard (not shown) suitable for holding spring-loaded arrow rest "flipper" arms in close to the main body of the sight window, thereby preventing the flipper arms from being bent out of shape when being the bow is being carried through the brush.

Figure 6:
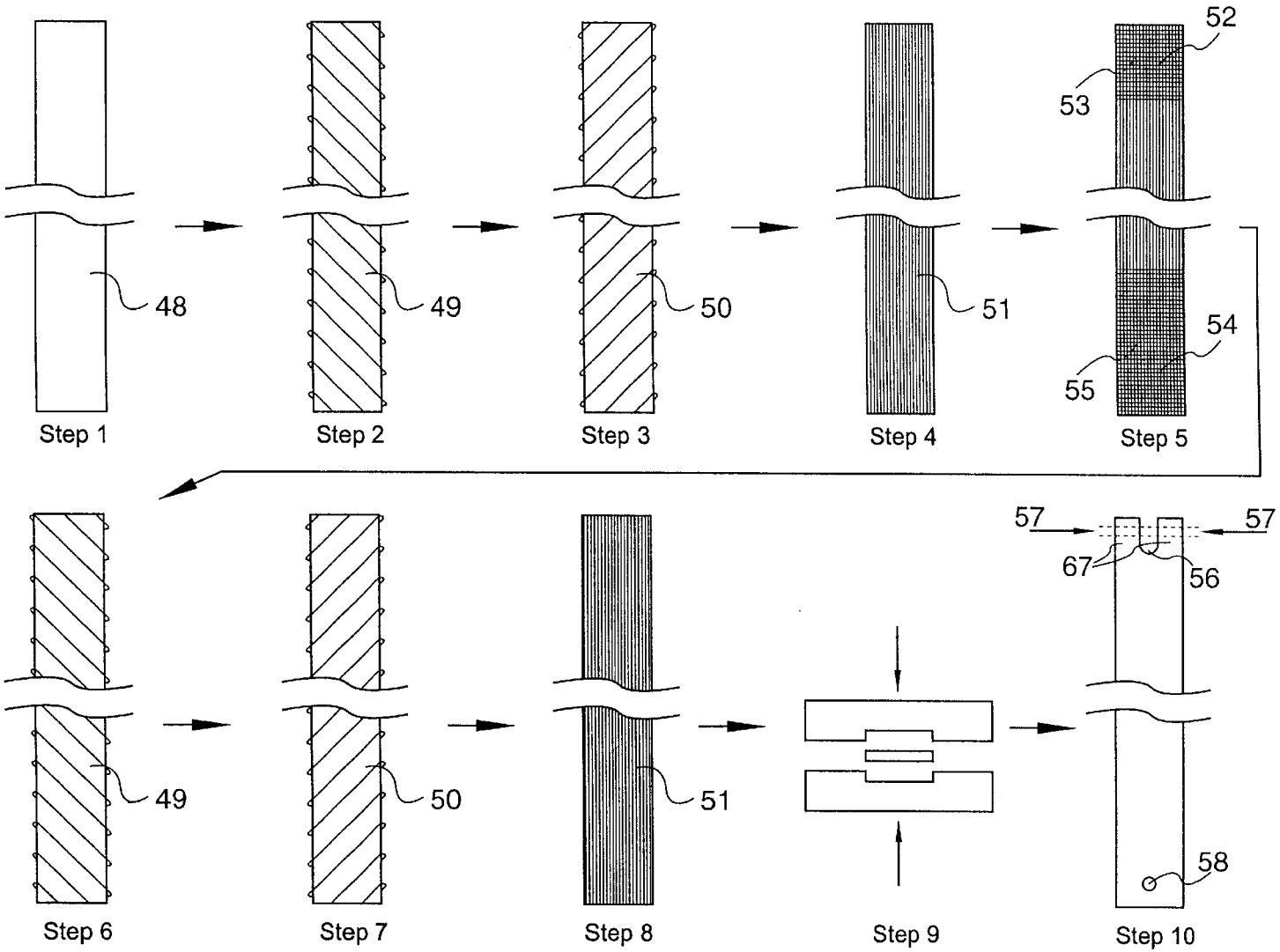
FIG. 6. FIG. #6 illustates a simple manufacturing process for producing the primary bow limbs and PRES components described in the preferred embodiment of the invention.

FIG. 6, illustrates the unique reinforcing fiber orientations employed in the construction of the primary limbs used in the preferred embodiment. Other approaches can be used to construct the primary limbs used on the inventive bow. However, the preferred embodiment illustrates what is felt to be the optimum method of limb construction since it incorporates in an integral and more effective manner a number of desirable characteristics which were either only available via non-integral means, or not available at all, in prior art compound bow limbs. The primary limbs of the invention may be made straight, when not under pressure, or recurved (arcuated in a deflex or reflex manner) when not under pressure. The preferred embodiment incorporates limbs which are straight when not under pressure. Straight limbs allow shorter crotch arms, and provide optimum preloading of energy when the bow is in an assembled, but undrawn state, such preloading conditions serving to further enhance transmission of energy to the arrow near the end of the forward power stroke. Straight limbs are also somewhat easier to produce mold forming tooling for.

Each primary limb employs for its core (48), material which is light in weight but strong when subjected to compressive loads. Maple wood, osage wood, and yew wood, as well as various synthetic materials can be used for this purpose. All fiber reinforced materials other than the center core of the limbs are preferably of the pre-impregnated fiber-reinforced tape type, wherein the adhesive pre-impregnated in the tapes is very strong, but somewhat pliable. Typically, the adhesive will be of the epoxy type, and one which cures via application of heat and pressure.

Pre-impregnated fiber-reinforced tape materials generally produce more consistent and uniform results during forming, than do materials "wet out" by hand with adhesive resin in the usual manner. Resin content, which has a direct bearing on limb response uniformity, is therefore generally enhanced through use of pre-impregnated fiber tapes, when compared to variances in resin content which often occur during typical pultrusion processes employed for forming the fiber reinforced materials used in prior art compound bow limbs.

The inventive limb construction method used for the limbs in the preferred embodiment, contain, as shown in FIG. 6, multiple wrappings (49, 50) of high strength but lightweight fiber material such as high modulus graphite or aramids like Kevlar, wrapped completely around the core in a helical fashion (49, 50) at approximately plus and minus 45 degrees to the lengthwise axis of each limb. The plus and minus 45 degree helical wrappings act in the finished limb to counteract any torque present, whatever the source, and act to suppress shearing in the crotch area of the limbs, and further act to quickly damp any shock and vibration the limb might be subjected to. The added integral shear-force resistance built into the limbs, makes added-on mechanical locks near the bottom of the limb crotches unnecessary, and serves to further reduce the overall limb mass that has to be accelerated forward upon release. High strength but lightweight materials such as fiberglass, high modulus graphite and/or boron which have both high tensile strength and high compressive strength, are used in the lengthwise direction (51) to provide resilient strength in the warp direction for arrow propulsion.

Any of these materials except boron may be wrapped lengthwise completely around the core, thus surrounding the entire core in an envelope fashion, and providing continuous reinforcing fiber filaments having uninterrupted strength in the most stress prone areas. In the event boron is chosen as a warp strength material it will need to be interleaved between other materials, in layers, such as being mixed with fiberglass or graphite tapes, due to it's extremely stiff and abrasive nature.

Near each end of the limb a pre-impregnated woven material (52,53,54,55) consisting of high stiffness fibers also having high compressive strength, running in the lengthwise (warp) direction, and high tensile/shear strength fibers running in the sideways (weft) direction is hand laid up and temporarily "tacked" in place, prior to being overlaid by more warp and/or helical wrappings. These fiber reinforced materials provide added strength in an integral manner near the each end of the limb where materials will be removed to accommodate pulley crotches and limb bolts.

The lengths of added reinforcements (52,53,54,55) incorporated at each limb end is determined by the bow builder to provide as long or short of a length of maximum bending in the center of the limb segment as desired for deflection purposes. The longer the non-additionally reinforced segment, the greater will be limb deflection with a given overall limb length and pulley size.

Once all fiber reinforced materials have been overwrapped around the core material, the limb is placed under mechanically induced pressure in an open sided mold, similar to that used for making laminated prior art limbs of wood and fiberglass in a sandwich manner, and cured, according to adhesive requirements, in an oven.

Alternatively, the limbs might be placed in an autoclave and use vacuum as a compression force during curing. When curing is completed, crotches (56), axle holes (57), and limb bolt holes (58) are incorporated using the same means for doing so as in prior art limb building methods.

Once cured, the limb members have fixed permanently in place in a homogeneous fashion, fiber reinforcements running in continuous fashion in four different directions, all strategically placed to provide: 1) adequate stiffness in the lengthwise (warp) direction for energy storage to later be used for cast, 2) side-to-side, and plus and minus 45 degree torsional resistance, and torsional stability in the limbs, 3), elimination of lengthwise shear force cracks, 4) damping of vibrations that occur when the bow is shot, and 5), which further make unnecessary and redundant any separate added-on mechanical locks near the bottom of the crotches in the limbs. The continuously overwrapped, helically placed fiber reinforcements further act to contain the warp fibers, in the event the limb is overstressed to the point where the warp fibers were to crack, or otherwise give way suddenly, thereby improving safety for the archer.

PRES components (Pulley Return Energy Source members) will optimally be constructed in a similar fashion to that used in building the bows primary limbs, whether or not the bow designer elects to use flexing PRES members. The preferred construction method for the PRES members assures that bending stresses affecting the PRES members will not easily give way to either shearing or staying permanently bent (take a "set") if subjected to extraordinary loads, above those typically encountered in a bow of a given draw-length and draw-weight.

After curing, material will be removed from the PRES members to provide the securing bolt hole near the base, and string or cable notches that may be used to secure the ends of the end-loops on the tensioning actuator segments in place when the bow is assembled. This type of construction for the PRES members when designed to be a non-integral element of the riser or primary limb, assures that regardless of the amount of stiffness engineered into them, they will be both very light in weight and resilient in nature, and less subject to failure from shearing along their fulcrum edges, than would be the case if constructed by other means.

The lengths (and widths) of the PRES components is a function of how much flexure the builder wishes to build into them, and how far back the bow designer wishes to have the primary limb tips move during operation of the bow. It is not possible to anticipate all combinations of PRES lengths, primary limb lengths, and pulley size configurations which might ensue following the teachings of the invention. The high number of overall configuration possibilities is a general advantage of the invention. PRES lengths will normally be in the range of one-third to one-fourth of the length of the primary limb components employed, though other options certainly exist, including directly connecting the end of the tensioning actuator to the back-side of the riser itself.

Rigid PRES components may also be employed in the invention, but are not employed in the preferred embodiment. Rigid PRES components mandate larger circumference, and therefore heavier, pulleys for a given draw length of bow, than will be required when flexible PRES components are employed. Primary limb motion is also less efficient by some measure when non-flexing PRES components are used, since primary limbs in configurations with rigid PRES elements would be subject to a higher degree of the "buckling beam" effect described earlier. Additionally, designs with rigid PRES components mandate relatively smaller secondary pulley side circumferences, which in configurations using coated steel cables for actuators, might cause the radius over which the cables had to be rolled and unrolled, to cause higher levels of cable fatigue in bows with very short draw lengths. For these reasons, the preferred embodiment employs flexible PRES components.

Figure 7A:
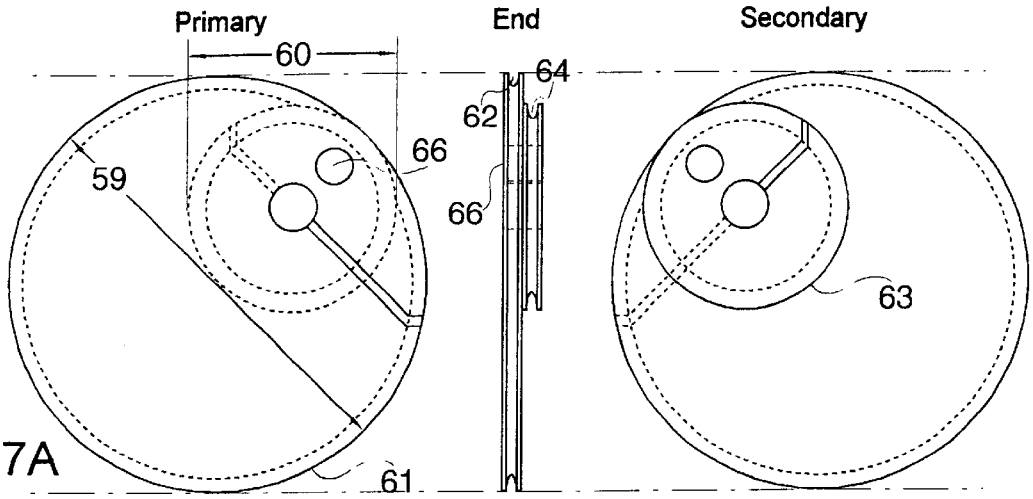
FIGS. 7*a,* 7*b,* 7*c,* and 7*d* illustrate side and end views of three different types of interchangable, dual-planar pulleys referred to in the description of the preferred embodiment of the invention, and show how each effects a different energy storage pattern deemed useful and desireable by archers, while allowing bows of all desireable draw-lengths to be produced.

FIGS. 7*a,* 7*b,* and 7*c,* illustrate three different types of interchangeable, twin-grooved, dual-planar pulleys designed for use in the inventive bow. All circumferences shown in the pulleys illustrated in FIG. 7, are round, although non-round circumferences could also be employed. Round circumferences are felt to be the preferred embodiment due to the fact that bows using pulleys having all round pulley grooves are easier to tune and are more forgiving of variances in hand position on the bow by the archer, as well as presenting a smoother "feel" to the archer when drawing the bow.

Figure 7B:
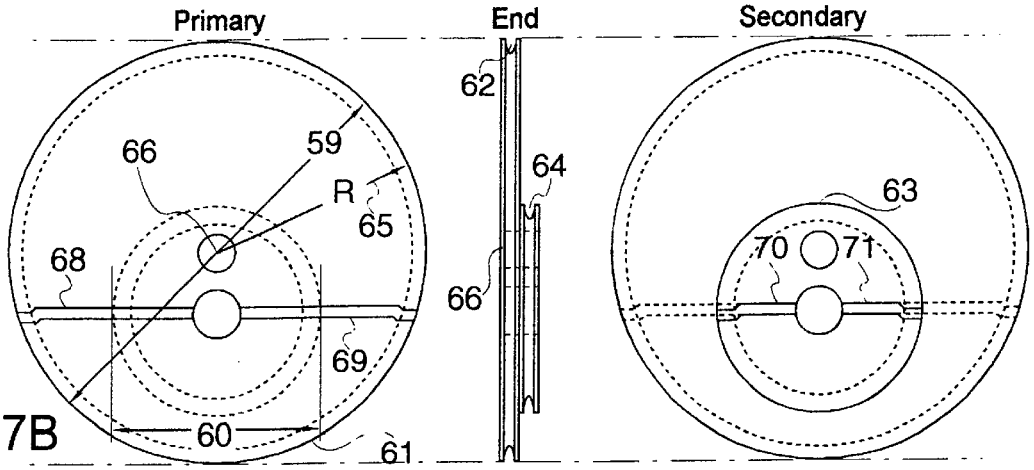
FIG. 7.
Figure 7C:
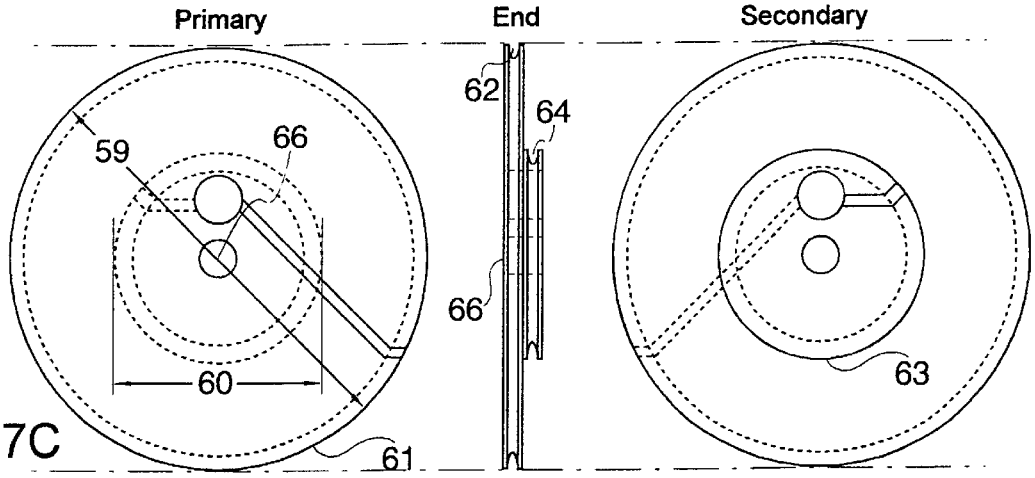

FIG. 7*a* represents an eccentric-eccentric pulley designed to provide the greatest possible reduction in draw force required by the archer to hold the bow in a fully drawn state. FIG. 7*b* represents a concentric-eccentric pulley designed to provide a medium degree of reduction in force needed to hold the bow in a fully drawn condition by the archer. FIG. 7*c* illustrates a concentric-concentric pulley designed to provide no reduction in the force needed by the archer to draw the bow back, at any point in the draw.

FIG. 7*d,* illustrates the variety of leverage inducing patterns possible for each pulley type shown. The leverage inducing patterns result in a wide variety of energy storing patterns when employed in the type of asynchronous bows defined by the invention. In each case in FIG. 7*d,* the "P" distances represent the length of the primary lever arm activated by pulling on the bowstring, which is attached to the groove associated with the outside circumference of the primary side of the pulley. The "S" distances represent the length of the secondary lever arm related to the outside circumference of the secondary side of the pulley, whose protruding actuator segment is tied off at the end of a PRES member at the same end of the bow.

In each instance in FIG. 7*d,* for purposes of this discussion, the diameter of the primary pulley side (59) has been set to be large enough to provide approximately 6–7" of actuator to be wrapped around it when at rest, while the diameter of the secondary side of the pulley (60) has been set to be large enough provide the capability to take up from 1.8" to 2.1 " of cable around it as the bow is drawn. This configuration would meet the needs of the most utilized draw length of bows, assuming the proper matching of PRES members and primary limbs were to be also employed.

The three types of pulleys illustrated in FIGS. 7*a,* 7*b,* and 7*c,* can all be constructed suitably scaled to a variety of other sizes, thereby allowing them to also fit archers of all other draw lengths, in bows of this invention, while at the same time, providing low fistmeles and allowing power stroke distances to be as long as the bow designer chooses to use.

In each case shown in FIGS. 7*a,* 7*b,* and 7*c,* the pulleys incorporate a first or primary side (61) whose outside circumference incorporates an actuator groove (62) around it, designed to house an actuator section which leads to the bowstring. The opposite (secondary) side of the pulley in each instance is significantly (usually one-fourth to one-third in size) reduced in it's circumference (63) with respect to the primary pulley side, and likewise incorporates an actuator housing groove (64) around it's entire outside circumference. The actuator emanating from the secondary side of the pulleys ultimately is anchored near the end of the PRES member mounted at the same end of the bow's riser.

The relationship between circumferences of the two sides of each pulley is determined by the lengths of primary limbs and PRES's used in building the bow, and is further subject to variances in these members relating to the stiffness of each. For this reason, it is not possible to specify all possibilities which exist in designing these parts to work together.

However, it will generally be the case that the relationship between the circumferences built into each pulleys primary and secondary sides will be in proportion to the length and stiffness of the primary limb and PRES member that each coacts with to effect energy storage in the system, without overstressing the resilient members in the process.

A key fact as regards the pulleys used in the invention is the use of two-sided, twin-grooved, (dual planar) coacting pulleys. Use of twin-planar coacting pulleys allows the primary side of the pulley to be sufficiently large in circumference so as to unroll enough actuator length to accommodate the draw lengths of all archers, while the secondary side, being much smaller in circumference, varies in terms of the "rate" at which the tensioning actuator section of cable is taken up or let out, and can therefore still be configured, in a bow having asynchronous operation, in a manner which does not take up so much cable during drawing of the bow so as to overstress the bending members, while, as can be seen by the three types of pulleys illustrated in FIGS. 7*a,* 7*b,* and 7*c,* still incorporating the widest possible range of energy storing patterns needed to meet the needs of all archers.

It is therfore the case, that use of dual-planar pulleys as shown in FIG. 7, when combined with the other elements of the invention, as described herein, results in completely resolving all of the performance-engineering conflicts unique to prior-art asynchronous compound bows, which were never all successfully resolved in prior art inventions.

The inventive pulley shown in FIG. 7*b,* designed specifically for use in bows following the teachings of the invention, is unique in that while other inventions have used compound pulleys having one side concentric with respect to the axle hole, and the other coacting side eccentrically mounted with respect to the axle hole; no such pulley, either incorporating similar proportions or different proportions between its opposing sides, has ever been employed in a similar manner for purposes of accomplishing a similar combination of functions on any compound bow. Prior art bisynchronous designs sometimes used concentric-eccentric pulleys with the concentric side used to effect synchronization between top and bottom limbs, while the eccentrically mounted side presented varying primary lever lengths to another (third) coacting eccentrically mounted pulley altogether.

In the inventive bow, the radius distance (65) representing the distance from the axle hole to the point where the actuator related to the primary pulley groove exits that groove, in the pulley shown in FIG. 7*b,* represents a constant length primary lever inducing arm on the pulley, whereas the variable distance from the axle hole to the point where the actuator exits the secondary side's pulley groove during operation of the system, which represents the secondary, or opposing, lever arm distance in the system, causes the overall leverage induced into the system to vary proportionally to the differences between the lengths of the primary and secondary lever arms, thereby providing a "medium letoff" energy storing pattern, which is virtually identical to that found in the majority of bisynchronous pulley systems, but which has benefits not available in bisynchronous pulley systems.

The inventive concentric-eccentric pulley illustrated in FIG. 7*b,* is unique in that is the only pulley used in compound bows of any kind wherein the primary lever arm is of constant length, and the secondary lever arm varies in length depending on the degree of eccentricity of that side of the pulley with respect to the axle hole. The "medium-to high" degrees of letoff available to bows using the inventive concentric-eccentric pulley of the invention is ideally suited to requirements of hunting archers, who comprise over 90% of archers worldwide, and also allows further desirable features to be incorporated into asynchronous bows using pulleys of this type.

The central positioning of the axle hole (66) with respect to the primary side of the pulley shown in FIG. 7*b,* provides that crotches in limb ends to accommodate rotation of the pulley, can be shortened in length by almost half when compared to crotches used in prior art bisynchronous bows of equal draw length, when using equal length limbs, and having equal fistmele, and which incorporate pulleys mounted at the ends of the limbs. Shortening the crotch arms (67, FIG. 6) by that amount greatly increases their stiffness and reduces the variance in bending moments between the limbs in the area of the crotch arms, and the area of the central section of the limb near the bottom of the crotch cutout, thereby further reducing the tendency of limbs to experience lengthwise shear cracks beginning near the bottom of the crotch.

Shortening and thereby stiffening the crotch arms provides additional stability at the ends of the limbs, in the area of the crotch arms, and the added limb stability translates into more stable arrow flight as well, thereby enhancing accuracy and penetration at the target, both of which are directly affected by arrow flight stability.

The reduced circumferential distance associated with the secondary side of the pulleys used in the invention, represents a shorter length of frictional contact between the actuator and the pulley grooves designed to house the actuator segment, and the reduced amount of stored energy lost to friction serves to proportionally increase the amount of stored energy available for transmittal to the arrow upon release.

As was seen during the review of prior art asynchronous approaches, the secondary side of the pulleys used in asynchronous bows must be proportionally smaller than the secondary side of pulleys used in bisynchronous bows, in order to not overstress flexing members, while providing adequately long draw lengths in the finished bow. The inventive pulleys as shown in FIG. 7 resolve these conflicts which plagued prior asynchronous compound bow inventions. Additionally, the reduced size of the secondary side of the pulleys in the instant asynchronous invention produces another benefit in that the overall amount of material of a given type needed to construct pulleys for the inventive bow is less than was required for prior art energy compounding systems of any kind.

Figure 8:
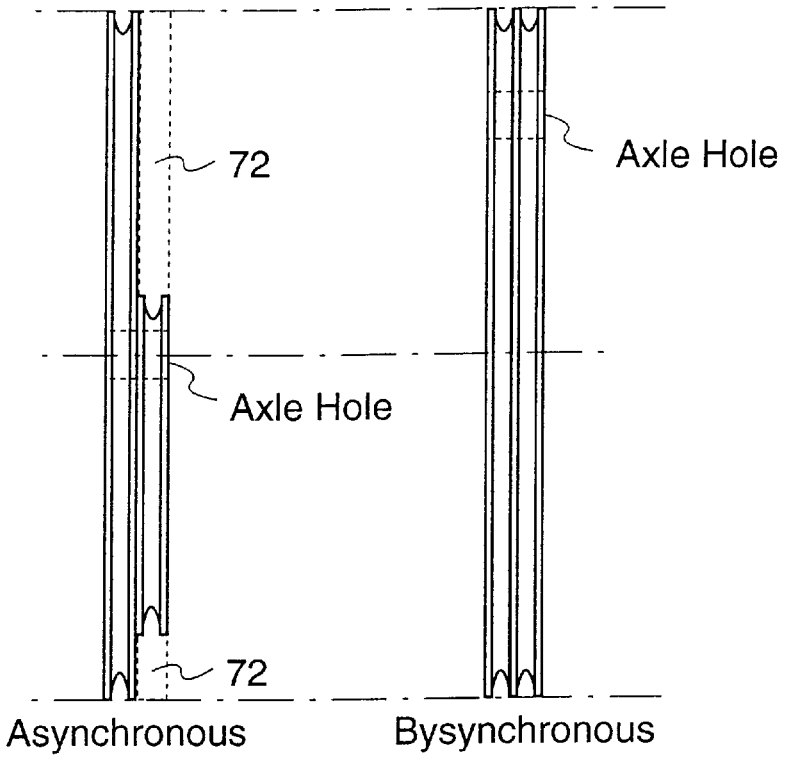
FIG. 8. FIG. #8 illustrates an end view of the pulley shown in FIG. 7*b,* and compares it to an end view of a prior art pulley designed to effect similar limb deflection in a bisynchronous compound bow, showing the reductions in mass possible by employing the pulleys described in the body of the patent application.

FIG. 8, which is a rear elevation of the pulley shown in FIG. 7*b,* illustrates the type of material reductions (72) that will typically be associated with pulleys of a type shown in FIG. 7*a,* 7*b,* or 7*c,* when compared to prior art pulleys designed to effect similar draw lengths and limb deflection in a given bisynchronous compound bow. The reduced amount of material associated with the pulleys secondary circumference translates into lowered swing weights, and again, results in reducing the amount of stored energy required to effect movement of the pulleys on the bow, thereby again increasing the amount of stored energy that can be made available for arrow acceleration. Lightened swing weights also reduce damage to the bows moving parts, and reduce shock to the archers bowhand when the bow is shot.

The pulley shown in FIG. 7*b* is further shown to have cable positioning slots (68,69,70,71) incorporated in it's sides which are symmetrical in nature with respect to the axle hole, on either side of the axle hole. This feature provides that a single pulley may be used for either the top or bottom limb of the bow in bows configured for either right-handed or left-handed archers. The symmetrical nature of the pulleys provides for lowered tool-up costs, whether pulleys are machined or molded, and result in the lowest possible inventory carrying costs for bow builders using the inventive pulleys as shown in FIG. 7*b.*

Figure 9:
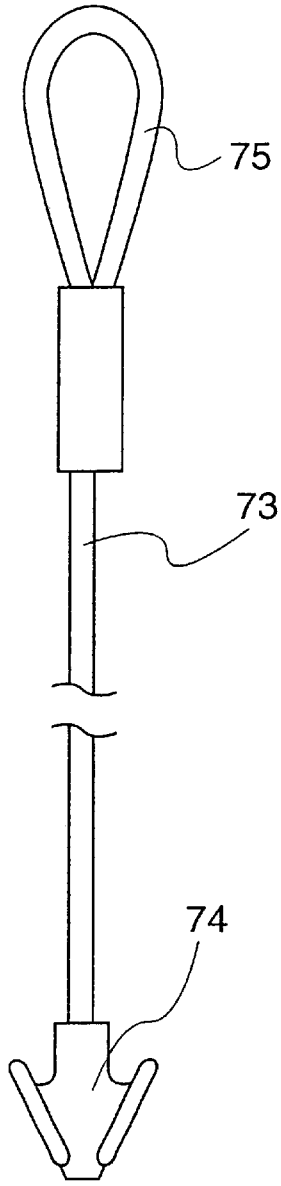
FIG. 9. FIG. #9 illustrates the composition and termination means of a tensioning actuator as described in the preferred embodiment of the invention.

FIG. 9 illustrates a single tensioning actuator segment configured for use in the preferred embodiment of the invention. In the preferred embodiment, the non-bowstring tensioning segments of the actuator system (73), are specified to be 1/16" steel cables, over-coated with nylon, and having a molded on or swaged on bowstring retaining fitting (74) at one and, and a swaged loop (75) at the opposite end, suitable for engaging the retaining notches situated proximate the end of each PRES member.

Use of coated steel cables is not mandated by the invention, only suggested as the preferred embodiment, since steel cables, coated with nylon, provide the greatest possible amount of adjustability in terms of easily preconfiguring, and/or thereafter adjusting, the amount of actuator length to be pre-rolled around each pulley's primary-side circumference when the bow is an assembled, but at-rest condition. This flexibility translates into complete latitude in terms of allowing adjusting the rate of rollover between opposing pulleys mounted at opposite ends of the bow, for archers of different shooting styles (i.e., those who use fingers, those who use release aids, those who try "string walking") and so on, since each of these shooting styles results in a somewhat different elevation of the primary pulling pressure being applied to the bowstring, and therefore affects the amount of actuator that needs to be pre-wrapped around the primary side of the pulley at each end of the bow.

Figure 10:
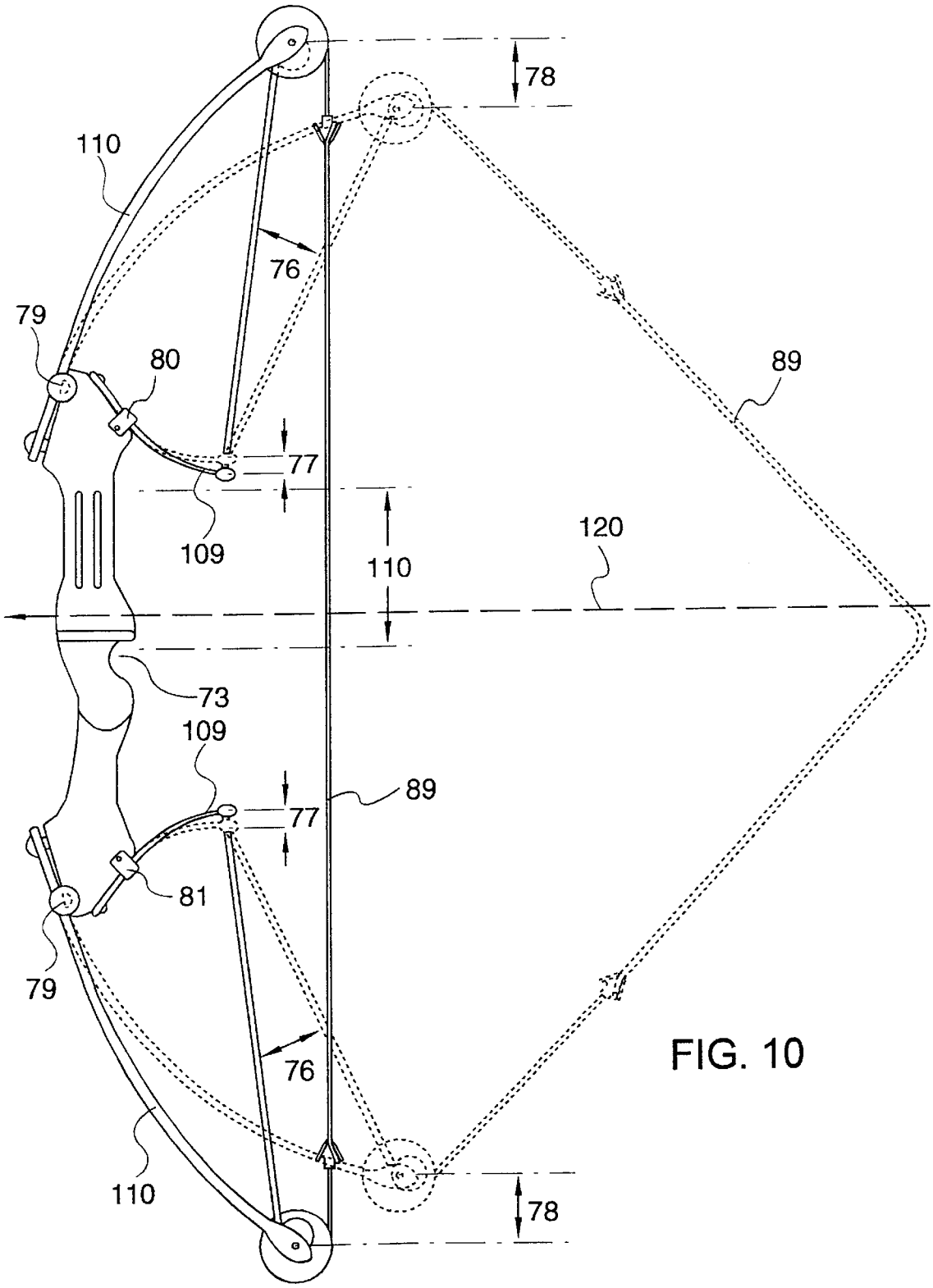
FIG. 10. FIG. #10 illustrates a side view of an asynchronous compound bow in accordance with the preferred embodiment. The movement of the primary limbs and PRES components is illustrated, and the pivotal motion of the tensioning actuators during operation of the bow is illustrated. This figure also depicts the relative angles at which the primary limbs and PRES components of the invention address each other, and the angles at which they address the vertical centerline of the riser component that they are mounted on in the preferred embodiment.

FIG. 10 illustrates a side elevation of the inventive bow, in an assembled condition, in accordance with the preferred embodiment, as it would appear in both a relaxed state and a fully drawn state.

As can be seen in FIG. 10, the inventive bow functions in an asynchronous manner. That is; the pulley, limb, PRES, and actuator segments at each end of the bow coact only with themselves in terms of storing and releasing energy into the system, and do not affect, nor are they affected directly by, the actions of similar components mounted at the other end of the bow.

The inventive bow therefore has no actuator segments that extend to a point where they might conflict with arrow fletching as the arrow leaves the bow.

Thus all of the performance engineering conflicts and difficulties associated with cable crossover in prior art bisynchronous compound bow systems are resolved by inventive configuration, and these conflicts are resolved in a manner that requires fewer components in the bows makeup, thereby making it easier to understand the operation of, and for the owner to perform periodic maintenance and repairs.

Specifically, the inventive bow eliminates the need for cable guard components, hanging load-balancing "yolks" from the axles at the limb ends, cable rollers, cable separators, or cable silencers. Elimination of such elements in the bows makeup additionally serves to reduce friction between moving parts, and reduces the overall weight of the assembled bow, thereby contributing to enhanced performance, and improved shooter comfort, while further simplifying maintenance for the owner.

At the same time, as shown in FIG. 10, the employment of twin-grooved, dual-planar, co-acting pulleys as illustrated in FIG. 7, in conjunction with the other asynchronous components previously defined by the preferred embodiment, and as configured in the inventive bow, resolves all of the conflicts and difficulties associated with prior art asynchronous compound bow inventions when attempting to balance out: 1), a need for efficient and desirable energy storing patterns, 2), a concurrent need for efficient limb tip motion for transferring energy stored in the limbs to the arrow for acceleration purposes, 3), a concurrent need for producing bows for all draw lengths of archers, 4), a concurrent need to employ limbs constructed of stiff, strong, and resilient materials, so as to provide rapid arrow acceleration, and 5), a concurrent need to provide suitably long power (acceleration) stroke distances in the bow, which types of conflicts were never all satisfactorily resolved in prior art asynchronous compound bow inventions.

The use of resilient and flexible PRES members (109) in the preferred embodiment of the inventive bow, provides that the primary limb tips can move further back, as well as being compressed inward toward the center of the bow, and toward one another, as the bow is drawn back by the archer. The reversal of this type of limb tip motion provides fully effective energy releasing motion to the limb tips when the fully drawn bow is released.

The inventive bow utilizes tensioning cable segments which are much shorter and lighter in weight than the same elements found on prior art bows, and the reduced swing weight of the tensioning actuator segments serves to allow more stored, energy to be deployed for arrow acceleration purposes. The tensioning cable segments of the invention also describe a different motion when the bow is being operated from prior art bows. The movement of the tensioning cables describe a modified pivotal arc (76, FIG. 10) during operation of the bow, rather than being carried, in their entirety, back and forth the same distance that the limb tips travel. This motion is substantially different from, and more efficient than, the tensioning actuator motion described by prior art bows in operation. The effect of the modified pivotal-arc motion described by the tensioning cable segments is to further effectively reduce the remaining accelerated weight of the tensioning actuator segments of a given material type, by about one-half, when compared to prior art bows, especially those prior art bows having bisynchronous operation.

The overall effect of combining the shortening, by approximately two-thirds, of the actuator segments themselves, and concurrent introduction of a more effective pivotal arc motion to them during operation of the bow, is that the effective accelerated weight of actuator segments, constructed of a given material type, will generally be between 60% and 80% less in bows of the invention, when compared to prior art bisynchronous pulley-actuator systems having pulleys mounted at the outside ends of the bow's limbs, when such bisynchronous actuator systems are constructed of like materials.

The PRES members (109), when designed to be flexing members, flex a relatively shorter distance (77) than the distance flexed (78) by the primary limbs (110) of the invention. The shorter distance moved by the PRES's results in their returning to an at-rest position very quickly when the fully drawn bow is released. The PRES's likewise have relatively little mass to be moved, when compared to the primary limbs, and this fact adds to their ability to quickly return to an at-rest position upon release. The quicker return to an at rest position by the PRES members holds the potential, depending upon the degree of stiffness engineered into them, for additionally accelerating the rotational rate of return of the pulley to which they are attached, thereby increasing string (and arrow) velocity by some margin over prior art approaches.

Figure 13:
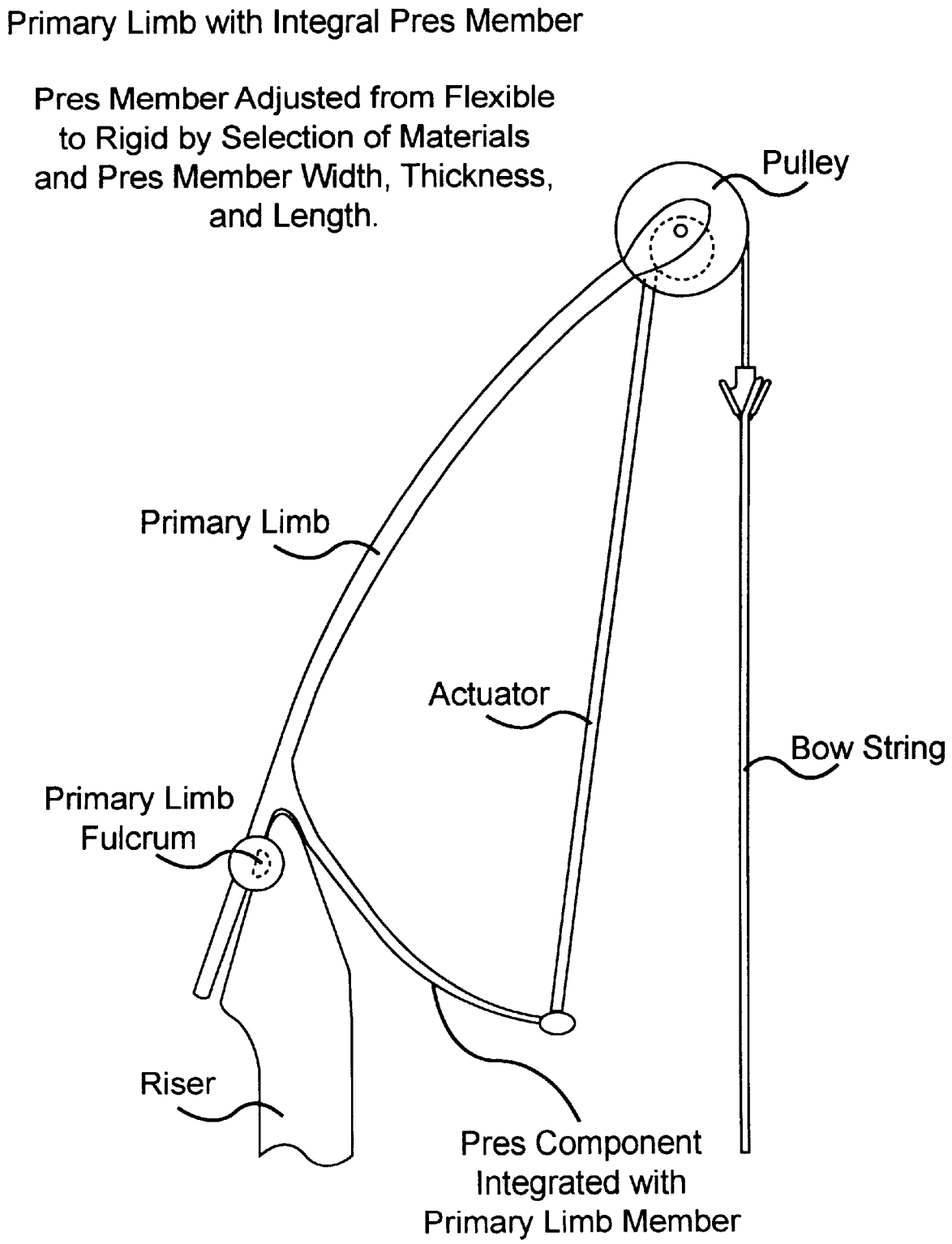
FIG. 13 and FIG. 14 show alternate embodiments of PRES member employment.
Figure 14:
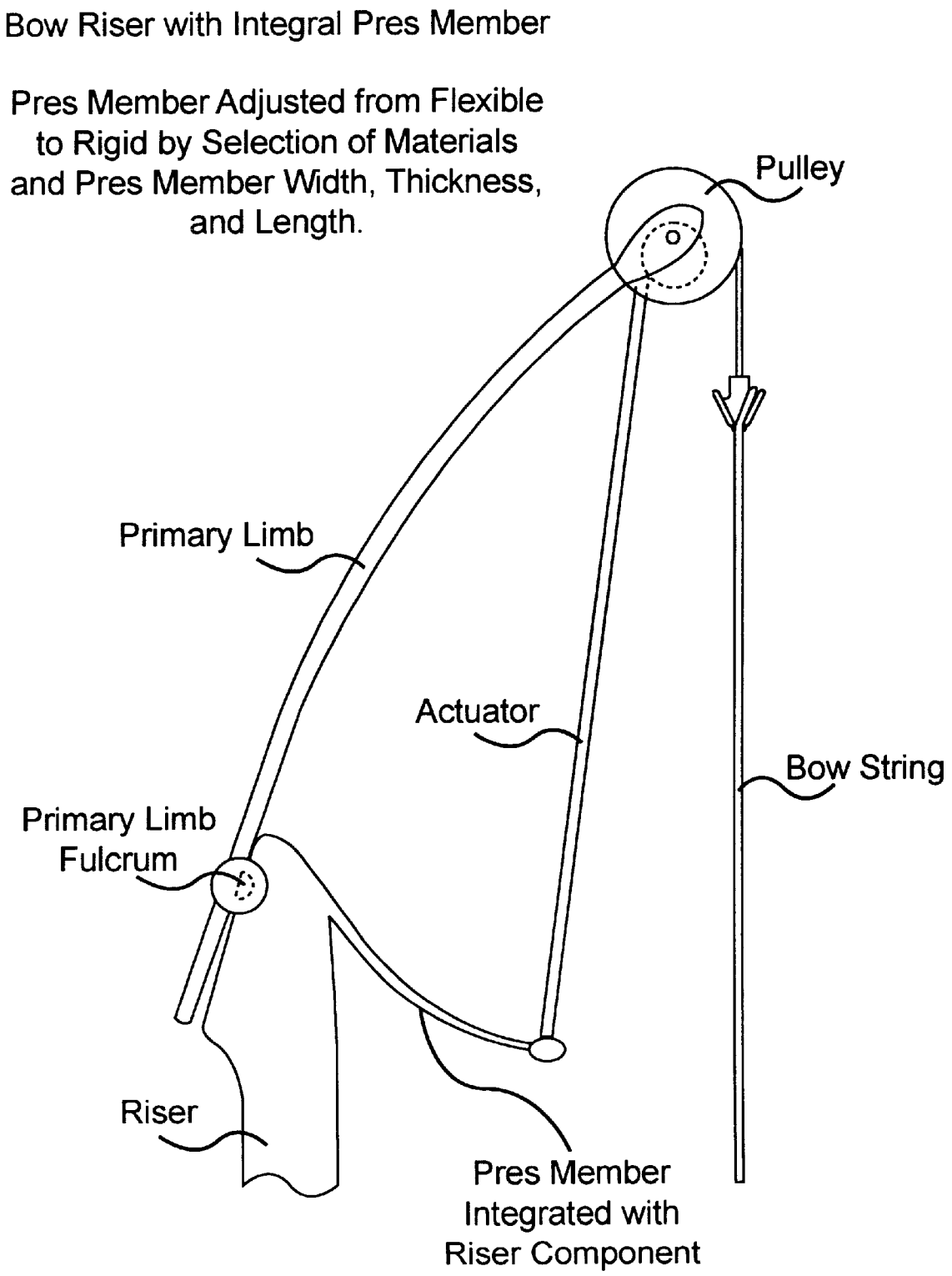

In the preferred embodiment, the inventive bow is configured to use separate PRES components, joined mechanically to the end of the bows main riser body. Alternate configurations consisting of PRES elements joined in an integral manner to either the primary limb, near the base (FIG. 13), or to the riser in the same general area (FIG. 14), as well as configurations wherein the PRES elements were joined mechanically to the primary limbs are possible as well. The preferred embodiment suggests use of a separate (non-integral) PRES component, mechanically joined to the riser since this configuration both 1) allows the simplest means of providing interchangeability of limbs of varying draw weights and lengths, and pulleys of different sizes or types, which might also affect PRES length and/or stiffness requirements, and 2) further provides the simplest means of producing and maintaining a suitable inventory of parts by manufacturers, capable of easily producing bows to meet the requirements of all sizes of archers, and while minimizing the number of component types and sizes needed to do so.

FIG. 10 also shows the most typical arrangement in terms of mounting both the primary limbs and PRES components on the bow. While other angles with respect to the bow's vertical centerline may be used when configuring the primary limbs and pres components to coact with the riser component, and many variations regarding whether the pres components and primary limbs are integral parts of the riser or each other, it will be the case that the most effective arrangements of these components will be achieved when the following conditions are met:

(a) when the angle between the base of the primary limb and the vertical centerline of the bow's riser component is such that when the primary limb is connected to the bow's riser, and the bow is in an assembled but undrawn state, an imaginary line connecting the endmost tip of the limb to the endmost base of the limb, when extended from the endmost tip of the limb, in the direction of and beyond the endmost base end of the limb, would intersect a plane that horizontally bisects the bow's riser at it's center, at a point in front of the bowstring actuator segment.

(b) when the angle between the base of the PRES component and the vertical centerline of the bow's riser component is such that when the PRES component is in place, and the bow is in an assembled, but undrawn state, an imaginary line connecting the endmost tip of the primary limb mounted at the same end of the bow's riser, to the endmost point of thetip of the PRES component at the same end of the bow, when extended from the endmost point of the primary limb tip, in the direction of and beyond the endmost point of the PRES component, would also intersect a plane that horizontally bisects the bow's riser at it's center, at a point in front of the bowstring actuator segment.

FIG. 10, further illustrates that the bottom or "throat" of the grip (73) of the bow (also shown as (6), FIG. 1) is located at a point behind (back towards the archer) the fulcrum point (79) of the primary limbs (110). Positioning the grip thusly provides that every draw length of archer can use limb-pulley combinations which effectively result in greater limb deflection and therefore greater energy storage during the drawing of the bow, than would occur if the grip were located farther forward. This is common knowledge to bow builders.

However, in prior art bows, such far back positioning of the grip on the bow served to also make the bow more sensitive to hand torque introduced by the archer, and therefore inherently somewhat less accurate while being somewhat faster shooting. In prior art bows therefore, such a tradeoff constituted at best a "net neutral" type of design change since arrow velocity may be increased, but reaction of the bow to hand induced torsion is made worse in the process. In the inventive configuration, the bow grip can be placed rearward of the primary limb fulcrum (79), back to a point where the PRES fulcrum point (80, 81) occurs, without increasing the adverse effects of shooter hand-induced torque on accuracy. This occurs because the resultant force on the riser in the inventive bow originally emanates from two fulcrum points, instead of just one. Thus, in the inventive bow, similar grip placement yields a "net positive" design change since arrow velocities can be increased without increasing the negative effects of hand induced torsion in the process.

A second benefit relating to spreading the resultant forces from drawing the bow over two points at each end of the riser is that up and down movements of the limb ends and PRES members ends, during the forward cast period, serve to partially offset one another, from a shock and vibration standpoint, when the slack all runs out. To illustrate, only the limb and PRES member at the top end of the bow will be referenced here. Shock in the primary limb attempts to move the limb tip up and toward the target, while shock in the PRES member attempts to move the PRES member's tip down and toward the target. These shock inducing forces have to be balanced for the bow to function properly. While the forward motion element of.shock remains unchanged, the up/down element of shock to the system tends to be minimized at each end of the bow.

Figure 11:
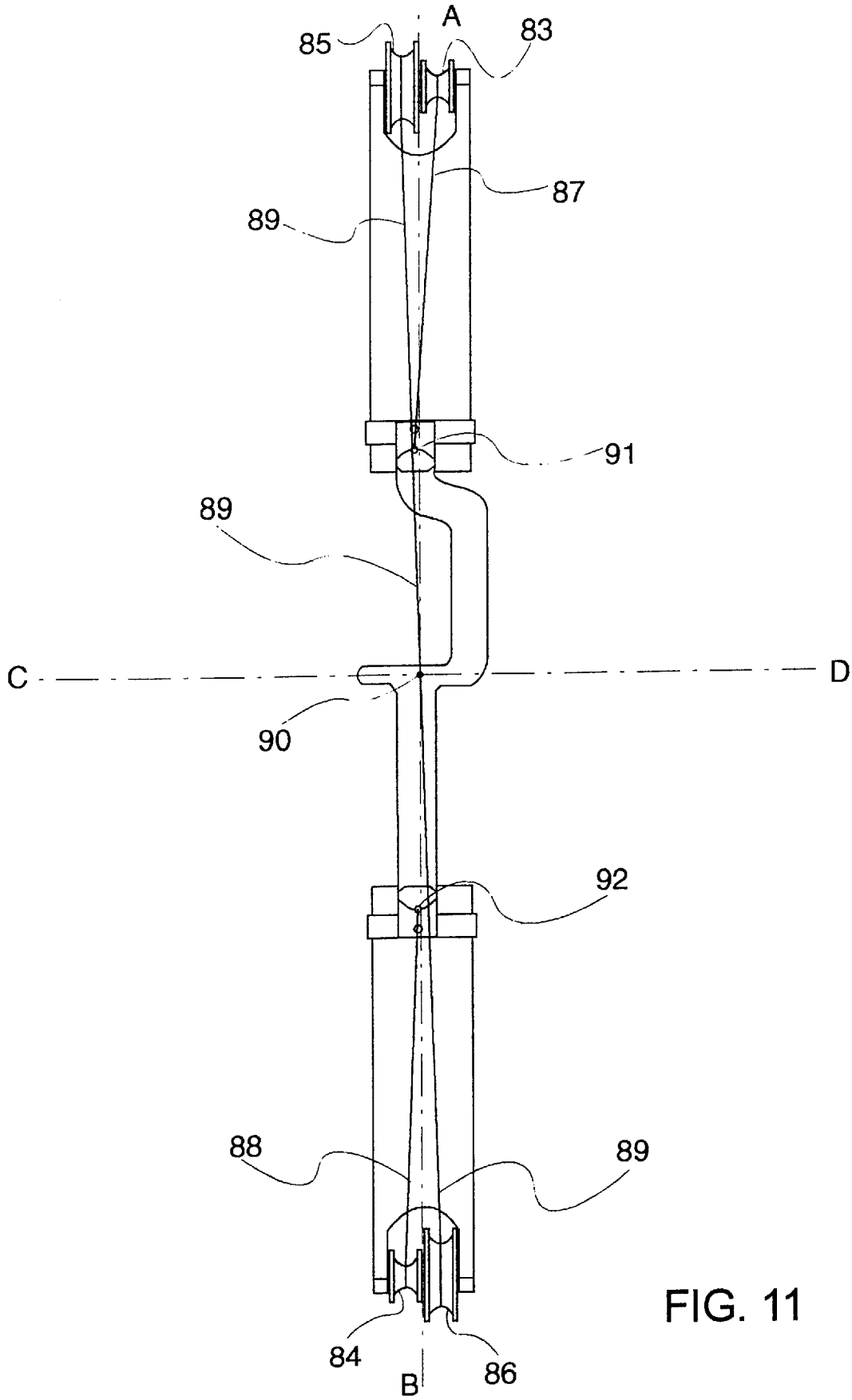
FIG. 11. FIG. #11 is a view from the rear of the asynchronous compound bow, shown in FIG. #10, as described in the preferred embodiment of the invention. In this view the non-parallel and non-co-planar rigging of the bowstring and tensioning actuators, with respect to a plane containing the the vertical centerline of the bows primary limbs, except at points of intersection with the vertical-centerline-containing-plane, is shown.

FIG. 11, is a rear elevation of the bow shown in FIG. 10. In this elevation the means for eliminating torsion in the limbs, resulting from pulley-actuator actions is shown. Pulley and limb widths are greatly exaggerated in this figure and in FIG. 12, to better illustrate non-co-planar tensioning actuator and bowstring angles with respect to the vertical centerline of the bow. In both FIGS. 11 and 12, Line AB defines the lengthwise vertical centerline of the bow's riser, grip, primary limbs, and PRES components. The pulleys two side-by-side grooves are located at approximately equal distances on either side of the vertical centerline of the bow, when mounted on the bows primary limbs.

Given normal width pulleys (about ⅜" wide), the inventive bow allows primary limbs to be made significantly (approximately 40%) less wide, when compared to bow limbs on bows having bisynchronous pulley arrangements incorporated at the ends of the bow limbs, since no width is needed to accommodate either cable tieoff (anchor) rollers or hanging load-distributing cable-harness assemblies on the axles, especially when the bow embodies in it's makeup limbs constructed with helically overwrapped fibers as described in FIG. 6. The significant reduction in limb width provides a proportionally significant reduction in limb mass which has to be accelerated forward upon release. The reduced limb mass provides that a proportionally increased amount of stored energy will therefore be left over for purposes of accelerating the string and arrow forward when the string is released, and that shock and vibration will also be proportionally reduced.

The pulleys in FIG. 11 are shown to be reversed on opposite limbs of the bow. That is, the secondary side of the pulley on the top limb (83) is located on the opposite side of the vertical centerline of the bow from the corresponding side of the pulley (84) mounted on the bottom limb of the bow. The same holds true for the related primary sides (85,86) of the pulleys mounted at opposite ends of the bow, that being that each is located on opposite sides of the vertical centerline of the bows limbs, riser, grip, and PRES components.

It is readily apparent from viewing FIG. 11, that the end result of reversing the pulleys at opposite ends of the bow results in all tensioning actuator segments (87,88), including the bowstring segment (89), being nonaligned with the plane represented by line (AB) in the drawing which defines the centerline of the bow's riser, grip, primary limbs, and PRES components.

The point (90) where the bowstring intersects the plane which contains the vertical centerline of the bow's riser, primary limb, and PRES members, is the vertical center of the overall bow, and, given the inventive riser design as defined by the preferred embodiment of that component described earlier, also represents the primary pull point on the bowstring by the archer, said point also lying in the plane representing the horizontal centerline of the bow, which concurrently intersects at the same point. The resultant force registering on the bows limbs at all times, coming from pressure induced by the bowstring, is thus entirely centered in the same plane as the centerline of the bows riser, grip, primary limbs, and PRES members, even though only a single point on the string, itself, is in this plane, that being the point at which the bowstring coincides with said vertical and horizontal centerline planes.

The point where each tensioning actuator segment emerging from the secondary side of the bows pulleys (83,84), is tied off on it's associated PRES member is likewise at an intersection point (91,92) with the plane which contains the centerline of the bow's riser, grip, primary limbs, and PRES members. The resultant force associated with the actuators connected to the PRES members ends, is therefore also centered in the same plane as the bow's riser, grip, primary limbs, and PRES members, even though only a single point on each of the actuator segment themselves lie in said plane, that being the point at which the actuators intersect said plane, at the point where they are connected to their respective PRES members.

The key difference between the inventive approach depicted in FIG. 11, and prior art methods, in terms of eliminating torsion in the system, is that in most prior art bows of the bi-synchronous type, one or more of the leverage inducing actuator elements, including the bowstring segment, of the bow were aligned in planes that either coincided with the plane defining the vertical centerline of the bow's riser, grip, and limbs (and pylons used to attach tensioning actuators in some asynchronous configurations), or lying closeby in other planes which were substantially parallel to such vertical limb-centerline-containing plane.

In most prior-art compound bows of a bi-synchronous type, due to the requirement to employ cable "guards" to deflect cables away from arrow shafts and fletching, the tensioning actuator and bowstring lay in intersecting planes which intersected at points beyond the ends of the bow.

In no prior art bow of a bi-synchronous or asynchronous type having any actuator segment non-coincident or non-parallel with the vertical centerline of the bows limbs, did the pulley/actuator combination result in elimination of pulley-induced torsion in the system. In the inventive bow of this invention, configured in the asynchronous manner as shown in FIG. 11, none of the actuator segments, including the bowstring segment, lie entirely in such a parallel or coincident plane, but instead lie in planes which intersect at a point between the pulleys, and between the vertical planes containing the pulley grooves. It is also the case in the inventive bow that the non-parallel and non-coincident actuator riggings do result in the elimination of pulley-induced torsion in the system.

In the inventive bow, as shown in FIG. 11, although only the single intersection points, noted in the preceding paragraphs, of the actuator segments, including the bowstring segment, themselves lie in the same plane as the plane defined by the centerline of the bow's riser, grip, primary limbs, and PRES members, the entire resultant force associated with their use does register entirely in that plane, thereby eliminating pulley-actuator induced torsion from registering in the bow's riser, grip, primary limbs, and PRES components.

Prior art bisynchronous compound bows have utilized approaches wherein the pulleys sides were reversed with respect to one another when mounted on limbs at opposite ends of the bow, but which maintained a bowstring segment lying in a plane substantially coincident or parallel to with the vertical plane defined by the bows limbs and riser (Simonds, et al, U.S. Pat. No. 4,368,718), and also in other non-patentable configurations wherein both pulleys placed the secondary side of the pulley mounted on each of the bow's limbs facing either in, toward the back side of the sight window, or out, toward the opening on the sight window of the bow, with the bowstring still lying either in a plane substantially parallel to, or directly in the same plane as the centerline of the bows riser, grip, and limbs.

All such prior art approaches in bows based upon bisynchronous pulley-actuator operation, proved to be marginally effective (if at all) in terms of reducing overall torque in the system, since, in order for the archer to be able to use them, cable deflectors or "guards" also had to be deployed in order to move the tensioning actuator segments over far enough away from the vertical centerline of the bow to allow an arrow to be mounted on the string in alignment with the vertical centerline of the bow's limbs, to be made ready for shooting. Cable deflectors ("guards") were also needed in such prior art bisynchronous configurations to thereafter provide cable clearance for the arrows fletching as the arrow was being propelled forward out of the bow. The concurrent need to use cable deflectors with these inventive bisynchronous approaches resulted in reintroducing pulley-actuator torsion to the system since the plane containing the resultant force associated with the tensioning actuators was therefore moved substantially off to one side of the vertical centerline of the limbs, to a point in a plane intermediate the plane containing the vertical centerline of the bows limbs, and a non-parallel plane containing the point where the tensioning actuators passed over the cable deflector column(s), thereby causing substantial pulley-actuator related torque to be reintroduced into the system during operation of the bow. Other bisynchronous approaches attempted to moderate the torque reintroduced when cable guards were employed to provide shaft and fletching clearance, by adding either "idler pulleys" or "load-balancing yolks" to the limbs. These approaches were only marginally successful, since the resultant forces resulting from their use were essentially unchanged. The primary function of these (idlers and load-balancing yolks) approaches was to redistribute where, along the length of the limbs (or riser), the torque initially registered. Idler pulleys caused more of the torque to register about ½ way between the tip end and base end of the limbs, rather than entirely at the limb ends. Load-balancing yolks caused more of the total torque load to be equally distributed across each edge of the limb ends (no apparent crotch arm tippage apparent to the archer), but pulled the entire limb end off in the direction of the point where the tensioning actuators passed over the cable guard. Neither prior art approach eliminated pulley induced torque, and all prior art approaches required more components and complexity to be made part of the bow.

When the actuators are deployed as depicted in FIG. 11, in conjunction with the other elements of the invention as described in FIGS. 1–10, the result is an asynchronous compound bow which is not only completely free from the negative effects of pulley-actuator induced limb torsion, but which further embodies all of the other characteristics of an ideal compound bow as defined in Section IV. of this patent application, and which solves, in a complete manner, all of the performance-engineering challenges relating to all prior art bisynchronous and asynchronous compound bows.

Figure 12:
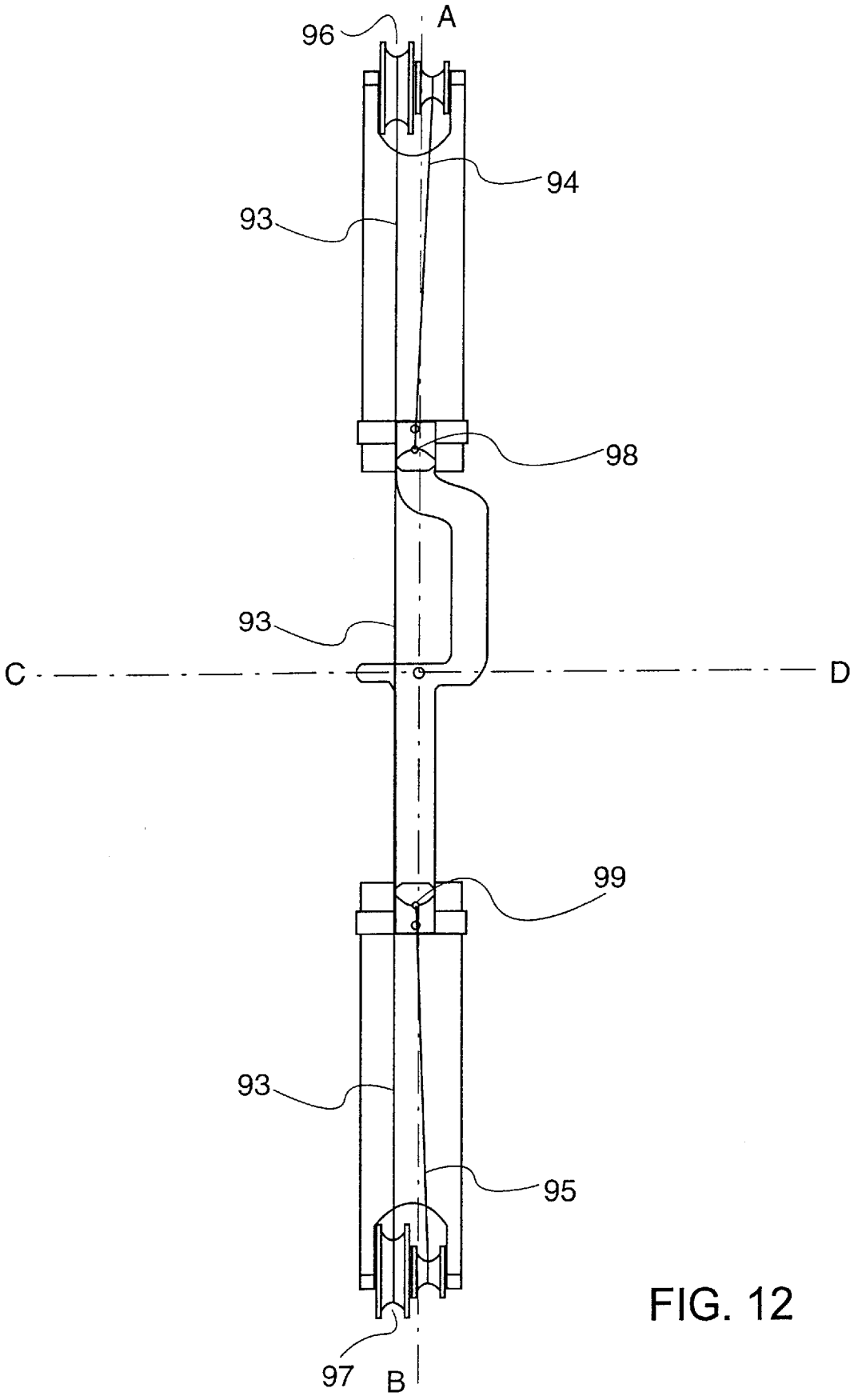
FIG. 12. FIG. #12 is a view from the rear of an alternate embodiment of an asynchronous compound bow as described in the body of the patent application. In this view an embodiment is shown which includes some non-parallel and non-coincident tensioning actuator riggings, with respect to a plane containing the vertical centerline of the bow's primary limbs, while employing a bowstring segment that is parallel to, but not coincident with a plane containing the vertical centerline of the bow's primary limbs.

FIG. 12, is an elevation from the rear of an alternate embodiment of the bow shown in FIG. 10. In this configuration, the bowstring (93) lies in a plane that is substantially parallel to, but not necessarily coincident with, the plane defined by the vertical centerline of the bow's riser, grip, primary limbs, and PRES members (represented by line AB in the drawing), while the actuator segments (94,95) tied off on the PRES members lie in a plane which is not parallel to the bows vertical centerline.

In FIG. 12, in each pulley, the pulley groove whose actuator segment leads to the bowstring (96,97), and the pulley groove whose actuator segments (94,95) lead to tieoff points on the PRES's (98,99) lie at approximately equal distances from, but on opposite sides of the plane defined by the vertical centerline of the bow's riser, grip, primary limbs, and PRES members (the vertical centerline is represented in the drawing by line AB.) The resultant force associated with the actuator segments working in concert during operation of the bow would lie in a plane running parallel to the vertical centerline of the bows other elements, positioned between the pulley grooves, and be very near to, but not necessarily always completely coincident with the plane defined by centerline of the bow's riser, grip, primary limbs, and PRES members.

The inventive bow configured as shown in FIG. 12, would therefore also achieve a resultant force which manifested itself in a near-zero amount of pulley-actuator induced limb torsion at all points in time, and which would be far superior to any prior art compound bow offering comparable latitude to bow builders in terms of it's ability to better meet all of the desirable characteristics of a compound bow as described in Section IV. of this patent application.

The bowstring and actuator deployment illustrated in FIG. 11, represents what is believed to be the preferred embodiment, since it may produce marginally better performance than any of (perhaps several) other embodiments of the invention. However, virtually any embodiment of the invention utilizing, in a variety of possible configurations, including the configurations shown in FIGS. 11 and 12, as well as possible other embodiments wherein the bowstring was coincident with the plane containing the vertical centerline of the bow, but wherein the tensioning actuator segments lay in different non-parallel planes; or embodiments wherein the tensioning actuator segments were coincident with the plane containing the vertical centerline of the bow, but the bowstring lay in a different, non-parallel plane, or embodiments wherein the bowstring and tensioning actuator segments lay in planes parallel to, but not necessarily coincident with, the plane containing the bow's vertical centerline, and other embodiments which otherwise employed the general component mix, and configurations defined in the preferred embodiment, and shown in FIGS. 1 through 12 in this application, would be superior in terms of allowing fulfillment of all of the objectives described in section IV, than is any prior art compound bow. To the extent that the drawings and illustrations contained herein might suggest alternate embodiments other than those shown here, to those practiced in the art, such alternate embodiments are intended to fall within the scope and spirit of, and be covered by this invention.

SUMMARY OF MEANS, STRUCTURES, AND COMBINATIONS MEETING REQUIREMENTS FOR PATENT COVERAGE

Unique Combination of Elements

The inventive combination, obtained by using a combination of: (1) asynchronous operation of the limbs, pulleys, and actuators, (2) two-grooved, dual-planar compound pulleys, (3)resilient, separate, PRES components, and (4) unique non-coplanar actuator riggings (wherein at least some tensioning actuator segments, including the bowstring segment, may lie in planes that are neither parallel to, or coincident with, the plane containing the vertical centerline of the bow, except, at points of intersection with said vertical centerline plane) which allows great latitude in terms of selecting draw lengths, energy storing patterns, and power-stroke distances, and which further results in torque-free pulley and actuator operation, and which successfully addresses, in a complete manner, all of the other performance and engineering-related criterea relating to both bisynchronous and asynchronous compound bows, as defined herein, while not requiring compromises in any of the performance-engineering areas, is thought to be patentable, since no prior art invention ever utilized a similar combination of elements in a similar configuration, in an attempt to successfully achieve similar results.

This aspect of the invention only purports to have discovered one new element (the separate independently flexing PRES components which have no pulleys directly attached to them) which are used in a dedicated manner to coact with the pulleys attached to the primary limbs, and tensioning actuators to provide an additional energy source, operating independantly from the primary limbs of the invention, suitable for further accelerating the rotational rate of the pulleys when the bow is released. The remaining elements in the combination comprising this aspect of the invention (pulleys, per se', limbs, actuators, etc.) can be found individually, in different formats, and used in different contexts in other individual prior art inventions. This invention seeks to describe a unique combination of old and new elements, said elements being combined in a manner which is different from all individual prior art references, and which combination produces a new, and superior range of solutions, in terms of successfully solving, individually and in combination, a large number of problems long worked on individually, but never solved either individually or in combination by other inventors in the field, in a manner that did not, at the same time, result in compromising or otherwise adversly effecting one or more of the other inter-related engineering and/or performance areas relating to compound bows that was not being worked on by the inventor at the time.

Additionally this invention produces an unexpected additional benefit not anticipated by the prior art in any individual reference or combination of references. By defining a flexing PRES component, in addition to a non-flexing PRES component, the invention provides a means whereby the rotational rate of the pulleys can be increased over prior art approaches, and made not solely dependant on the rate of return of the primary limbs of the invention. A bisynchronous compound bow is limited to having the rotational rate of the pulleys solely determined by the return rate of the limbs on the bow. The same dependant relationship is similarly defined in a bow of this invention wherein the PRES components are defined to be non-flexing. However, unlike the bisynchronous prior art, the bow of this invention having rigid PRES components still provides the full range of soughtafter problem solutions defined as being the objectives of the invention. But, when the PRES components are defined to provide a predetermined amount of flexure during operation of the bow, an unexpected additional benefit arises. By making the rotational rate of return of the pulleys not solely dependant on the rate of return of the primary limbs of the bow, not only do solutions to the long standing problems defined herein occur, but it becomes possible to increase the rotational rate of return of the pulleys to be greater than would (or could) ensue when the return rates of the primary limbs and their attached pulleys at each end of the bow are solely dependant on one another. The result is an unexpected increase in the rate at which the string can be made to move forward, and a resulting increase in the rate of acceleration of the arrow out of the bow at the time of release.

Additionally, the invention defines a different and superior motion as relates to the tensioning actuators. In currentart bows the tensioning actuators are carried back and forth the entire distance that the pulleys move during operation of the bow. In the instant invention, the tensioning actuators describe a modified pivotable arc during operation of the bow, which serves to minimize the amount of actuator mass that has to be moved over essentially the same distance as was the case for prior art bows, and provides the potential for further increasing the rate of acceleration forward of these elements during shooting of the bow.

The combination of elements described in this invention provides solutions to a plurality of engineering problem areas in a manner that does not involve compromising or otherwise adversly affecting any of the known engineering or performance-related areas which are unique to either bisynchronous or asynchronous compound bows, as described herein. No prior art compound bow invention is known to have attempted or accomplished a solution of such significant proportion.

Additionally, this aspect of the invention seeks to solve en total, a number of problem areas that may never have even been recognized at all by prior art practitioners. The unique combination of elements in this invention seeks to define and provide solutions to a complete list of all of the engineering and performance-related problem areas, defined herein, which have in the past adversely affected compound bows.

This occurs because the inventor in this case has, for the first time, defined a complete matrix (ninty-six elements in all) of interconnected problems which must all be solved concurrently, in order to affect a complete solution to problems facing compound bow designers. This invention profits from having a complete and detailed definition of the problem(s) stated as the starting point, whereas prior art inventions sought to solve individual engineering problems without understanding the relationship of a given engineering problem, to the whole matrix of other inter-related, engineering and performance problem areas affecting compound bow design, and therefore began their efforts with an incomplete understanding of combined nature and the totality of problems facing them.

The modifications to some elements of the invention, which may appear in a different forms and contexts in other individual inventions comprising the prior art, were clearly not suggested by the prior art. In fact, at least some of the elements of the combination comprising the basis of this invention, are taught against in the relevant prior art. The non-coplanar aspects of the actuator riggings are a case in point. Prior art asynchronous inventors seek to show that having all co-planar elements is required in order to effect elimination of pulley-induced torque in the system. Likewise, all prior art teaches that dual-planar compound pulleys should provide that the primary leverage-inducing side should be eccentrically mounted with respect to the axle hole, which is diametrically contrary to the approach taken in the preferred embodiment of this invention. No prior art suggests the use of a separate, flexing member per se' dedicated to providing enhanced rotational rates for the pulleys of the invention.

Changes in the Means by which Mechanical Advantage is Achieved

The concentric-eccentric pulley of the invention, which provides that the primary lever arm remains constant in length, while the secondary lever arm varies in length to accommodate desirable energy storing patterns in compound bows having (primarily) asynchronous operation, is thought to be patentable with respect to it's use in combination with the other elements of the combination described herein, since no prior art bow has ever used a similar pulley, acting alone or otherwise with respect to other pulleys in the system, as the primary leverage inducing element of the pulley system. The concentric-eccentric pulley provides an additional benefit in that shorter and more stable limb-crotch arms may be employed in bows using this type of compound pulley.

Essentially, this aspect of the invention seeks to contradict the prior art teachings, by reversing the means by which mechanical advantage is achieved. All prior art teaches that the primary lever arm should vary in length, resulting from an eccentric placement of the axle hole with respect to the geometric center of the primary side of the pulley.

In this aspect of the invention a second completely new element is proposed for use in the combination of elements referenced earlier. No prior art uses a primary leverage-inducing pulley, having the primary lever arm that represents a constant length.

Changes in the Means for Providing Positive Limb Alignment in the Bow

The limb alignment components of the invention which coact with a separate main body section in a three piece riser configuration which includes a well defined means for tooling up and producing both the main body section, and the coacting limb alignment components from higher strength materials, yet in a more cost-effective manner, and which further provides that the separate limb alignment components co-act with the main body to accomplish all of their functions, in a free-floating manner, without being fixedly attached to either the riser body or the limb member, and without the need for axles, or other functionally-related but separate co-acting components, while eliminating undesirable weight from the bow, is thought to be patentable, since no such means of effecting limb alignment has ever been integrated for use with a similar main body of a bow riser in prior art bows, nor has any such process for manufacturing separate co-acting limb alignment components been known to be utilized in prior art bows of any kind.

In this aspect of the invention, a third completely new element has been integrated into the riser component that forms the basis for mounting of the other elements in the aforementioned combination of elements which uniquely define the overall invention.

Changes in the Means for Reducing Susceptibility to Torque Registration and Lengthwise Shearing in the Bow's Limbs and Pres Components The invention defines alternate, and superior, means for incorporating reinforcing fiber orientations in the limbs and pres components which yield improved performance in every related area. The inventive bow limbs, incorporating a combination of zero degree, ninety degree, and helically placed reinforcing fibers surrounding the entire outside circumference of the limbs at an angle with respect to the vertical centerline of the limbs, is thought to be patentable, since no prior art bow has ever used helically oriented fiber orientations in it's limbs for purposes of achieving torsional stability and improved durability, nor has any known prior attempt been made to manufacture bow limbs using a process similar to the process described in the invention.

This aspect of the invention seeks to define an alternate means of reinforcing bow limbs and pres components, in an integral manner, making them less suceptable torque, and making the limbs less susceptible to developing lengthwise cracks in the crotch area, and therefore also being more durable, while concurrently eliminating the need for employing the types of additional external attachments to the limbs that have been required in prior art bows to accomplish the required and necessary level of reinforcement and torque suppression.

Accomplishing Multiple Functions with a Single Component, which Otherwise would Require Multiple Components to Effect Similar Functions The inventive incorporation of rectangular-cross-sectional channeled sightpin slots in the sight window area of the bow, said slots being channeled on one side in a manner that allows them to coact with non-round sight pin locking nuts (prohibiting their turning) when used with industry standard sight pins is felt to be patentable, since no prior art bow has employed slots which incorporate nut engaging channels. The incorporation of the nut engaging channels allows sight pins to be used which only require two locking nuts for each threaded sight pin (one depressed in the channel, and one on the opposite side of the sight window), rather than three or more locking nuts to be used by the archer as is the case with prior art sight pins, and greatly simplifies sight adjustment procedures for the archer.

This aspect of the invention describes a means of ommitting an element embodied in prior art (a third locking nut, and/or additional separate "slide" elements), while retaining all of the functionality of the prior art approaches.

Having thus described the prior art and the preferred embodiment of my invention, I now claim the following:

1. A shooting archer's bow comprising:

(a) a rigid elongate handle riser assembly having opposite ends and a central handle portion, with the central section providing a hand grip area below the horizontal center of the riser assembly proximate to the horizontal centerline, and at least one linear offset section suitable for use as a sighting window above the vertical centerline of the riser, with the bottom of the sight window recess being proximate to the horizontal and vertical centerlines of the riser assembly, (b) a bowstring section suitable for use by the archer in drawing the bow, consisting of opposite ends and a center portion, (c) a pair of elongate, resilient, primary limbs, one attached to each of the ends of said riser assembly, with each primary limb consisting of a base section at one of it's ends, a tip end section at it's other end, and a center section joining the base and tip sections, the limbs endmost tip sections defining outer limb tips at the opposite ends of the bow, (d) a pair of mounting means for connecting and holding the base section of each primary limb to said riser assembly in cantilever manner at a substantially fixed vertical orientation with respect to it's related riser end's endmost point and at a predetermined angle with respect to an imaginary line drawn connecting the outermost points at each opposite end of the riser assembly such that a straight line connecting the elongate centerpoint of the base section end and the elongate centerpoint of the outer tip section end would, if extended away from the tip section of the limb, toward and beyond the base section end of the limb, intersect a plane projected horizontally through the center of the riser assembly that was perpendicular to the plane of bowstring travel, at a point in front of the bow's bowstring, when the bow is assembled but in a pre-drawn condition, with each mounting means providing a horizontal fulcrum area for the underside of each primary limb to be bent over and to bend against when drawing the bow, with the horizontal centerline of the mounting means fulcrum lying in a plane substantially parallel to the plane horizontally bisecting the bow's riser assembly, with each mounting means further operating in a manner to provide sufficient lateral restraints to keep the base end section the base of the primary limb that it connects to and restrains, substantially fixed in a constant lateral position during operation of the bow, thereby constraining clockwise or counter-clockwise motion in the primary limb, (e) a pair of resilient pulley return energy source components, hereinafter referred to as pres components, each having a base section, a tip section, and a center section joining the base and tip sections, with the base section of one such pres component disposed near each end of the riser assembly proximate to the base of the primary limb mounted at the same end of the bows riser, with each pres component providing a means of securing in place, near the tip end of said pres component, one end of an tensioning actuator segment, (f) mounting means for connecting and securing in place the base section of each pres component to the bow, proximate the location on the bow where the base end of the primary limb operates over it's fulcrum, in a cantilever manner with a substantially fixed vertical orientation with respect to it's related riser end's most endmost point, and with it's base end section fixed in place at a pre-determined angle with respect to the primary limb mounted at the same end of the bow's riser assembly, such that a straight line connecting the elongate centerpoint of the outermost tip end of the pres component to the elongate centerpoint of the outermost tip end of the primary limb mounted at the same end of the bow's riser assembly would, if extended in a direction away from the endpoint of the primary limb, toward and beyond the endpoint of the adjacent pres component, intersect a plane projected through the risers horizontal centerpoint that is perpendicular to the plane of the bowstring, at a point in front of the bow's bowstring when the bow is assembled but in an undrawn condition, said mounting means providing a fulcrum point along the pres component's length which serves as a (second) point of resistance for the primary limb mounted at the same end of the bow's riser component to bend against when drawing the bow, said pres fulcrum's horizontal centerline lying in a plane substantially parallel to the plane that horizontally bisects the bow's riser assembly, and said mounting means further operating in a manner providing sufficient lateral restraints to keep the base end section of each of said pres components substantially fixed in a constant lateral position during operation of the bow, thereby constraining clockwise or counter-clockwise movement in the pres components, (g) a pair of compound pulley assemblies each comprising a two-grooved, dual planar pulley having an axle hole passing through it, an axle for the pulley to revolve around during operation of the bow, a minimum of one flexible actuator means suitable for operating the pulley as a compound pulley, and a mounting means for securing the pulley assembly in place proximate the outside tip end of one of said primary resilient limb members, said pulleys each consisting of a first or primary side whose outside circumference is grooved to accept a flexible bowstring actuator means, an opposite or secondary side whose circumference is also grooved to accept a flexible tensioning actuator means, said pulley sides joined in a manner that causes each pulley side to remain fixed in position with respect to the other pulley side, with each compound pulley providing a means of constraining the actuator section relating to each side of the pulley in a manner that assures that the length of the free end of actuator section protruding from the initial point wherein said actuator section first makes contact with it's associated pulley groove will, when measured from the point of initial groove contact to the furthest endpoint of actuator section protruding from the same side of the pulley, remain substantially constant at all times once positioned in place during assembly of the bow, with one of said pulley assemblies being fixedly disposed near the outermost tip of each of said primary limbs in a manner so that the longitudinal centerline of each pulley's axle lies in a plane that is substantially parallel to the horizontal plane bisecting the bow's riser assembly, with each of the pulleys able to freely rotate about their axles in a plane substantially perpendicular to the longitudinal centerline of the axle the pulley is rotating around, while providing a means at the free end of the flexible tensioning actuator section protruding from said secondary side pulley groove suitable for attaching in a secure manner that actuator segment's endpoint to a point near the tip end section of the pres component mounted at the same end of the bow's riser, and providing at the free end of the flexible actuator segment protruding from the primary side pulley groove a means of fixedly attaching to one end of said bowstring actuator section, with the free end of each secondary pulley side tensioning actuator segment proceeding directly to the designated point of attachment near the end of the pres component mounted at the same end of the bow's riser assembly to there be secured position at the point provided for that purpose on the pres component, in a manner providing that rotation of the pulley around it's axle during drawing of the bow will cause the length of tensioning actuator section protruding from said secondary pulley side to become engaged in and become wrapped around the groove provided for that purpose on the secondary side of the pulley, with the free end of said actuator segment exiting the primary side of the pulley to be fixedly attached to one end of the bowstring section after having been wrapped partially around the circumferential groove in that side of the pulley when the bow is assembled but in an undrawn condition, the combined primary and secondary pulley side actuator positioning during assembly of the bow suitable to provide that drawing of the bowstring actuator segment will cause the actuator portion exiting from and pre-wrapped around the primary pulley side actuator groove, to be unwrapped from around it's pulley groove, thereby adding draw length to the system, and the actuator portion exiting from and associated with the secondary pulley side actuator groove, to concurrently become wrapped around the actuator groove in the secondary side of the pulley, thereby applying bending pressure to the primary limb that the pulley is directly attached to by bending against the fulcrum point of the primary limb and the fulcrum point of the pres component to which the free end of the secondary pulley side's tensioning actuator segment is attached, these pulley, limb, pres component, and actuator motions being reversed as the bow returns from a drawn to an at-rest condition, with the motion of each tensioning actuator section engaging the secondary side of it's associated pulley describing a modified pivotal arc during operation of the bow, and with the bowstring actuator segment and tensioning actuators deployed in a manner such that at least one actuator segment does not lie entirely in a plane containing the lengthwise centerline of a primary limb, when the bow is in an assembled state.

2. A bow as in claim #1 wherein at least one pres component consists of a flexing member.

3. A bow as in claim #2, wherein at least one flexing pres component is mechanically connected directly to the bow's riser component.

4. A bow as in claim #2, wherein at least one flexing pres component is an integral part of the riser component.

5. A bow as in claim #2, wherein at least one flexing pres component is mechanically connected to the primary limb member mounted at the same end of the bow's riser.

6. A bow as in claim #2, wherein at least one flexing pres component is an integral part of the primary limb mounted at the same end of the bow's riser.

7. A bow as in claim #1, wherein at least one pres component is substantially non-flexing.

8. A bow as in claim #7, wherein at least one substantially non-flexing pres component is mechanically connected directly to the bow's riser component.

9. A bow as in claim #7, wherein at least one substantially non-flexing pres component is an integral part of the riser component.

10. A bow as in claim #7, wherein at least one substantially non-flexing pres component is mechanically connected to the primary limb member mounted at the same end of the bow's riser.

11. A bow as in claim #7, wherein at least one substantially non-flexing pres component is an integral part of the primary limb member mounted at the same end of the bow's riser.

12. A bow, as in claim #1, which has in it's makeup at least one flexing primary limb or flexing pres component that incorporates reinforcing fibers wrapped in a radial manner around it's entire circumference in at least one directional orientation.

13. A bow as in claim #12, wherein at least some of the reinforcing fibers used in construction of the members are comprised of preimpregnated tapes.

14. A bow as in claim #12, wherein at least some of the radially wrapped fibers are originally positioned by overbraiding.

15. A bow, as in claim #1, wherein the riser component is a multiple piece sub-assembly comprised of a main body section which coacts with separate limb alignment components via a joining means located near each end of the main riser body section.

16. A bow as in claim #15, wherein the main body section of the riser subassembly is produced from a preforged material billet having sight window offset and/or arrow shelf reliefs incorporated in the preforged billet such that right-hand and left-hand riser main body sections may be produced from the same preforged billet by using the same profiling pattern or CNC machine program.

17. A bow as in claim #15 wherein the main body section joining means for coacting with at least one of the separate limb-alignment components is comprised of a concave-shaped relieved section located proximate an end of the main body section of the riser sub-assembly.

18. A bow as in claim #15 wherein at least one limb alignment component of the riser sub-assembly incorporates two upward directed flanges each having an inside surface area and outside surface area and a distance between their inside surface areas such that a bow limb's base portion fits within the distance between the inside surface areas, said upward projecting flanges being of sufficient height above the in-between flange base surface, to restrain side-to-side, clockwise rotational, or counter-clockwise rotational movement of the bow limb when the limbs are mounted on the bow in conjunction with the limb alignment component, a base surface relating to the between inside surface distance between the inside surfaces of the upward projecting flanges suitable for the base of the bow limb to rest upon, two downward projecting flanges each having an inside surface and outside surface and a distance between these inside surfaces sufficient to allow the downward projecting flanges to slip over the parallel sides of the bow riser in the area provided for mounting the limb alignment component on the riser, in a manner that provides that the downward projecting flanges extend lengthwise to a point that would cause them to engage the sides of the riser if an attempt were made to move the limb alignment component itself, from side-to-side, or in either clockwise rotational or counter-clockwise rotational directions after being mounted on the riser, with the shape of the area of the allignment component that is between the downward projecting flanges curved in a convex shape designed to fit and coact with a matching concave-shaped relieved area on the bow's riser component, said curved surface providing the capability to rotate the pitch of the limb in a manner that would allow for placing either more or less prestress in the primary limb housed by the limb alignment component when the bow is in an assembled state.

19. A bow as defined by claim #1, having a riser main body section which incorporates a minimum of one sight-pin slot passing through the riser from side-to-side provided for in it's sight window area, with said slot incorporating at least one recessed channel along at least part of the length of one side of the slot, with the channel to be of sufficient depth, width, and shape to fixedly engage and keep from turning either clockwise or counterclockwise the sides of sight-pin locking nuts when such lock-nuts are not round.

20. A bow as in claim #1, incorporating in it's makeup at least one pulley having a larger circumference round primary pulley side and a smaller circumference round secondary side and a distance between them, said pulley sides joined in a manner that causes each pulley side to remain fixed in a constant position with respect to the other, an axle hole passing completely through the pulley from side to side, the axle hole being positioned at the geometric center of the primary side of the pulley, and the axle hole being not at the geometric center of the secondary side of the pulley, with each of the pulley's side's outer circumference incorporating a concave shaped groove of sufficient depth to retain the type of flexible actuators selected for use with the pulley, with the pulley providing a means of holding in position the actuator or actuators associated with each side of the pulley so that the length of each pulley side's actuator segment remains substantially constant during operation of the bow, said pulley providing that the motion relating to the point where the free end of the actuator exiting the pulley groove in the primary side of the bow during rotation of the pulley would appear to remain substantially constant, whereas the motion relating to the point where the free end of the actuator exits the secondary side of the pulley during rotation of the pulley would appear to describe an elliptical arc, thereby allowing the leverage applied by the actuator(s) to the cable tieoff point on the bow in the case of the actuator exiting from the secondary side of the pulley, or to the bowstring in the case of the actuator exiting from the primary side of the pulley, to vary in a variety of patterns depending on the degree of eccentricity of the axle hole position with respect to the secondary side of the pulley while maintaining an axle hole position that is geometrically centered with respect to the primary side of the pulley.

21. A bow as in claim #1, wherein the bowstring actuator segment and the tensioning actuator segments comprise a single continuous strand of actuator material.

* * * * *

UNITED STATES PATENT AND TRADEMARK OFFICE

CERTIFICATE OF CORRECTION

PATENT NO. : 6,470,870 B1
DATED : October 29, 2002
INVENTOR(S) : John G. Schaar

It is certified that error appears in the above-identified patent and that said Letters Patent is hereby corrected as shown below:

Title page,
Item [54], first word in the title of the invention should read -- ASYNCHRONOUS -- not "SYNCHRONOUS"

Signed and Sealed this

First Day of April, 2003

JAMES E. ROGAN
*Director of the United States Patent and Trademark Office*